US009901149B2

(12) United States Patent
Arndt et al.

(10) Patent No.: US 9,901,149 B2
(45) Date of Patent: Feb. 27, 2018

(54) CANOPIES AND CANOPY SUPPORT STRUCTURES

(71) Applicant: ARTiculatedshade, LLC, Boulder, CO (US)

(72) Inventors: Jennifer McConnell Arndt, Boulder, CO (US); Kyle Robert Arndt, Boulder, CO (US)

(73) Assignee: ARTiculatedshade, LLC, Boulder, CO (US)

( * ) Notice: Subject to any disclaimer, the term of this patent is extended or adjusted under 35 U.S.C. 154(b) by 148 days.

(21) Appl. No.: 14/432,181

(22) PCT Filed: Sep. 27, 2013

(86) PCT No.: PCT/US2013/062448

§ 371 (c)(1),
(2) Date: Mar. 27, 2015

(87) PCT Pub. No.: WO2014/052916

PCT Pub. Date: Apr. 3, 2014

(65) Prior Publication Data

US 2015/0284973 A1 Oct. 8, 2015

Related U.S. Application Data

(60) Provisional application No. 61/706,130, filed on Sep. 27, 2012.

(51) Int. Cl.
*A45B 19/12* (2006.01)
*E04H 15/26* (2006.01)
(Continued)

(52) U.S. Cl.
CPC ..... *A45B 19/12* (2013.01); *E04H 15/26* (2013.01); *E04H 15/28* (2013.01); *A45B 25/06* (2013.01);
(Continued)

(58) Field of Classification Search
CPC ..... A45B 19/12; A45B 19/10
See application file for complete search history.

(56) References Cited

U.S. PATENT DOCUMENTS 23,503 A * 4/1859 Selden ..... A45B 19/12 135/25.2
5,263,505 A * 11/1993 Yeom ..... A45B 11/00 135/20.1
(Continued)

FOREIGN PATENT DOCUMENTS

DE 944147 C * 6/1956 ..... A45B 19/06
DE 102006053270 A1 * 5/2008 ..... A45B 19/04
(Continued)

OTHER PUBLICATIONS

English translation of DE944147C from espacenet.com.*
International Search Report and Written Opinion dated Jun. 9, 2014, PCT/US2013/062448, 5 pages.

*Primary Examiner* — David R Dunn
*Assistant Examiner* — Danielle Jackson
(74) *Attorney, Agent, or Firm* — Brownstein Hyatt Farber Schreck, LLP

(57) ABSTRACT

A canopy support structure includes first and second hubs coupled to and movable along the pole or first and second hubs of which one is coupled to and movable along a track. The first and second hubs are movable toward each other during extension of the canopy support structure and away from each other during retraction of the canopy support structure. A plurality of articulating arms is connected directly or indirectly to the first and second hubs. The articulating arms include sets of scissor-connected primary articulating arms. At least some of the sets of scissor-connected primary articulating arms are connected directly
(Continued)

to the first and second hubs and extend outward from the first and secondary hubs during expansion of the canopy support structure.

33 Claims, 45 Drawing Sheets

(51) Int. Cl.

| | |
|---|---|
| ***E04H 15/28*** | (2006.01) |
| ***A45B 25/06*** | (2006.01) |
| ***A45B 25/10*** | (2006.01) |
| *E04H 15/48* | (2006.01) |
| *E04F 10/04* | (2006.01) |
| *E04H 15/50* | (2006.01) |

(52) U.S. Cl.
CPC ..... *A45B 25/10* (2013.01); *E04F 10/04* (2013.01); *E04H 15/48* (2013.01); *E04H 15/50* (2013.01)

(56) References Cited

U.S. PATENT DOCUMENTS

| | | | | |
|---|---|---|---|---|
| 5,634,483 | A | 6/1997 | Gwin | |
| 5,927,310 | A * | 7/1999 | Lin | A45B 23/00 135/20.1 |
| 6,070,602 | A | 6/2000 | Ling | |
| 6,230,727 | B1 * | 5/2001 | Chen | E04H 15/28 135/127 |
| 6,354,315 | B1 * | 3/2002 | Liu | A45B 25/16 135/28 |
| 6,386,214 | B1 | 5/2002 | Clarke | |
| 6,601,599 | B2 | 8/2003 | Carter | |
| 6,868,858 | B2 | 3/2005 | Suh | |
| 6,929,017 | B2 * | 8/2005 | Byun | E04H 15/50 135/131 |
| 7,628,166 | B2 | 12/2009 | Carter | |
| 7,900,643 | B2 | 3/2011 | Ma | |
| 8,240,322 | B2 * | 8/2012 | Chang | A45B 19/00 135/27 |
| 8,511,327 | B2 * | 8/2013 | Sun | A45B 11/00 135/20.1 |
| 9,303,427 | B1 * | 4/2016 | Arndt | E04H 15/48 |
| 2004/0163691 | A1 * | 8/2004 | Ma | A45B 19/12 135/25.2 |
| 2007/0017561 | A1 | 1/2007 | Kuo | |
| 2007/0204891 | A1 | 9/2007 | Zubyk | |
| 2013/0340800 | A1 * | 12/2013 | Liu | A45B 11/00 135/20.1 |
| 2016/0222693 | A1 | 8/2016 | Arndt et al. | |

FOREIGN PATENT DOCUMENTS

| | | | | |
|---|---|---|---|---|
| EP | 1500758 | | 1/2005 | |
| FR | 3012728 | A1 * | 5/2015 | A45B 23/00 |
| GB | 1032315 | A * | 6/1966 | A45B 25/06 |
| GB | 1537174 | | 12/1978 | |
| RU | 2347515 | C2 | 2/2009 | |
| WO | WO 08/114305 | | 9/2008 | |
| WO | WO 2010078829 | A1 * | 7/2010 | A45B 19/10 |
| WO | WO 2013185268 | A1 * | 12/2013 | A45B 19/00 |

* cited by examiner

CANOPIES AND CANOPY SUPPORT STRUCTURES

BACKGROUND

Conventional pole-mounted canopy support structures suffer from an inability to independently configure the structure's height and span. In particular, the structure has to be tall enough that the structure's retractable arms can close without hitting the ground or other objects. Conversely, limits on the practical height of the structure limit the span of the structure's extended arms. These limitations are accentuated in the case of eccentric canopy structures (i.e., structures that have arms extending in a longer direction on one side of the structure's support pole).

SUMMARY OF THE INVENTION

In one embodiment, a canopy support structure comprises a pole, a three-dimensional array of hub pairs, and a plurality of articulating arms connecting the hub pairs. The hubs of each hub pair are movable toward each other during extension of the canopy support structure and away from each other during retraction of the canopy support structure. A first of the hub pairs includes a first hub and a second hub. Each of the first hub and the second hub is coupled to and movable along the pole. The articulating arms include sets of scissor-connected primary articulating arms. Each of the hub pairs is pivotally connected to at least one other of the hub pairs by a respective set of the scissor-connected primary articulating arms.

In another embodiment, a canopy support structure comprises a pole, first and second hubs coupled to and movable along the pole, and a plurality of articulating arms. The first and second hubs are movable toward each other during extension of the canopy support structure and away from each other during retraction of the canopy support structure. Each of the articulating arms is connected directly or indirectly to the first and second hubs. The articulating arms include sets of scissor-connected primary articulating arms. At least some of the sets of scissor-connected primary articulating arms are connected directly to the first and second hubs and extend outward from the first and second hubs during expansion of the canopy support structure.

In still another embodiment, a canopy support structure comprises a track, a three-dimensional array of hub pairs, and a plurality of articulating arms connecting the hub pairs. The hubs of each hub pair are movable toward each other during extension of the canopy support structure and away from each other during retraction of the canopy support structure. A first of the hub pairs includes a first hub and a second hub. The first hub or the second hub is coupled to and movable along the track. The articulating arms include sets of scissor-connected primary articulating arms. Each of the hub pairs is pivotally connected to at least one other of the hub pairs by a respective set of the scissor-connected primary articulating arms.

In yet another embodiment, a canopy support structure comprises a track, first and second hubs, and a plurality of articulating arms. The first hub or the second hub is coupled to and movable along the track. The first and second hubs are movable toward each other during extension of the canopy support structure and away from each other during retraction of the canopy support structure. Each of the articulating arms is connected directly or indirectly to the first and second hubs. The articulating arms include sets of scissor-connected primary articulating arms. At least some of the sets of scissor-connected primary articulating arms are connected directly to the first and second hubs and extend outward from the first and second hubs during expansion of the canopy support structure.

Other embodiments of the invention are also disclosed.

BRIEF DESCRIPTION OF THE DRAWINGS

Illustrative and presently preferred embodiments of the invention are illustrated in the drawings, in which.

DESCRIPTION OF THE PREFERRED EMBODIMENT

Figure 1:
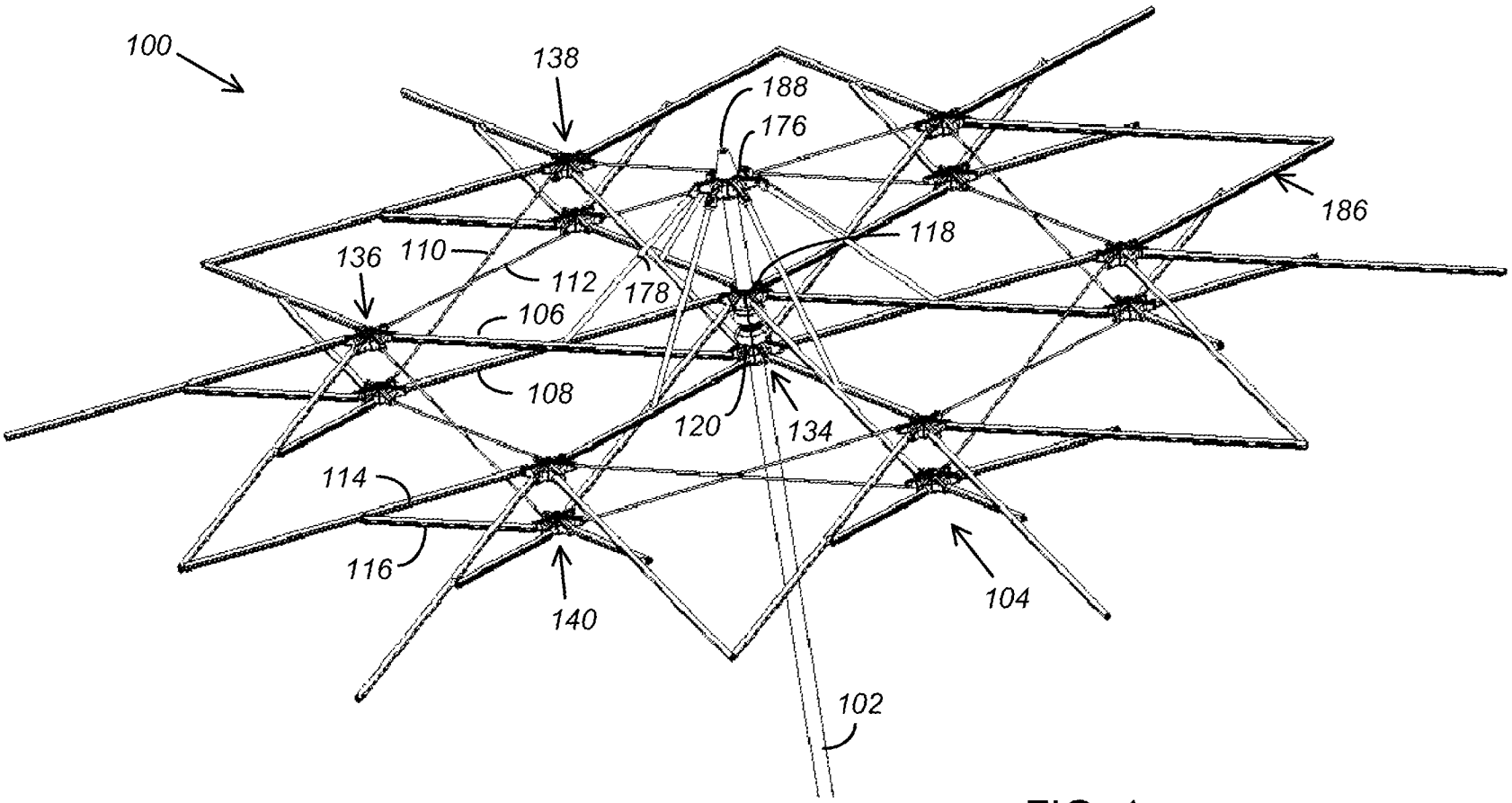
FIGS. 1-6 illustrate a first example of a canopy support structure.
Figure 2:
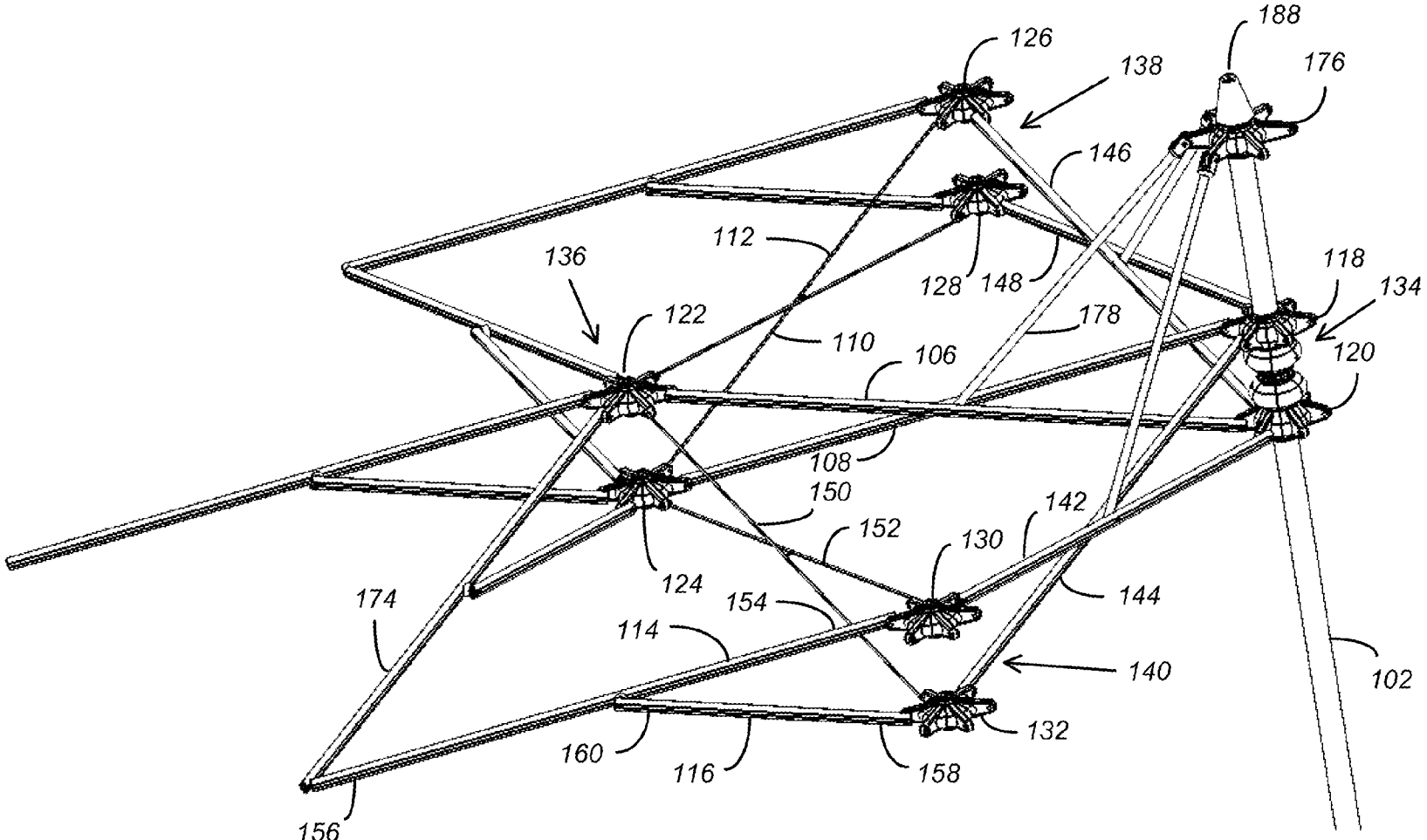
Figure 3:
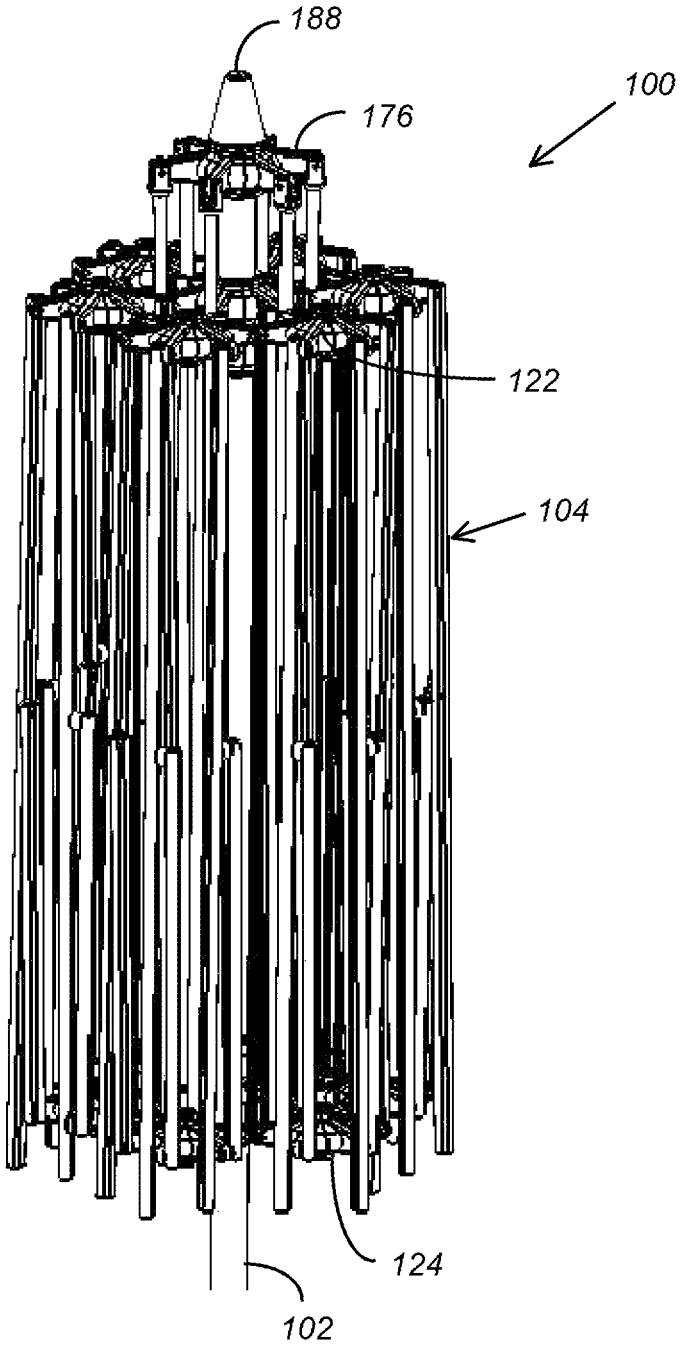

FIGS. 1-6 illustrate a first example of a canopy support structure 100. The structure 100 comprises a pole 102, a three-dimensional array 104 of hub pairs 134, 136, 138, 140, and a plurality of articulating arms or members (e.g., 106, 108, 110, 112, 114, 116). The hubs (e.g., 118/120, 122/124, 126/128, 130/132) of each hub pair (e.g., 134, 136, 138, 140) move toward each other during extension of the canopy support structure 100 (as shown in FIGS. 1 & 2), and away from each other during retraction of the canopy support structure 100 (as shown in FIG. 3). A first of the hub pairs 134 includes a first hub 118 and a second hub 120, each of which is coupled to and movable along the pole 102. These hubs 118, 120 are referred to herein as "primary hubs".

Figure 4:
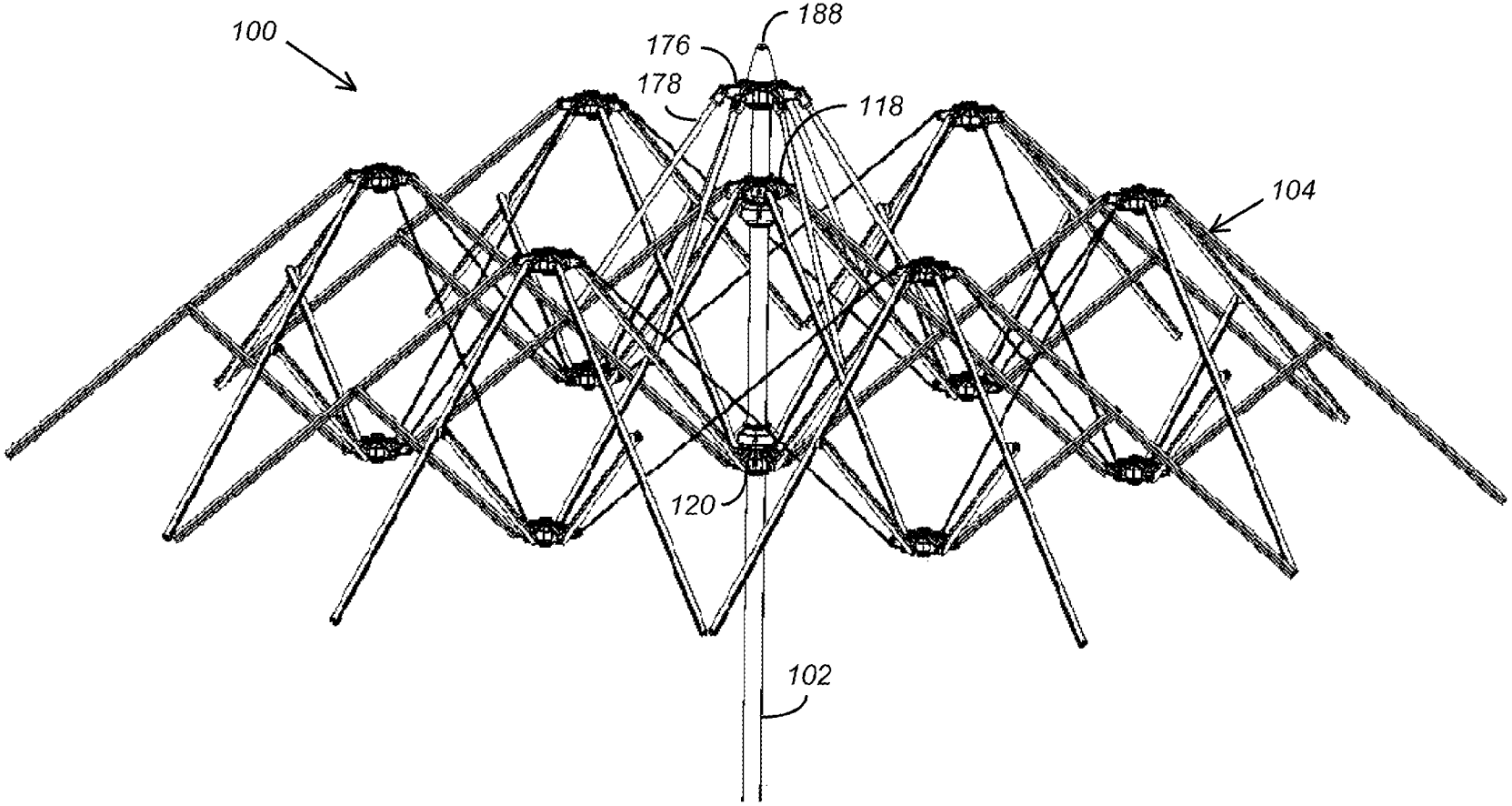

In some embodiments, the canopy support structure 100 may be extended or retracted by means of a user moving (e.g., rolling or sliding) the lower hub 120 up and down the pole 102. FIG. 4 illustrates the canopy support structure 100 in an intermediate position, about halfway between the structure's fully extended and fully retracted positions.

Figure 5:
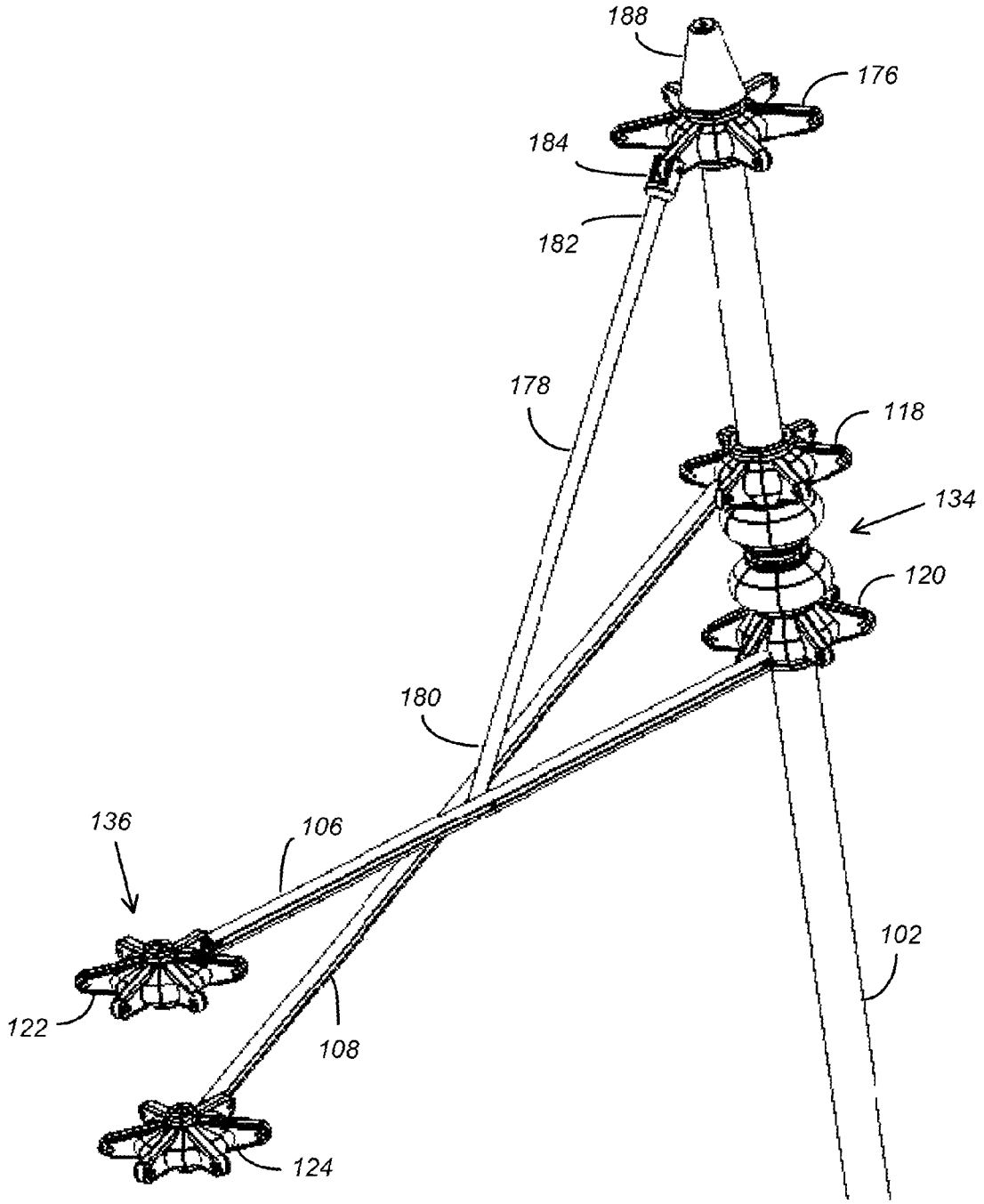

FIGS. 2 & 5 illustrate different subsets of the hub pairs and articulating arms that form the canopy support structure 100. As shown most clearly in FIG. 2, the articulating arms or members 106, 108, 110, 112, 142, 144, 146, 148, 150, 152 connect the hub pairs 134, 136, 138, 140 and include sets of scissor-connected primary articulating arms (e.g., 106/108, 142/144, 146/148). By "scissor-connected", it is meant that the primary articulating arms are coupled at some point along their length by a pivot mechanism, such as a pin or mechanical connector (e.g., pivot-connected sleeves or clips for receiving different ones of the scissor-connected primary articulating arms). Each of the hub pairs 134, 136, 138, 140 is pivotally connected to at least one other of the hub pairs 134, 136, 138, 140 by a respective set of the primary articulating arms 106/108, 142/144, 146/148. By way of example, FIGS. 1-6 illustrate a canopy support structure 100 where primary articulating arms 106, 108, 142, 144, 146, 148 only extend in a radial direction from the pole 102—i.e., between the primary hubs 118, 120 (i.e., those that move along the post 102) and secondary hubs 122, 124, 126, 128, 130, 132 (i.e., those that are coupled to the post 102 via articulating arms 106, 108, 142, 144, 146, 148). However, in some canopy support structure embodiments, primary articulating arms can also extend between pairs of secondary hubs, as discussed below in the context of lateral support members.

The articulating arms may also comprise secondary and tertiary articulating arms 114, 116. Each of the secondary articulating arms 114 has first and second ends 154, 156, with the first end 154 being pivotally connected to one of the hubs 130, and with the second end 156 hanging free or being foldably coupled to an end of an articulating arm 174 that is coupled to a different hub pair 136 (e.g., by a foldable plastic or nylon connector comprising sleeves that engage the distal ends of adjacent articulating arms 114, 174, or by a canopy or canopy segment having pockets that receive the distal ends of adjacent articulating arms 114, 174). Each secondary articulating arm 114 pivots with respect to a tertiary arm 116 at some intermediate point along its length. Each of the tertiary articulating arms 116 also has first and seconds 158, 160, with a first end 158 being pivotally connected to one of the hubs 132, and with a second end 160 being pivotally connected to an intermediate or end portion or of another articulating arm 114.

Figure 7:
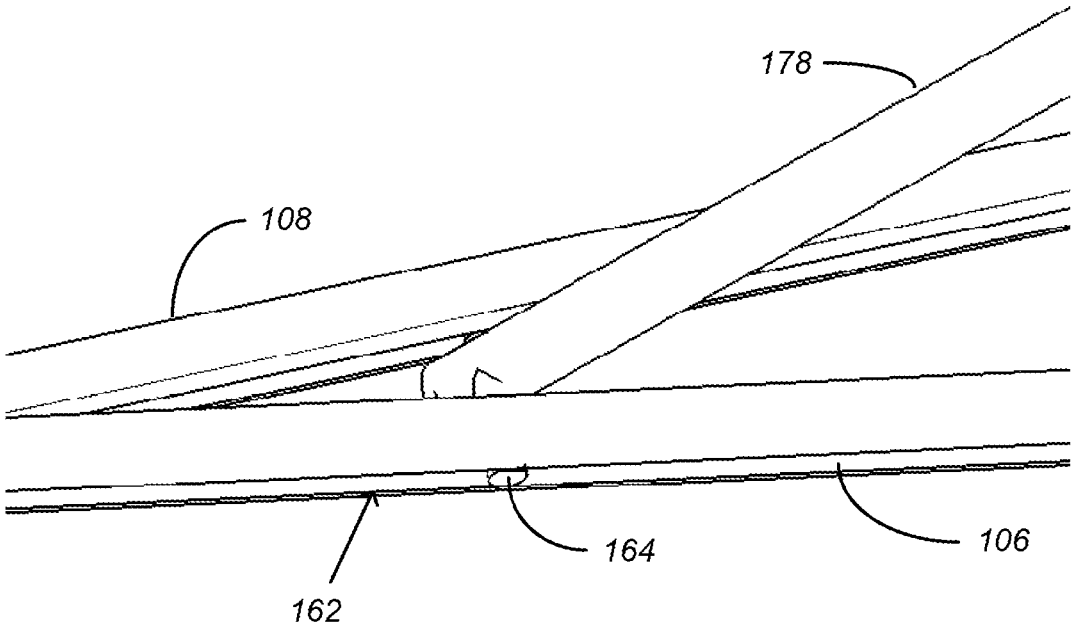
FIG. 7 illustrates an example of a bypass pin connection between two primary articulating arms.

FIG. 7 illustrates an example of a bypass pin connection 162 between two primary articulating arms 106, 108. The connection 162 comprises a pin 164 that extends through each of the primary articulating arms 106, 108 and allows them to pivot with respect to one another. The pin may be secured by having a head on one end, and a flare (rivet), bend, nut or other feature on the other end. In the case of a nut, the pin may be provided with threads over at least a portion thereof. A suspension arm 178 is sandwiched between the primary articulating arms 106, 108 and is retained by the pin 164. Alternately, the primary articulating arms 106, 108 could be separated by a bushing or abutted directly against each other, or bushings or spacers could be included between each of 1) the articulating arm 106 and the suspension arm 178, and 2) the articulating arm 108 and the suspension arm 178. By way of example, the bushings or spacers may be formed of nylon, plastic or steel. Use of a lower friction material can improve the operability and extend the life of the articulating arms 106, 108, 178. Bypass pin connections can be used to couple various ones of the articulating arms 106, 108, 142, 144, 146, 148 used in the canopy support structure 100 (see FIGS. 1, 2 & 5).

Figure 8:
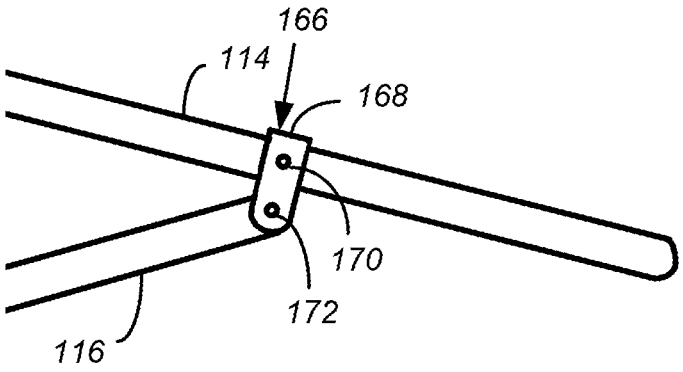
FIG. 8 illustrates a first example of a mechanical connector connection between secondary and tertiary articulating arms.

FIG. 8 illustrates a first example of a mechanical connector connection between secondary and tertiary articulating arms 114, 116. The mechanical connector connection comprises a connector 166. By way of example, the connector 166 comprises a body 168 in which first and second pins 170, 172 are received. The pins 170, 172 respectively engage the secondary and tertiary arms 114, 116 and retain them within the connector body 168. Mechanical connector connections can be used to couple various ones of the articulating arms, and in some cases may connect primary articulating arms. Other types of connections between articulating arms may also be employed, such as the connection shown in FIG. 9.

Figure 9:
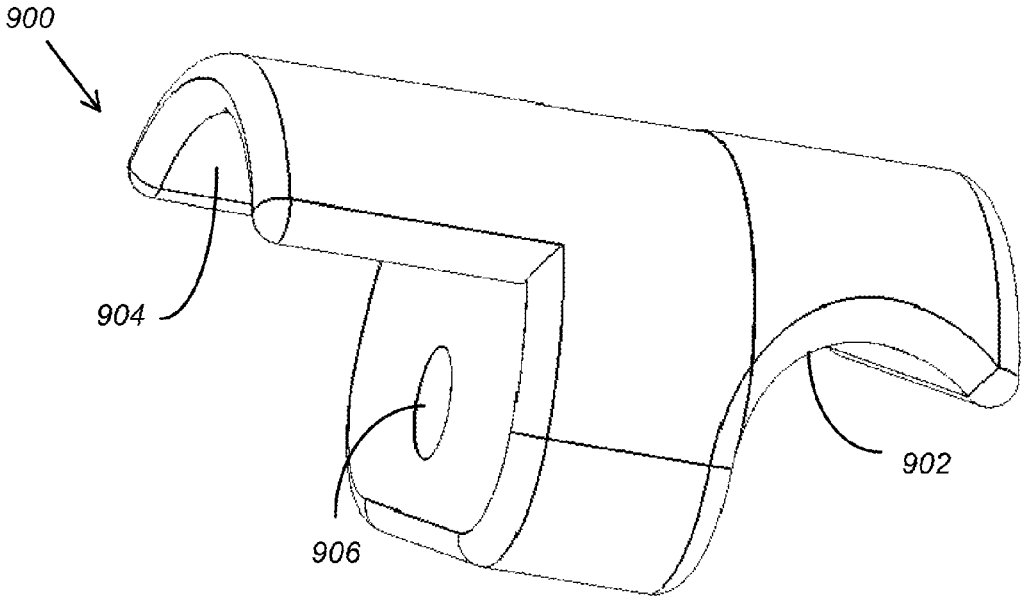
FIG. 9 illustrates a second example of a mechanical connector connection between secondary and tertiary articulating arms.

FIG. 9 illustrates a second example of a mechanical connector connection for connecting secondary and tertiary articulating arms 114, 116. The mechanical connector connection comprises a connector 900 having perpendicular channels 902, 904. The first channel 902 has a curved surface that partially surrounds the circumference of a secondary articulating arm 114. In some cases, the curved surface surrounds less than 180 degrees of the circumference of the secondary articulating arm 114. In other cases, the curved surface may surround more than 180 degrees of the circumference of the secondary articulating arm 114. In the latter cases, the secondary articulating arm 114 may clip into the first channel 902 of the connector 900. The second channel 904 has a curved surface oriented perpendicularly to the curved surface of the first channel 902. The second channel 904 is configured to receive one end of a tertiary articulating arm 116 such that the end faces into and rotates within the second channel 904. A pin or other suitable fastener may be placed through corresponding holes in the secondary articulating arm 114, connector 900 (e.g., hole 906) and tertiary articulating arm 116.

A number of lateral support members 110, 112, 150, 152 may connect the pairs 136, 138, 140 of secondary hubs 122, 124, 126, 128, 130, 132. See FIGS. 1 & 2. By way of example, the lateral support members 110, 112, 150, 152 may take the form of ropes, cords, cables, wires or other flexible elements that provide tension between the secondary hubs 122, 124, 126, 128, 130, 132. In contrast to a flexible canopy, which only provides lateral bracing to its support structure when its support structure is fully extended, the lateral support members 110, 112, 150, 152 provide lateral bracing during all stages of operation of the canopy support structure 100 (e.g., when the canopy is fully extended, fully retracted, or in any position between fully extended and fully retracted). Despite the flexibility of these lateral support members 110, 112, 150, 152, they may still articulate at their points of connection with the secondary hubs 122, 124, 126, 128, 130, 132. In some cases, the lateral support members 110, 112, 150, 152 can be implemented as scissor-connected (or unconnected) primary articulating arms 106, 108, 142, 144, 146, 148. With concentric umbrellas (i.e., concentric around a pole 102, as shown in FIGS. 1 & 6), the tangential/concentric ring of lateral support members need only carry tension and so can comprise much lighter and non-rigid members.

Figure 6:
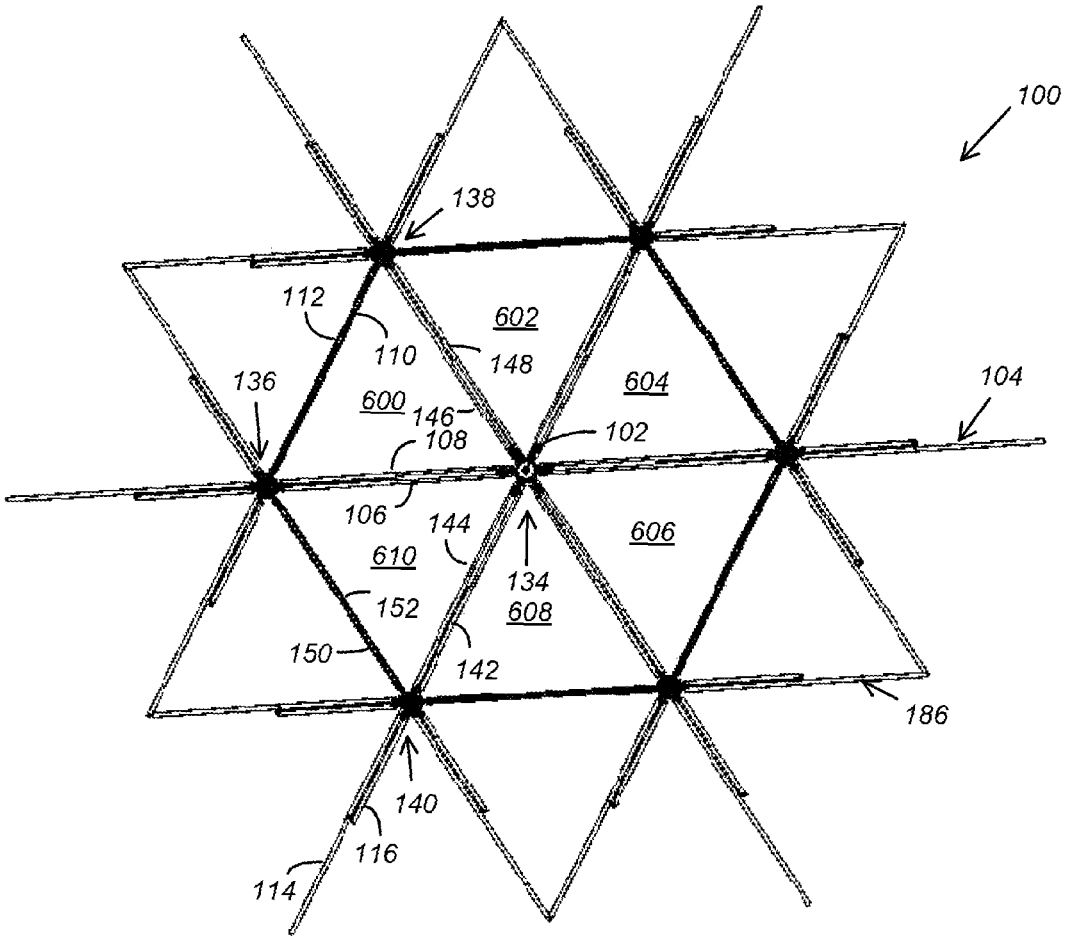

FIG. 6 illustrates a top plan view of the canopy support structure 100. As the figure illustrates, the three-dimensional array 104 of hub pairs and plurality of articulating arms or members 106, 108, 110, 112, 114, 116, 142, 144, 146, 148 shown in FIGS. 1-6 define a three-dimensional articulating lattice structure. By way of example, the three-dimensional articulating lattice structure is shown to have six equilateral triangle support structures 600, 602, 604, 606, 608, 610. Each equilateral triangle support structure (e.g., 600) comprises a first set of hubs 118, 122, 126 defining vertices of a first equilateral triangle (see FIG. 2); a second set of hubs 120, 124, 128 defining vertices of a second equilateral triangle; and a plurality of articulating arms or members 106, 108, 110, 112, 146, 148 connecting the hubs 118, 120, 122, 124, 126, 128 defining the vertices of the first and second equilateral triangles. As shown in FIG. 6, adjacent ones of the equilateral triangle support structures (e.g., 600, 610) may share certain hub pairs 134, 136 and articulating arms 106, 108. A canopy support structure 100 may be modified to comprise any number of equilateral triangle support structures and is sometimes referred to herein as an "equi-lattice" canopy support structure. For large umbrellas, additional secondary hub pairs may be added beyond the ring of secondary hub pairs formed, in part, by the secondary hub pairs 136, 138, 140 shown in FIG. 6.

Figure 10:
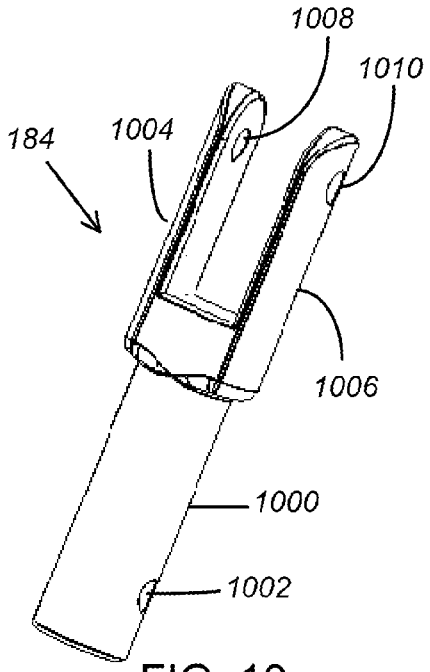
FIG. 10 illustrates a double-shear connector used to connect the suspension arms to the suspension hub in the canopy support structure shown in FIGS. 1-6.

The lattice framework 186 formed by the array 104 of hub pairs and articulating arms or members 106, 108, 110, 112, 142, 144, 146, 148, 150, 152 may be tethered to the pole 102 by a tethering system (also referred to as a suspension system). See, in particular, FIGS. 1 & 5. By way of example, the tethering system may comprise 1) an anchor on the pole, such as a suspension hub 176, and 2) a plurality of tethers or articulating suspension arms (e.g., 178). The tethers or suspension arms 178 are coupled between the anchor 176 and the lattice framework 186. The suspension arms 178 may be constructed similarly to ones of the articulating arms or members 106, 110 that connect the hub pairs 134, 136, 138, 140, with rigid members that provide additional structural support for the primary articulating arms 106, 108 in the event of a wind event (e.g., a wind event that causes uplift forces on the canopy support structure 100 and the canopy it supports. Alternately, tethers may be provided by flexible elements such as ropes, cords, cables or wires. In FIG. 5, the suspension arm 178 comprises a first end 180 that is coupled between scissor-connected primary articulating arms 106, 108 by means of a bypass pin connection. The second end 182 of the suspension arm 178 is coupled by means of a double-shear connector 184 to the suspension hub 176. The double-shear connector 184 is shown in more detail in FIG. 10 and may comprise a tubular portion 1000 that slips inside one of the hollow suspension arms 178, and a forked end comprising two tines 1004, 1006. Alternately, and by way of example, the tubular portion 1000 may be hollow and slip over one of the suspension arms 178, or the double-shear connector 184 may be welded to or otherwise permanently integrated with one of the suspension arms 178. A rib of the suspension hub 176 is received between the tines 1004, 1006 and fastened thereto with a pin that extends through holes 1008, 1010 in the tines 1004, 1006 and the rib. Likewise, the tubular portion 1000 of the connector 184 is fastened to the suspension arm 178 with a pin that extends through holes 1002 in the connector 184 and suspension arm 178.

The articulating arms and members 106, 108, 110, 112, 114, 116, 178 of the canopy support structure 100 (FIG. 1) may be formed using the same or different materials. By way of example, the articulating arms 106, 108, 114, 116 may be hollow extruded aluminum tubes having square cross-sections; the suspension arms 178 may be hollow extruded aluminum tubes having circular cross-sections; and the lateral support members 110, 112 may be metal cords or fabric cables. Alternately, for example, any of the arms or members may be made of wood or a composite material; may be hollow or solid; or may have square, rectangular, circular or other cross-sections. The lateral support members and tethers may also be ropes, cords, cables or wires, for example.

Figure 11:
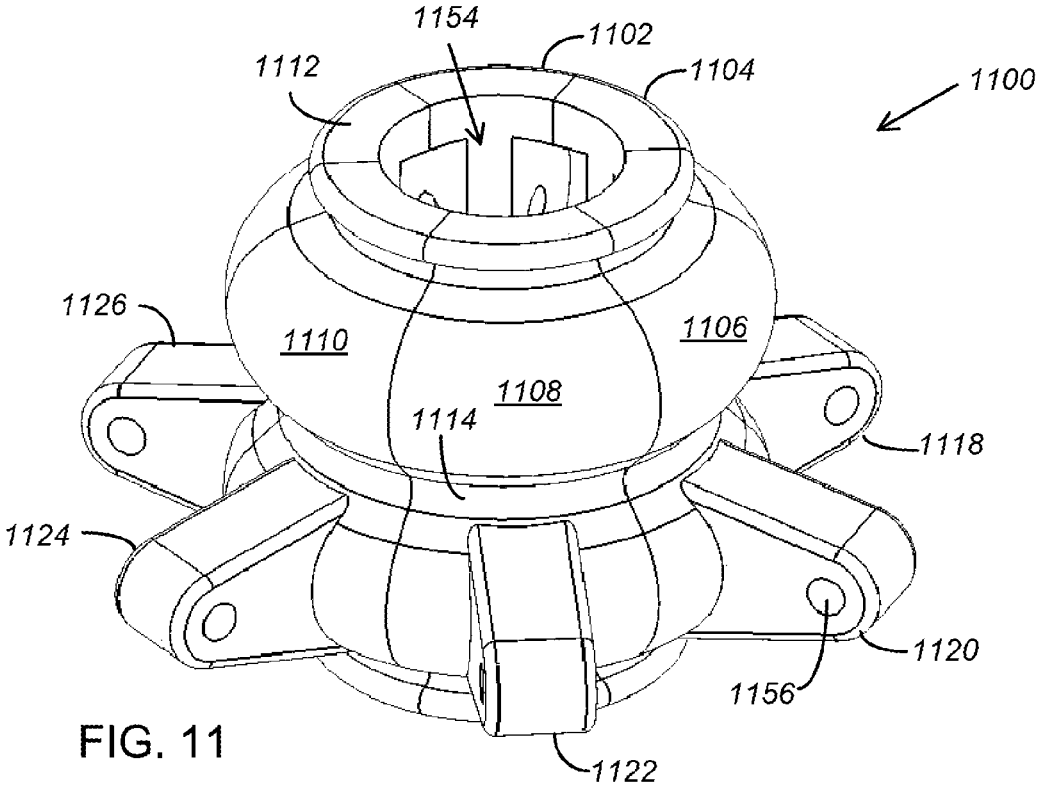
FIG. 11 illustrates a first example of a modular primary hub usable in the canopy support structure shown in FIGS. 1-6.
Figure 12:
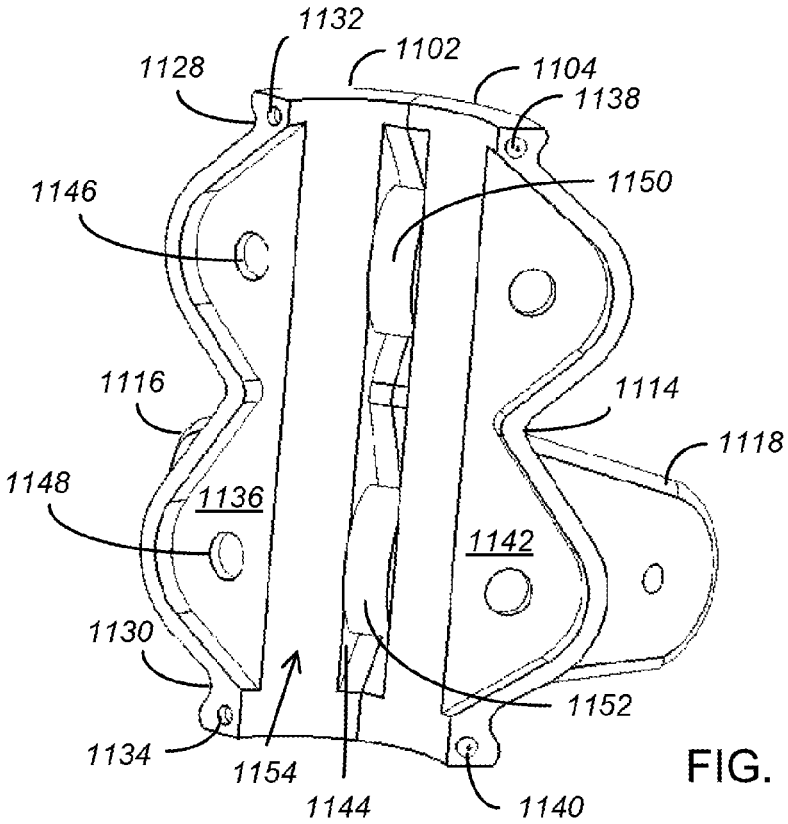
FIG. 12 illustrates two modular components of the modular primary hub shown in FIG. 11.

FIG. 11 illustrates an example 1100 of a primary hub 118 or 120. The primary hub 1100 comprises a plurality of modular components 1102, 1104, 1106, 1108, 1110, 1112. FIG. 12 illustrates only two of the modular components 1102, 1104. Each modular component 1102-1112 is identical in construction and is generally wedge-shaped. The outer surface of each component 1102-1112 has a double-humped surface that defines part of a hub waist 1114. Additional waists 1128, 1130 may be formed by lips formed at each end of the hub's pole-receiving cavity 1154 (FIG. 12). Wires, cords, clips or other elements may be placed around one or more of the waists 1114, 1128, 1130 and fastened to secure the modular components 1102-1112 to one another, thereby forming the hub 1100. In this manner, the hub 1100 may be easily constructed, disassembled or repaired.

A rib 1116, 1118, 1120, 1122, 1124, 1126 extends from the outer surface of each modular component 1102-1112 and has a hole bridging its sidewalls (e.g., hole 1156). As shown in FIG. 5 and illustrated by components 108 and 118, an articulating arm may be pinned to each rib 1120 by means of its hole 1156 and a suitable pin.

Internally, each modular component 1102-1112 has a number of alignment features for aligning the modular component with adjacent components. By way of example, the alignment features are shown to comprise a pair of holes 1132, 1134 on one internal face 1136 of each wedge-shaped component, and a pair of corresponding pins 1138, 1140 on the other internal face 1142 of each wedge-shaped component (FIG. 12). The pins may thereby be inserted into corresponding holes to construct the hub 1100.

Each internal face (e.g., 1136, 1142) of a modular component 1102-1112 may be recessed from the boundary of the modular component's outer surface and have a pair of axle-receiving holes 1146, 1148 therein. In this manner, an axle with attached wheel (1150 or 1152) may be fit between facing ones of the holes 1146, 1148 as the modular components 1102-1112 are assembled to form the hub 1100. This enables the hub 1100 to roll along the surface of the pole 102 on which it is mounted, making it easier for a canopy operator to move the hub 1100 along the pole 102. This is particularly useful for offset canopy support structures (e.g., any of the offset canopy support structures described later in this document), where the imbalance of forces on each hub might otherwise cause the hubs to bind up on the pole 102 and prevent smooth movement of a canopy support structure along the length of the pole 102. Similarly, the double-hump arrangement may house two tiers of wheels or bearings to ensure alignment of the hub 1100 with the pole 102 for smooth movement along the length of the pole 102. Alternately, the wheels 1150, 1152 may be eliminated; the double-hump may be eliminated in favor of a single hump; and the pole-receiving cavity 1154 of the hub 1100 may be provided with a diameter that enables the hub 1100 to slide along the surface of the pole 102.

Figure 13:
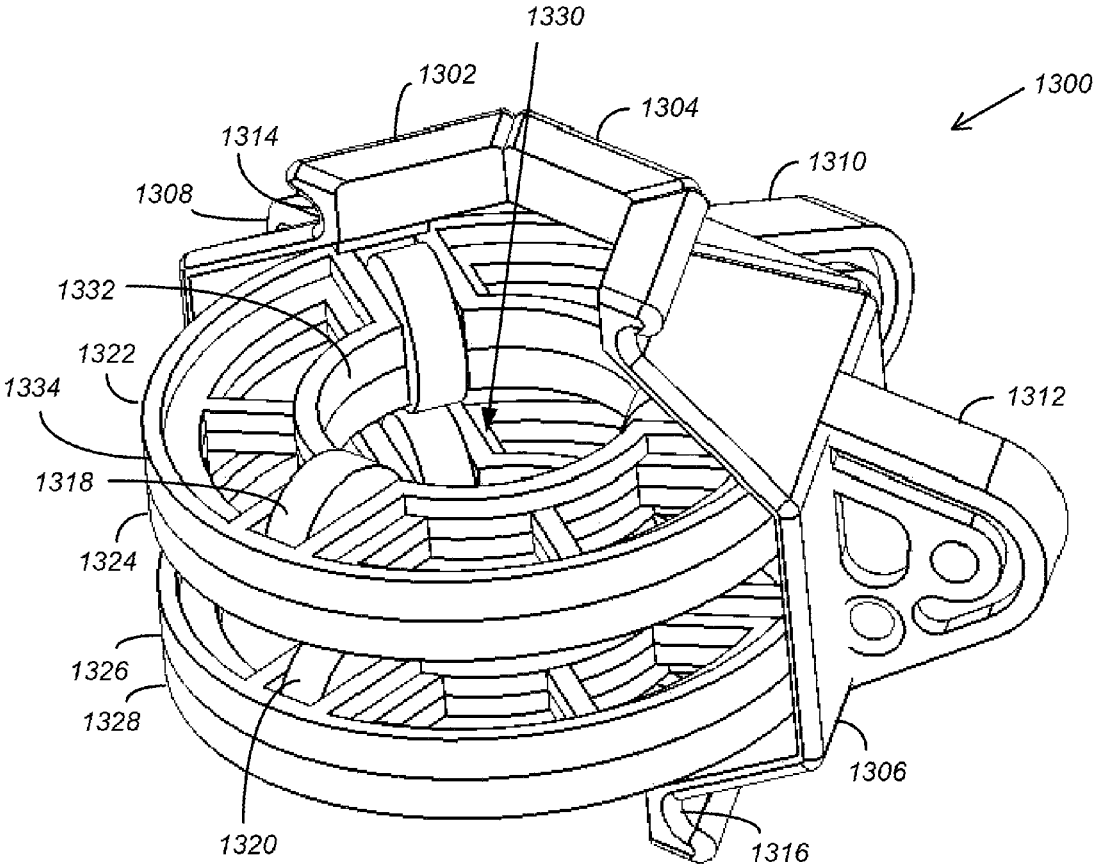
FIG. 13 illustrates a second example of a modular primary hub usable in the canopy support structure shown in FIGS. 1-6.

FIG. 13 illustrates a second example 1300 of a primary hub 118 or 120. The hub 1300 includes a plurality of modular components 1302, 1304, 1306 that fit together similarly to the components 1102-1112 shown in FIG. 11. Three of the modular components are removed to reveal components interior to the hub 1300. Each of the modular components 1302-1306 includes a rib 1308-1312 with a hole or holes for connecting articulating arms or other elements to the component 1302-1306.

The outer surface of each modular component 1302-1306 defines part of a circumferential channel or waist 1314, 1316 at each end of the hub's pole-receiving cavity 1330. Wires, cords, clips or other elements may be placed around each of the waists 1314, 1316 and fastened to secure the modular components 1302-1306 to one another, thereby forming the hub 1300.

Interior to the hub 1300 are two pairs of rings 1322/1324, 1326/1328. Each ring 1322-1328 has an inner surface 1332 that defines part of the pole-receiving cavity 1330, and an outer surface 1334 that abuts interior surfaces of the modular components 1302-1306. Connecting the inner and outer surfaces 1332, 1334 of each ring 1322 are a number of structural ribs. A number of slots defined in each ring 1322-1328 provide locations for receiving wheels or bearings (e.g., wheels 1318 and 1320). The slots face inwardly toward the pole-receiving cavity 1330. Each wheel 1318 may be mounted on an axle, with ends of the axle being trapped between the rings of each pair 1322/1324, 1326/1328. Spacers or clips on the interior surfaces of the modular components 1302-1306 may hold the ring pairs 1322/1324, 1326/1328 apart from one another. Alternately, spacers between or attached to the ring pairs 1322/1324, 1326/1328 may hold the ring pairs 1322/1324, 1326/1328 apart from each other.

In other embodiments of the primary hubs 118, 120, each hub 118, 120 may be formed as a unitary molded structure or in other ways. If a hub is formed as a unitary molded structure, recesses for receiving wheels or bearings may be provided on the interior surface of its pole-receiving cavity.

Figure 14:
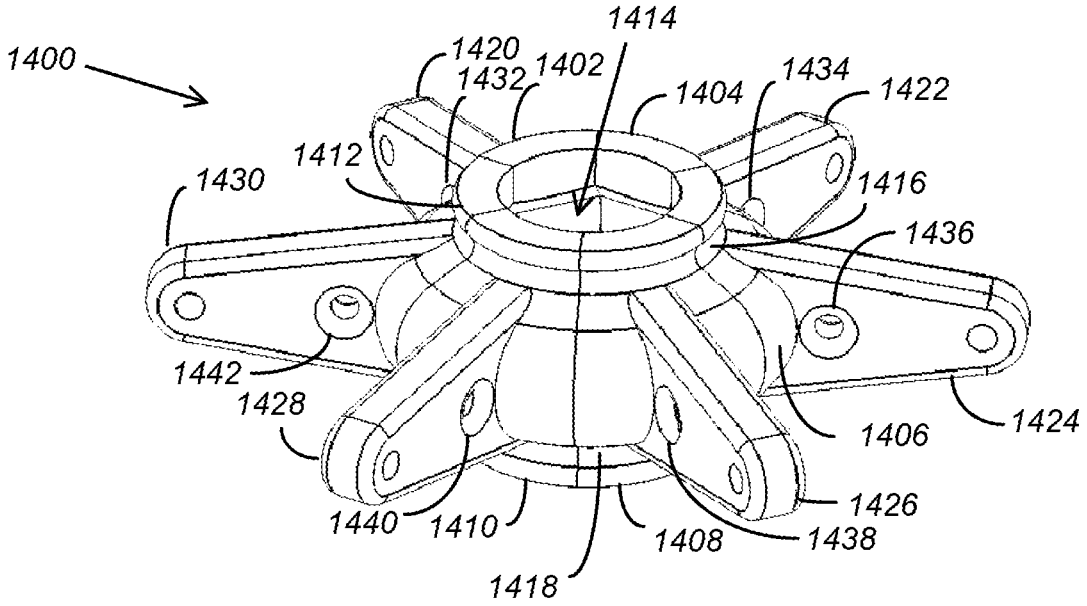
FIG. 14 illustrates a first example of a suspension hub usable in the canopy support structure shown in FIGS. 1-6.

The suspension hub 176 may in some cases be constructed of modular components with wheels or rollers, similarly to how the primary hub 1100 is constructed. FIG. 14 illustrates an alternate example 1400 of the suspension hub 176, constructed with modular components 1402, 1404, 1406, 1408, 1410 and 1412 similarly to how the primary hub 1100 is constructed, but without wheels or rollers on the interior of its pole-receiving cavity 1414.

The outer surface of each modular component 1402-1412 defines part of a circumferential channel or waist 1416, 1418 at each end of the hub's pole-receiving cavity 1414 (FIG. 14). Wires, cords, clips or other elements may be placed around each of the waists 1416, 1418 and fastened to secure the modular components 1402-1412 to one another, thereby forming the hub 1400.

The outer surface of each modular component 1402-1412 further comprises a rib 1420, 1422, 1424, 1426, 1428, 1430 to which a double-shear connector (e.g., 184) attached to a suspension arm (e.g., 178) may be pinned. See FIG. 10. The ribs 1420-1430 may be sized to extend beyond those of the primary hubs 1100, thereby enabling the suspension arms 178 to hang vertically outside the circumference of each primary hub 1100 and not interfere with the primary hubs 1100 when the canopy support structure 100 is in its retracted position.

In some cases, the ribs 1420-1430 may comprise holes 1432, 1434, 1436, 1438, 1440, 1442 through which the components of a multi-part canopy (e.g., the canopy shown in FIGS. 54-57) may be laced.

Figure 15:
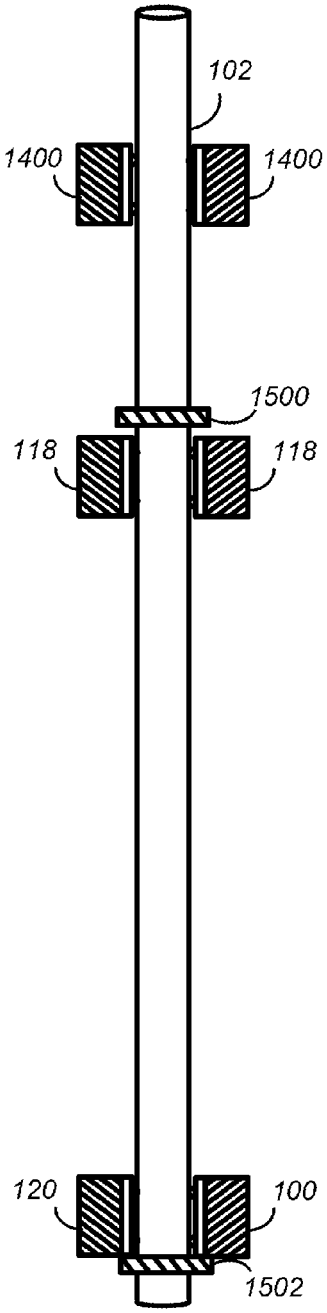
FIGS. 15-17 illustrate movement of primary hubs and a suspension hub when mechanical stops are used to limit the movement of the hubs.
Figure 16:
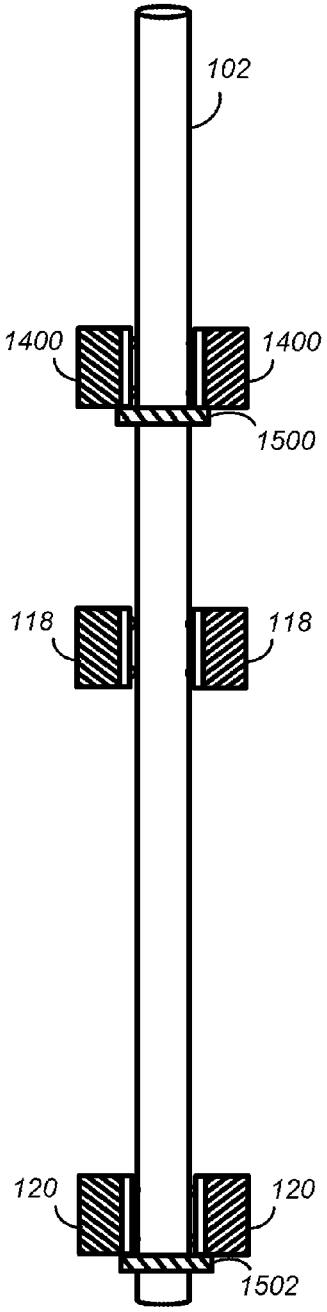
Figure 17:
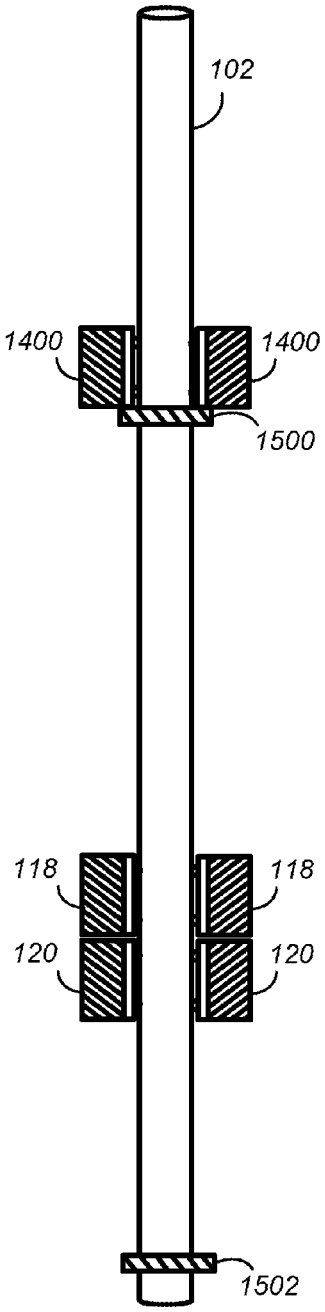

Because the suspension hub 1400 has a pole-receiving cavity 1414 that fully receives the pole 102, its ability to roll or slide down the pole 102 needs to be limited via a pin 1500 or other mechanism at or near the top of the pole 102. See, for example, the suspension and primary hubs 1400, 118, 120 shown in different operating positions in FIGS. 15-17, where FIG. 15 shows one possible hub position when a canopy support structure is fully retracted; FIG. 16 shows hub positions when the canopy support structure is partially extended or retracted; and FIG. 17 shows hub positions when the canopy support structure is fully extended. When coupled with a pin 1502 or other mechanism to set the lower extent of the lower primary hub 120, setting the lower extent of the suspension hub 1400 short of the top of the pole 102 allows the suspension hub 1400 to move upward along the pole 102 as the canopy support structure retracts and the lowest primary hub 120 reaches its lower extent (i.e., as the hubs 1400, 118, 120 move from their FIG. 16 positions to their FIG. 15 positions). This enables a designer to control the lower clearance of the retracted canopy support structure (FIG. 15) and the lower clearance of the extended canopy support structure (FIG. 17) independently. In some cases, a pole 102 may be provided with multiple holes for receiving the pins 1500 and 1502, thereby enabling a user of a canopy support structure to place the pins at selected locations along the pole 102. Alternately, a suspension hub could be fixed to a movable mast mounted at the top of the pole 102 (i.e., in or about the top of the pole 102). Movement of the suspension hub can then be achieved via movement of the movable mast.

In some cases, the upper opening of the pole-receiving cavity 1414 can be fully or partly covered by a cap or finial, thereby enabling the suspension hub to sit atop the pole 102.

Figure 18:
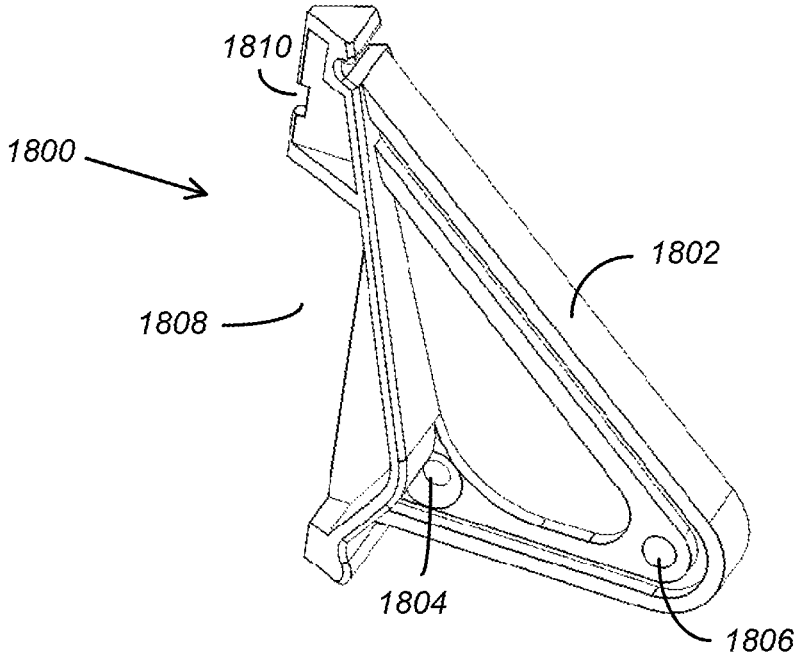
FIG. 18 illustrates an alternate modular component usable with other like (or different) modular components to form a suspension hub for the canopy support structure shown in FIGS. 1-6.

FIG. 18 illustrates a modular component 1800 that may be joined with five like modular components to form a second example of a suspension hub. The modular component 1800 has a rib 1802 and two holes 1804, 1806 that function similarly to corresponding elements of the modular component 1402 (FIG. 14). However, the modular component 1800 has an interior recess 1808 that, with similar recesses in the modular components that are joined to the modular component 1800 to form a suspension hub, enables a suspension hub formed of modular components 1800 to sit atop the pole 102 of the canopy support structure 100 (FIG. 1). In addition, the modular component 1800 has a recess 1810 that, with similar recesses in the modular components that are joined to the modular component 1800 to form a suspension hub, provides a way to anchor the head of a bolt to which a cap 188 or finial is attached.

Figure 19:
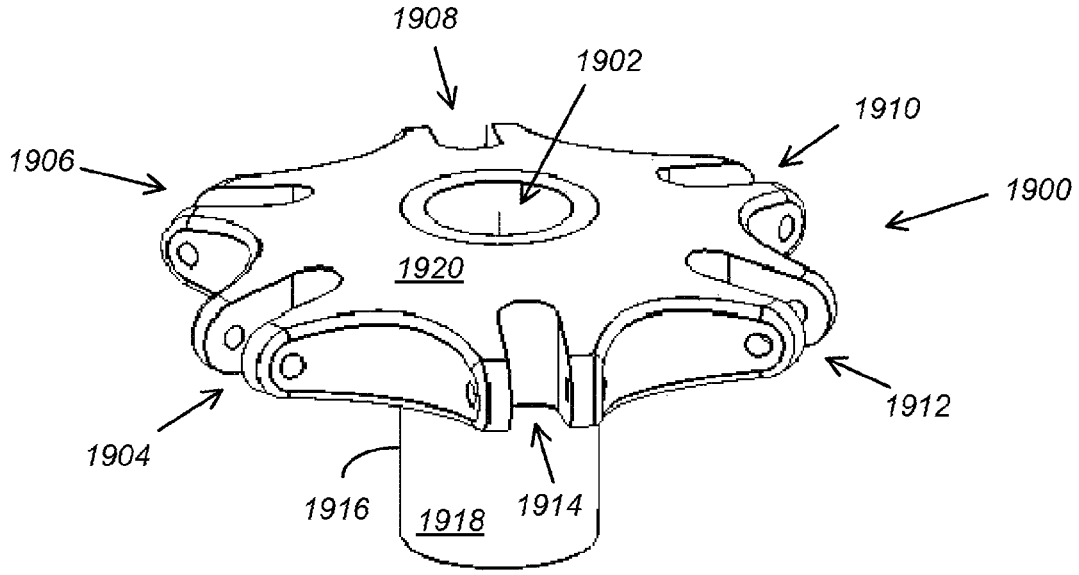
FIG. 19 illustrates a second example of a suspension hub.

FIG. 19 illustrates a third example 1900 of a suspension hub. The suspension hub 1900 is formed as a unitary molded structure having a shaft 1916 with pole-receiving cavity 1902. In an alternate configuration, the suspension hub 1900 could have a body 1918 sized to fit within the pole 102 such that the horizontal member 1920 rests atop the pole 102. In contrast to the suspension hub 1400 shown in FIG. 14, the suspension hub 1900 has double-shear connectors 1904, 1906, 1908, 1910, 1912, 1914 for directly receiving suspension arms. That is, a suspension arm 178 may be pinned to the suspension hub 1900 without using a double-shear connector 184.

Figure 20:
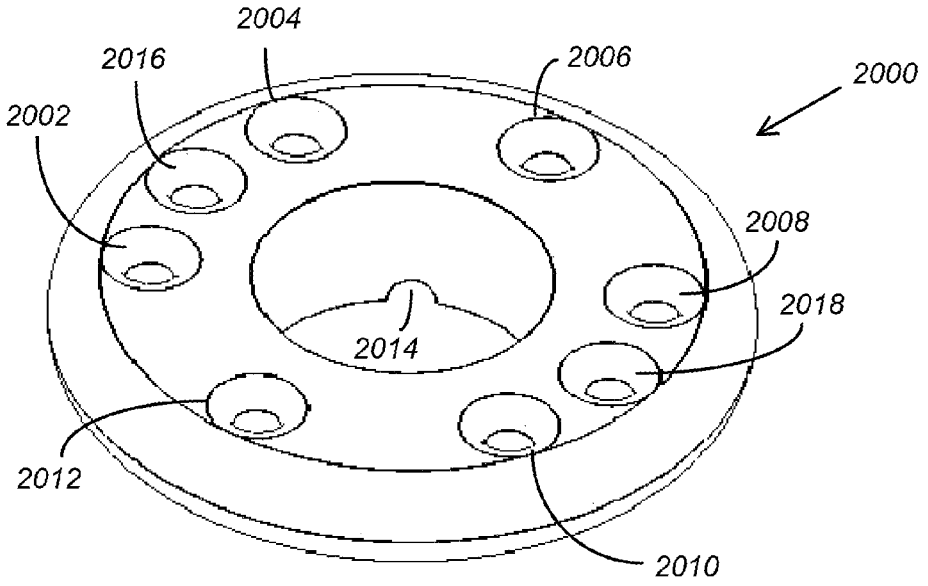
FIG. 20 illustrates a third example of a suspension hub.

FIG. 20 illustrates a fourth example 2000 of a suspension hub. The suspension hub 2000 takes the form of a suspension ring having a plurality of holes 2002, 2004, 2006, 2008, 2010, 2012 therein. When non-rigid suspension members such as ropes or cords are used to suspend a lattice framework, the ropes or cords may be laced through one or more of the holes 2002-2012 and then attached to various points of the lattice framework. In addition, or alternately, the components of a multi-part canopy (e.g., the canopy described later in this document) may be laced to the suspension ring 2000. Additional holes 2016, 2018 may be provided to accommodate other arrangements of articulating lattice structures (e.g., any of the "quadrilattice" arrangements described later in this document).

The underside of the suspension ring 2000 may have a channel 2014 formed therein. The channel 2014 allows the suspension ring 2000 to seat more positively on a pin that retains the suspension ring 2000 atop a pole 102.

In some embodiments, the suspension hubs 1400 or 1900, or suspension ring 2000, may be used in conjunction with an optional pole cap 188 (see, FIGS. 1-5). In these embodiments, lower canopy segments 5400, 5402, 5404, 5406, 5408, 5410 of a multi-part canopy may be laced or otherwise attached to the suspension hub 1400, 1900 or 2000; and the pole cap 188 may be used to support the center segment 5430 of the multi-part canopy. See, e.g., FIGS. 54-57. Optionally, a finial may be attached to the pole cap 188, and the canopy segment 5430 may be held between the pole cap 188 and finial.

Figure 21:
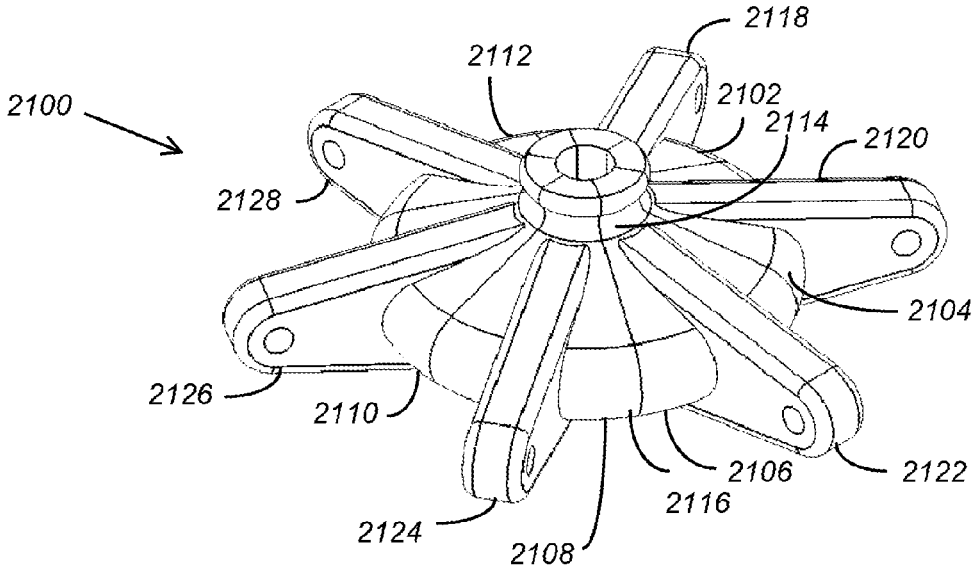
FIG. 21 illustrates an example of a secondary hub usable in the canopy support structure shown in FIGS. 1-6.

FIG. 21 illustrates an example 2100 of a secondary hub 122, 124, 126, 128, 130, 132—i.e., one of the hubs that is connected directly or indirectly to one of the primary hubs 118, 120 by means of articulating arms. The secondary hub 2100 comprises a plurality of modular components 2102, 2104, 2106, 2108, 2110, 2112, each of identical construction and generally wedge-shaped. The outer surface of each component 2102-2112 defines part of a circumferential channel or waist 2114, 2116 at each axial end of the hub 2100. Wires, cords, clips or other elements may be placed around each of the waists 2114, 2116 and fastened to secure the modular components 2102-2112 to one another, thereby forming the hub 2100.

The outer surface of each modular component 2102-2112 further comprises a rib 2118, 2120, 2122, 2124, 2126, 2128 to which an articulating arm or member 106, 108, 110, 112 may be tied or pinned. See FIGS. 1 & 2.

In other embodiments of the secondary hubs 122-132, each hub 122-132 may be formed as a unitary molded structure or in other ways.

Figure 22:
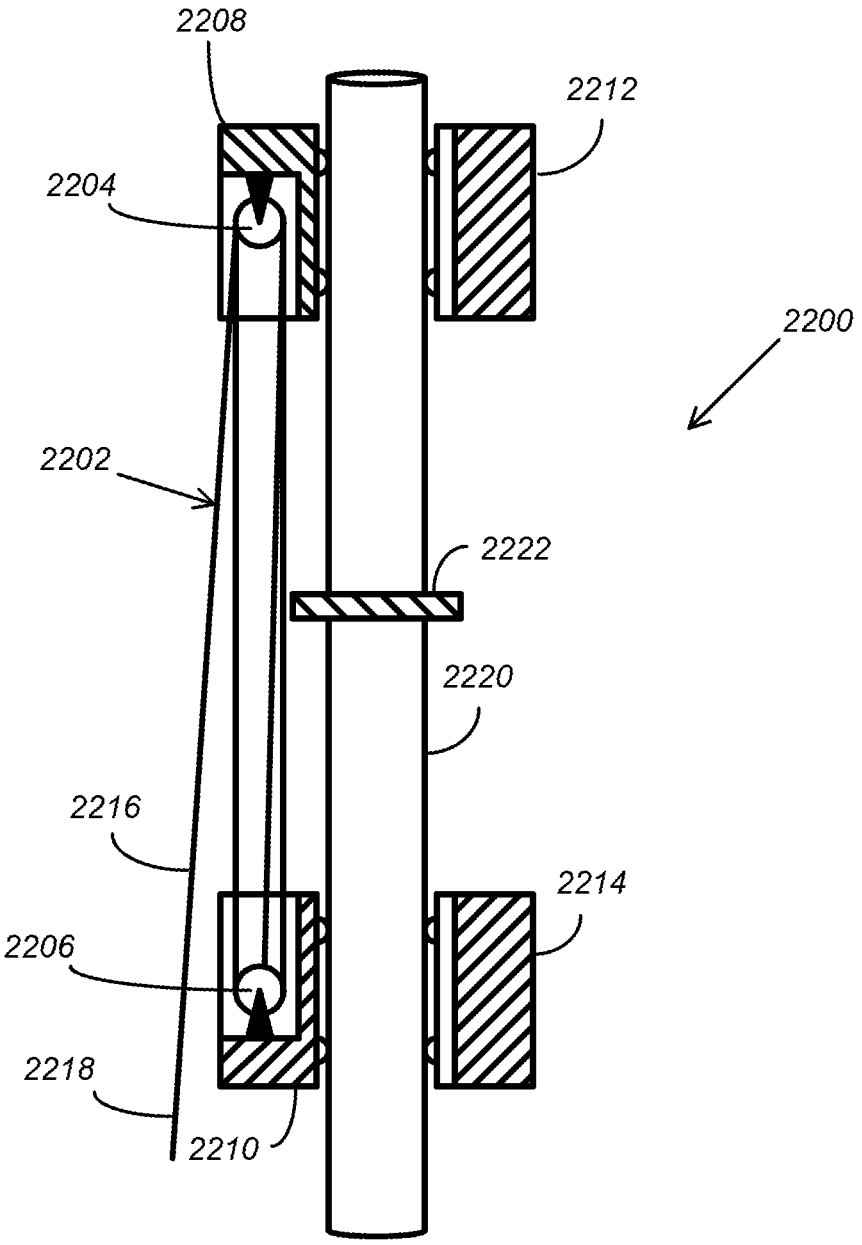
FIG. 22 illustrates an example of a mechanism for extending and retracting a canopy support structure.

FIG. 22 illustrates an example of a mechanism 2200 for extending and retracting the canopy support structure 100 or any other canopy support structure. The mechanism 2200 comprises a block and tackle 2202 having pulleys 2204, 2206 attached to the outer surfaces, ribs or collars 2208, 2210 of first and second primary hubs 2212, 2214. A cord 2216 is anchored to one of the pulleys 2206 and threaded around each of the pulleys 2204, 2206, in a typical block and tackle configuration. The block and tackle 2202 may be implemented as a single or multi-loop block and tackle. The free end 2218 of the cord 2216 is pulled to extend the canopy support structure attached to the primary hubs 2212, 2214 (not shown in FIG. 22), and released to retract the canopy support structure. When pulled, the cord 2216 may be wrapped around a cleat to maintain the canopy support structure's extended position. A second block and tackle, similar to block and tackle 2202, may be added to ribs or collars diametrically opposite the ribs or collars 2208, 2210 to ensure symmetrical loading of the block and tackle on the hubs, and to further enable smooth movement of the primary hubs 2212, 2214 along the length of the pole 2220.

Alternate mechanisms may be used to extend and retract a canopy support structure. The mechanisms may be more rudimentary or more complex than the block and tackle shown in FIG. 22, and may include mechanisms mounted wholly or partly external or internal to the pole. Some forms of mechanism may include a crank for operating the mechanism. The various types of mechanisms usable to extend and retract a canopy support structure are not a part of the invention, and will not be described in further detail in this disclosure.

FIG. 22 also illustrates an optional safety stop 2222 (e.g., a collar that is welded or otherwise affixed to the pole 2220). The safety stop 2220 can be mounted mid-distance between the primary hubs 2212, 2214, and can help prevent over rotation of the canopy support structure's articulating arms in high winds.

Figure 23:
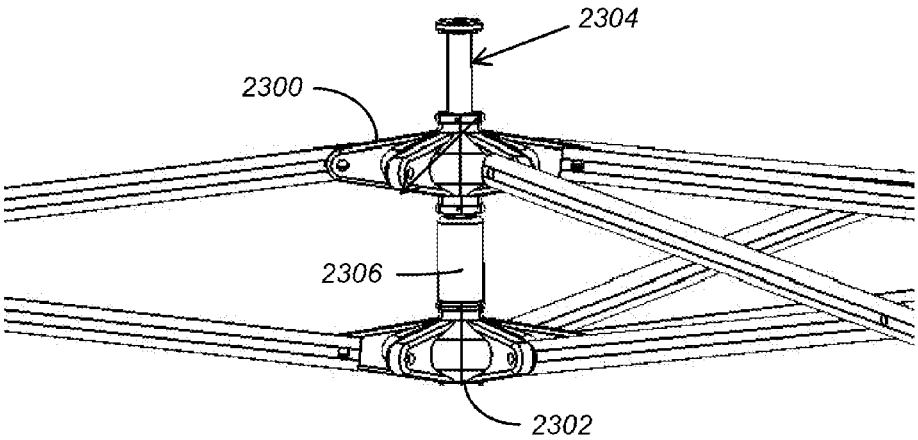
FIGS. 23 & 24 illustrate a pair of secondary hubs of substantially identical construction, wherein the upper one of the hubs has an optional telescoping mast fitted through a central sleeve of the hub.
Figure 24:
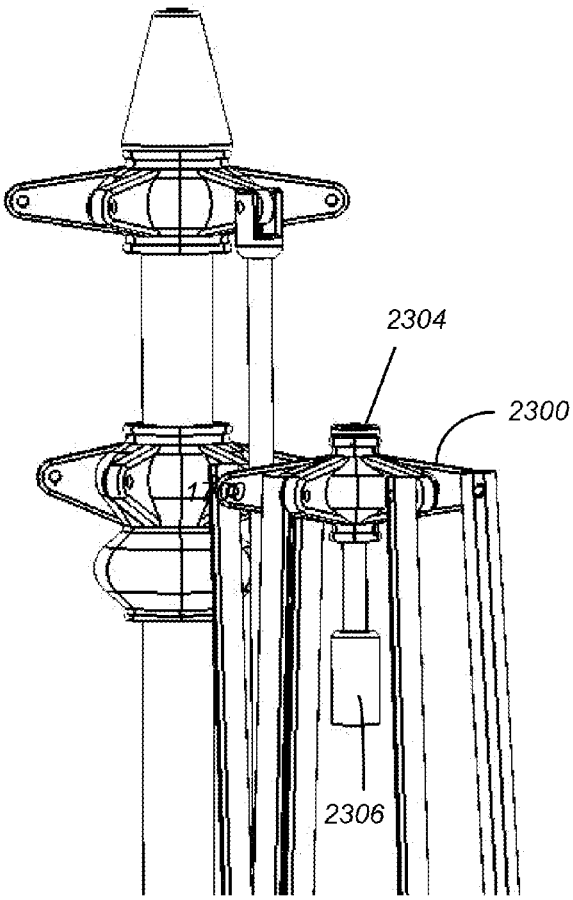

FIGS. 23 & 24 illustrate a pair of secondary hubs 2300, 2302 of substantially identical construction, wherein the upper one of the hubs 2300 has an optional telescoping mast 2304 fitted through a central sleeve of the hub 2300. FIG. 23 shows the hubs 2300, 2302 when a canopy support structure is in its extended position. In this position, the telescoping mast 2304 bears against the upper surface of the lower hub 2302 and is pushed upward and out of the hub 2300 to a fully extended position. FIG. 24 shows the hub 2300 when a canopy support structure is in a retracted or partially retracted position. In this position, the telescoping mast 2304 extends past the lower surface of the upper hub 2300. The telescoping mast 2304, and the length thereof, can be used to affect the drape of a canopy attached to the canopy support structure. In some cases, the telescoping mast 2304 can be used to simply push up and elevate a portion of a canopy. Alternately, a canopy could be attached to the telescoping mast 2304, and the telescoping mast 2304 can push or pull the canopy to affect the canopy's drape.

The height of the hubs 2300, 2302 may be selected such that the hubs 2300, 2302 rest against each other or abut a spacer 2306 of the telescoping mast 2304 when a canopy support structure is in its fully extended position. Among other things, having the hubs 2300, 2302 rest against each other when the canopy support structure is extended helps prevent over-rotation of the structure's articulating arms.

In some cases, a telescoping mast may have a threaded finial attached to its upper end. In this manner, a canopy may be provided with a hole or grommet through which a portion of the telescoping mast may be inserted before the finial and mast are threaded together from opposite sides of the canopy.

In some embodiments, the canopy support structure 100 may be modified by eliminating its lateral support members 110, 112, 150, 152. This makes the structure simpler and less expensive, but also makes it weaker. Nonetheless, the option of eliminating lateral support members can be especially useful when designing umbrellas for more protected areas. The umbrella's secondary hubs 122-132 remain laterally braced, but by secondary arms at obtuse angles as opposed to primary arms at acute angles. In fact, canopies directly attached to the upper secondary hubs 122, 126, 130 would do the task of bracing those hubs 122, 126, 130, which may be all the bracing needed for some sizes of canopy support structures.

Figure 25:
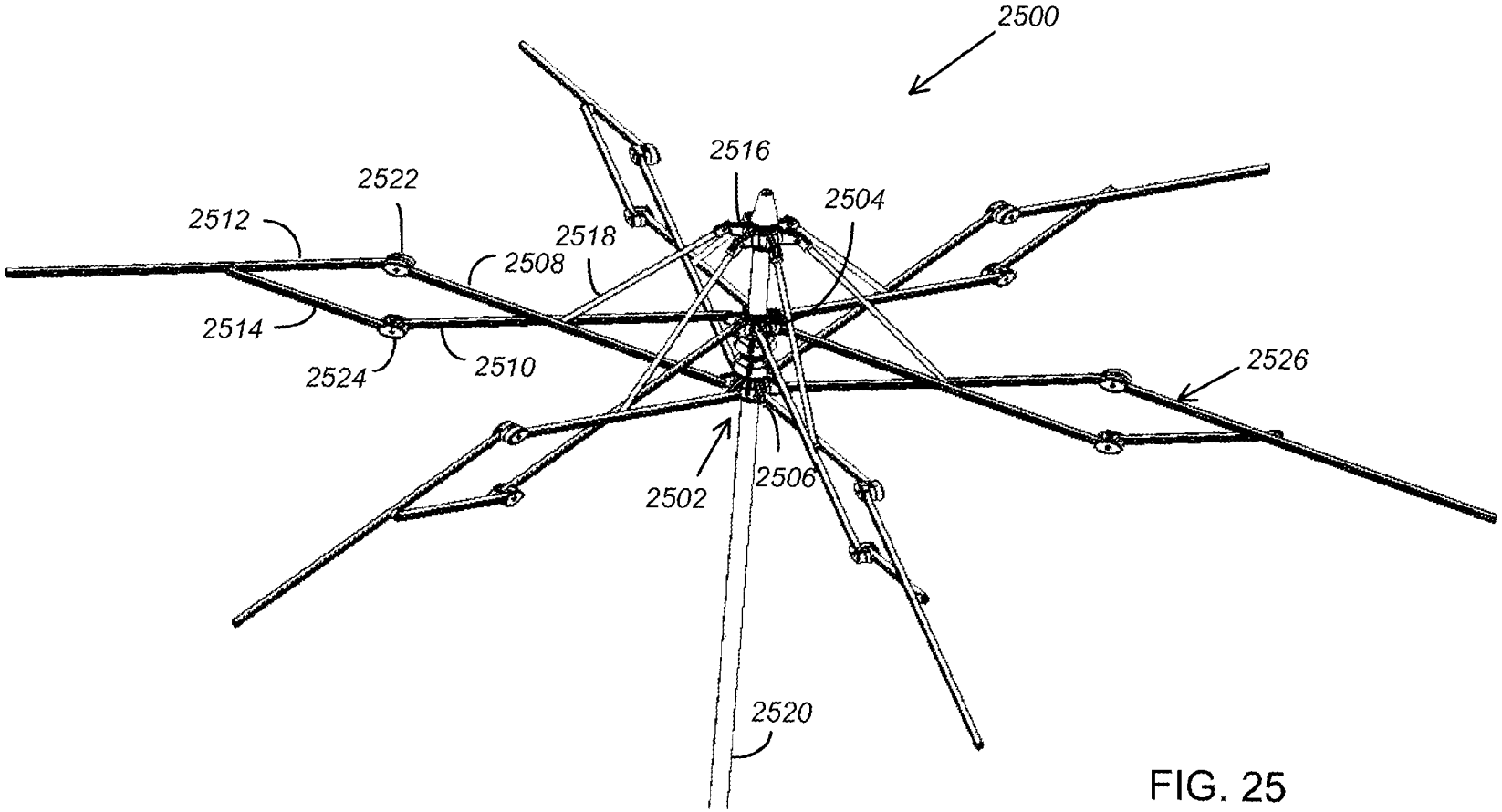
FIG. 25 illustrates a second example of a canopy support structure.
Figure 26:
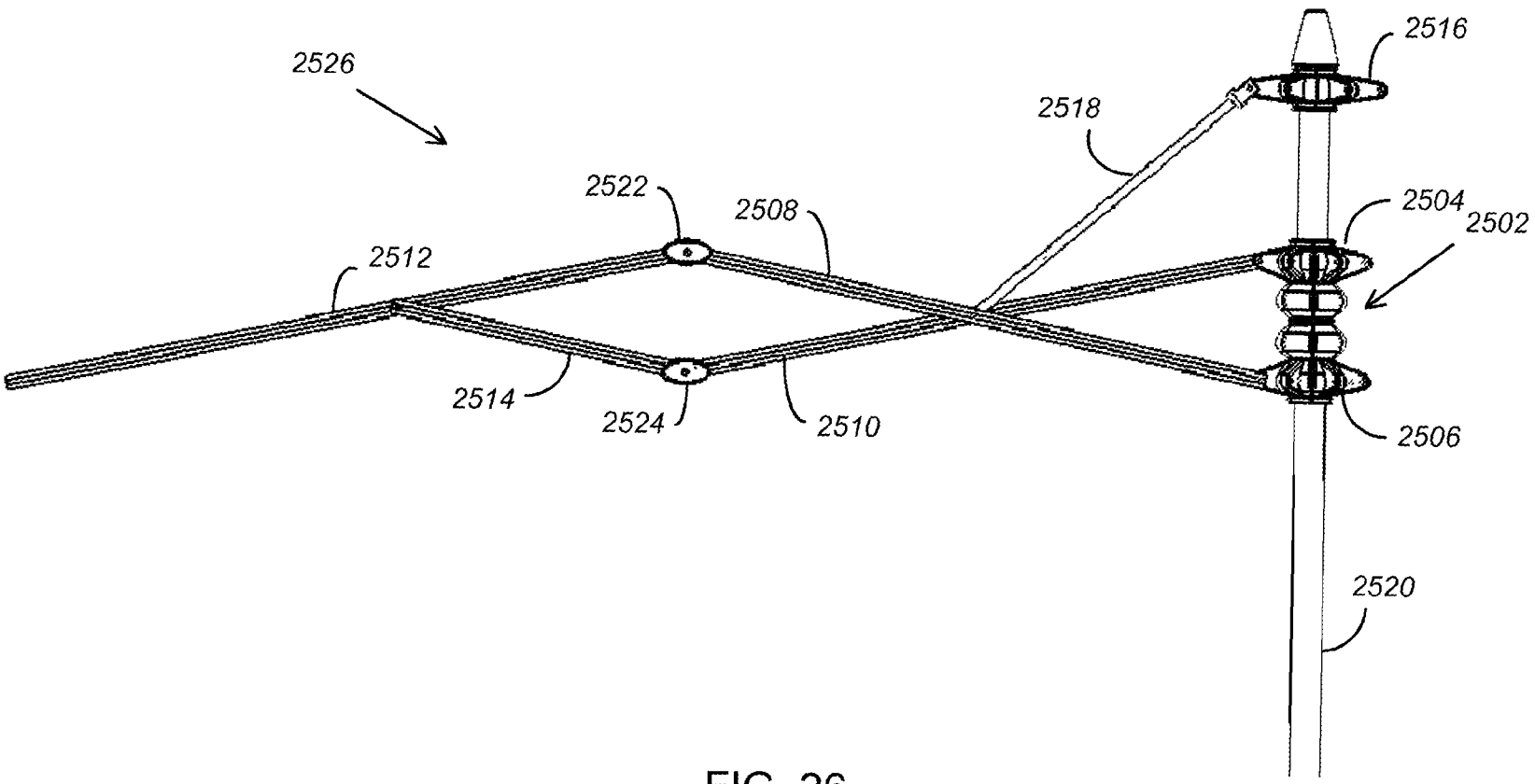
FIG. 26 illustrates an elevation of one radial arm of the canopy support structure shown in FIG. 25.

FIG. 25 illustrates a second example 2500 of a canopy support structure, and FIG. 26 illustrates an elevation of one radial arm of the canopy support structure 2500. The canopy support structure 2500 comprises a pair 2502 of primary hubs 2504, 2506, a plurality of primary, secondary and tertiary articulating arms (e.g., 2508, 2510, 2512, 2514), a suspension hub 2516, a plurality of suspension arms (e.g., 2518), and a pole 2520, and operates similarly to the canopy support structure 100. However, in addition to eliminating lateral support members, the canopy support structure 2500 uses brackets (e.g., 2522, 2524) in lieu of secondary hubs. In alternate embodiments, the brackets 2522, 2524 could be replaced with simple bypass pin connections. However, the brackets 2522, 2524 provide additional stability to the joints between articulating arms 2508/2512, 2510/2514, and the upper brackets 2522 provide an anchor point for attaching a canopy or components thereof to the framework 2526. Additionally, the upper brackets 2522 protect an attached canopy from wear due to friction resulting from contact with the articulating arms 2508, 2512.

Similarly to the primary hubs 118, 120 of the canopy support structure 100 shown in FIG. 1, the primary hubs 2504, 2506 are coupled to and movable along the pole 2520. The hubs 2504, 2506 are movable toward each other during extension of the canopy support structure 2500, and away from each other during retraction of the canopy support structure 2500.

Each of the primary 2508, 2510, secondary 2512 and tertiary 2514 articulating arms is connected directly or indirectly to the first or second primary hub 2504, 2506, with at least some of the articulating arms 2508, 2510 being coupled in sets of scissor-connected primary articulating arms. In the canopy support structure 2500 shown, all of the scissor-connected primary articulating arms 2508, 2510 are connected directly to the first and second primary hubs 2504, 2506 and extend outward from the first and secondary primary hubs 2504, 2506 during expansion of the canopy support structure 2500. In alternate embodiments of the canopy support structure 2500, additional sets of scissor-connected primary articulating arms (and additional brackets) may be used to further extend the reach of a canopy support structure and may be indirectly connected to the first and second primary hubs 2504, 2506 via other sets of scissor-connected primary articulating arms. The same is true for the other canopy support structures (e.g., structure 100) disclosed herein.

Figure 27:
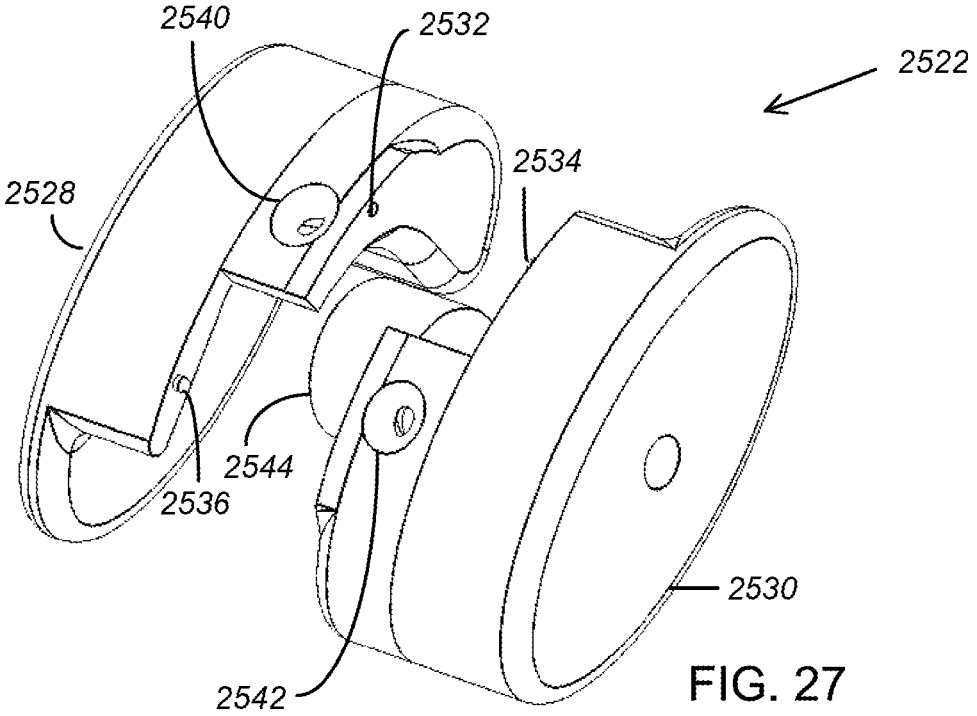
FIGS. 27 & 28 provide exploded views of a bracket used in the FIG. 25 canopy support structure.
Figure 28:
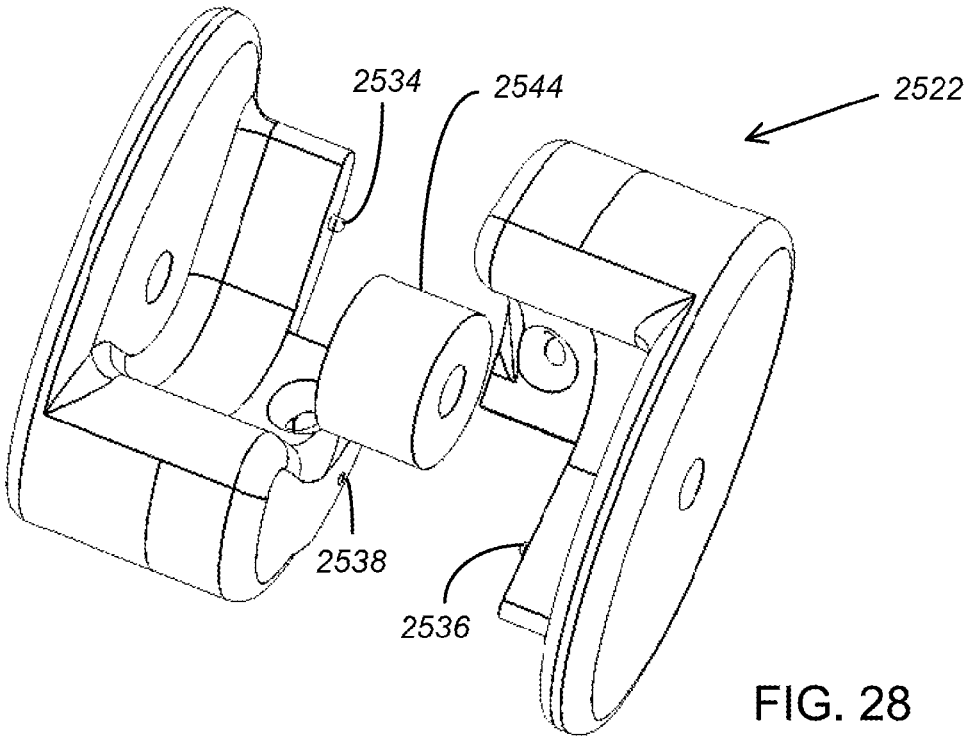

FIGS. 27 & 28 provide exploded views of one bracket 2522. FIG. 27 provides a view of the bracket 2522 as it would be seen from above a canopy. As shown, the bracket 2522 may be formed using two pieces 2528, 2530 of a single modular component, with one of the pieces 2530 rotated 180 degrees with respect to the other piece 2528.

Each modular component 2528, 2530 comprises alignment features such as an alignment hole 2532 or 2538 and an alignment pin 2534 or 2536, enabling the pin 2534 or 2536 of one component to be received by the hole 2532 or 2538 of the other component. Each modular component 2528, 2530 also comprises a hole 2540 or 2542. When the components 2528, 2530 of the bracket 2522 are assembled, the holes 2540, 2542 may be used for lacing a canopy or components thereof to the bracket 2522. This not only provides a mechanism for attaching the canopy to a lattice framework 2530, but can also enable the canopy to provide additional structural stability to the canopy support structure 2500 when the structure 2500 is in its extended position.

Figure 29:
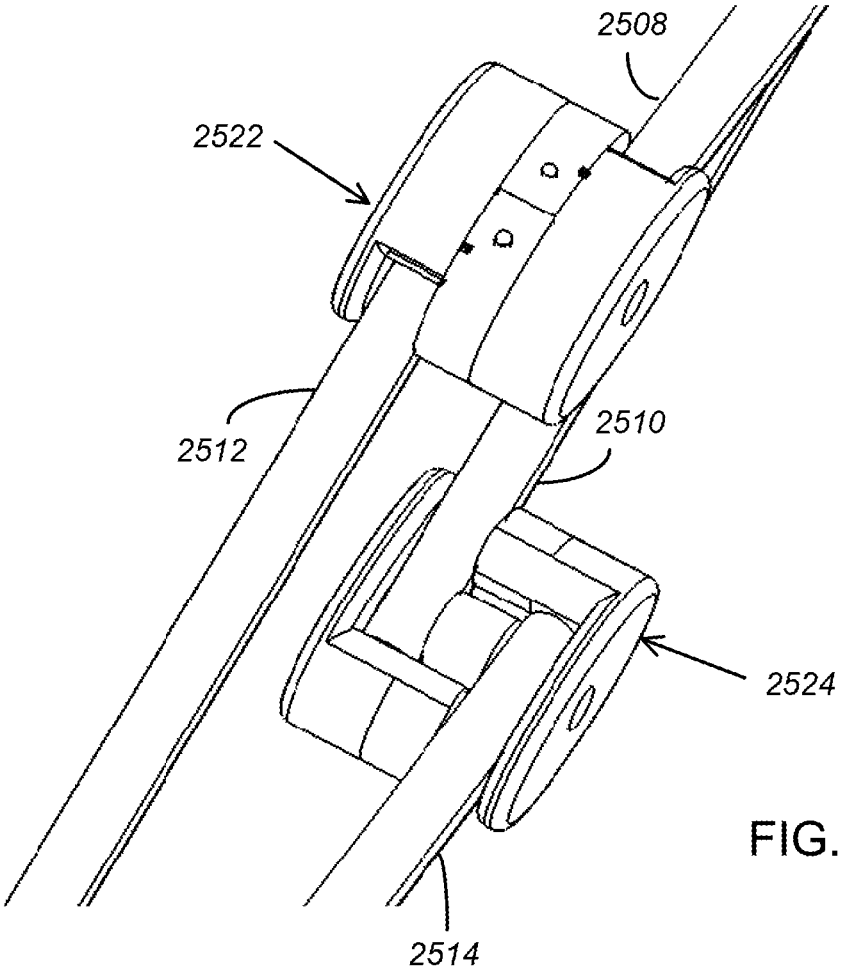
FIG. 29 illustrates a top view of a first bracket joining a first set of articulating arms, as well as the opposite view of a second bracket joining a second set of articulating arms.

FIG. 28 shows the undersides of the components 2528, 2530, as well as a bushing 2544 that sits between the articulating arms 2508, 2512 that are joined by the bracket 2522. FIG. 29 illustrates a top view of the bracket 2522 joining articulating arms 2508 and 2512, as well as the opposite view of the bracket 2524 joining articulating arms 2510 and 2514. The components 2528, 2530, 2544 of each bracket 2522, as well as the articulating arms 2508, 2512 to be joined, may be fastened together by inserting a pin through respective holes in the bracket components 2528, 2530, 2544 and articulating arms 2508, 2512.

Figure 30:
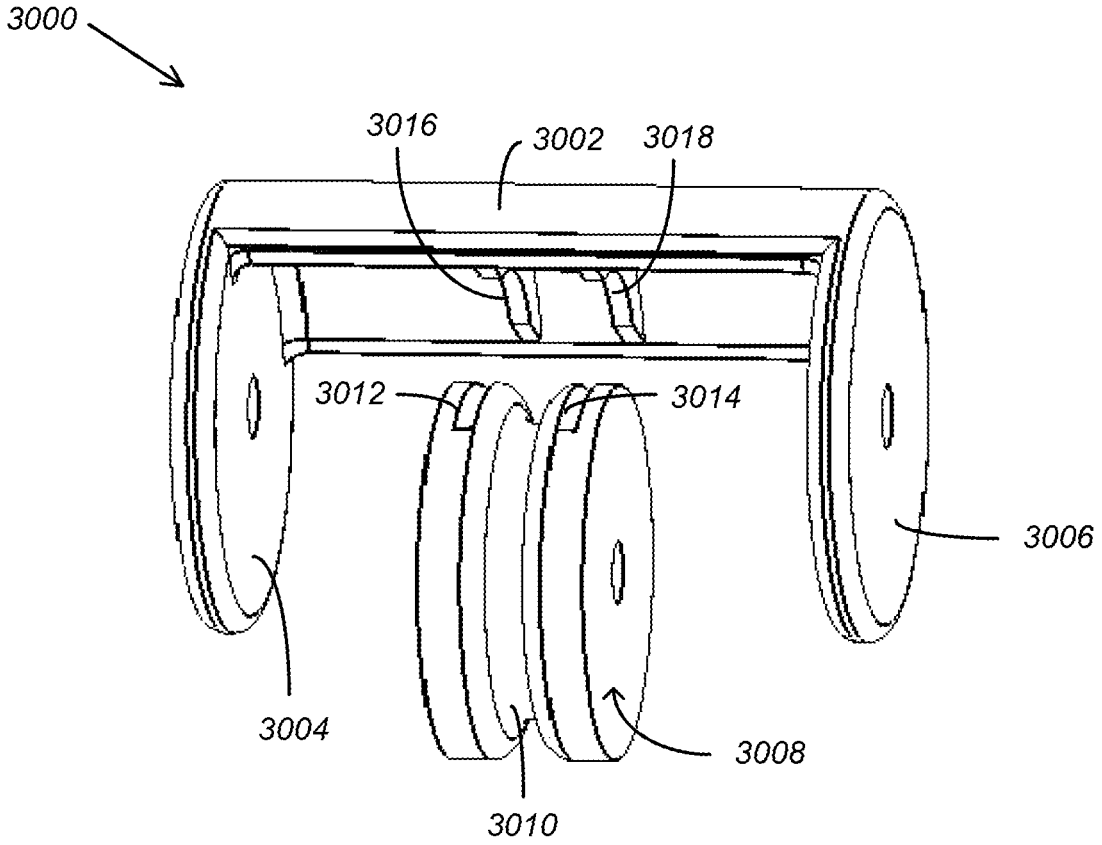
FIG. 30 provides an exploded view of an alternate bracket usable in the FIG. 25 canopy support structure.

In alternate embodiments of the canopy support structure 2500, different forms of brackets or fasteners could be used to join articulating arms. One such bracket is illustrated in FIG. 30. Of note, the bracket 3000 has only two elements, versus the three elements included in the brackets 2522, 2524 shown in FIGS. 25-29. One element comprises a bridge 3002 connecting two end caps 3004, 3006. The other element is a wheel 3008 having a circumferential channel 3010 and a pair of edge recesses 3012, 3014. The edge recesses 3012, 3014 mate with respective protrusions 3016, 3018 on the underside of the bridge 3002. One articulating arm may be positioned between the wheel 3008 and the end cap 3004, and another articulating arm may be positioned between the wheel 3008 and the end cap 3006. A pin may then be inserted through corresponding holes in the end caps 3004, 3006, wheel 3008 and articulating arms. Other brackets may include, for example, a feature or mechanism (e.g., a hole, hook or connector) for connecting rigid or flexible lateral support members to the brackets.

Figure 31:
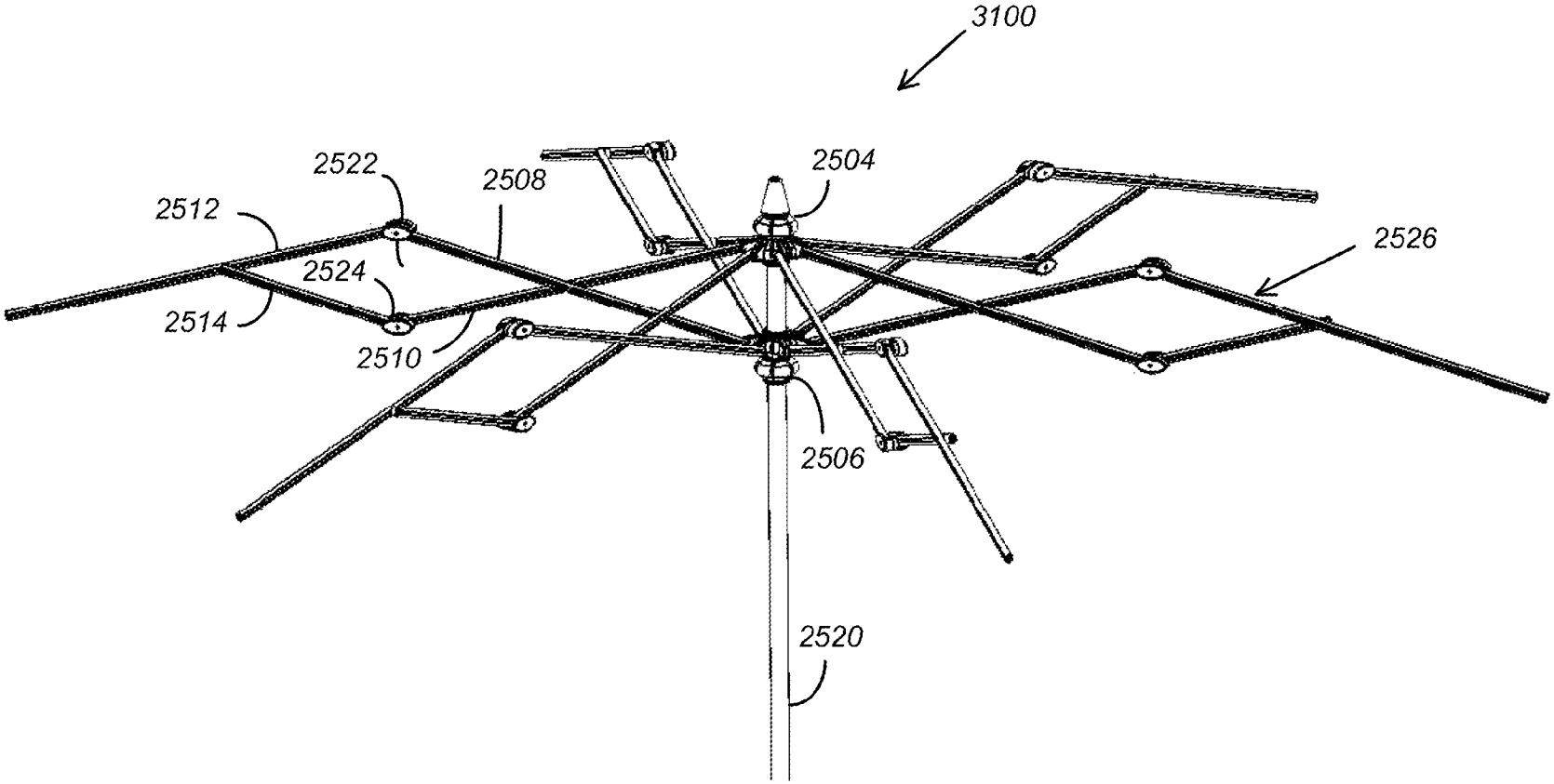
FIGS. 31 & 32 illustrate a third example of a canopy support structure, without the suspension mechanism illustrated in FIG. 25.
Figure 32:
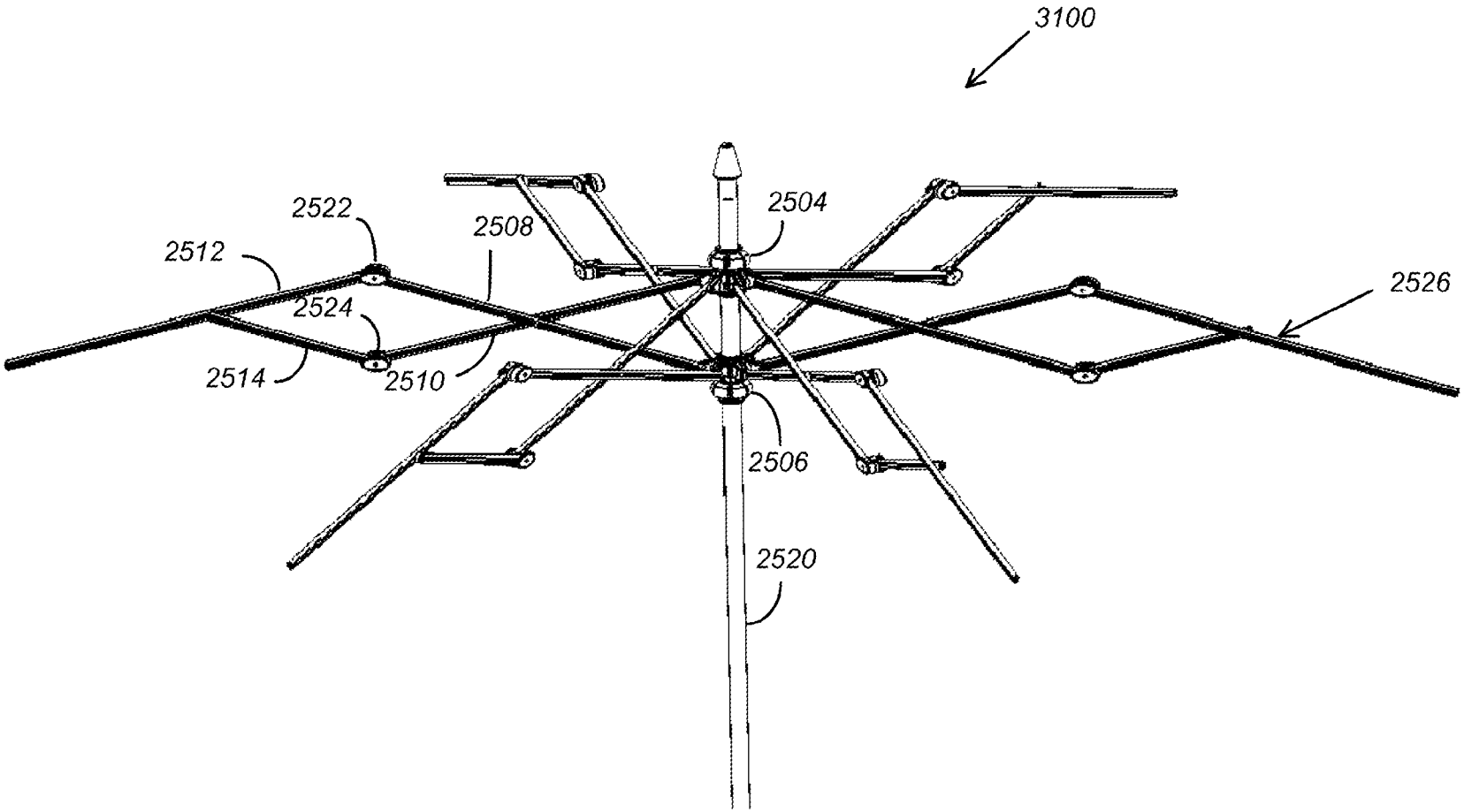

FIGS. 31 & 32 illustrate a third example 3100 of a canopy support structure. The structure 3100 is similar to the structure 2500, but with elimination of the suspension mechanism (e.g., the suspension hub 2516 and arms 2518). With elimination of the suspension mechanism, the canopy support structure 2500 has fewer parts, but the stability of the framework 2526 becomes dependent on the spacing of the primary hubs 2504, 2506 when the canopy support structure 2500 is extended. This tends to limit the horizontal extent of the canopy support structure 2500. Also, without the suspension mechanism, the ability of the upper primary hub 2504 to roll or slide down the pole 2520 needs to be limited via a pin or other mechanism at or near the top of the pole 2520.

To provide maximum clearance under the canopy support structure 3100 when extended, the lower bound of the upper primary hub 2504 needs to be positioned as close to the top of the pole 2520 as possible. However, this requires a canopy to take on a shallow dome shape, which may be less aesthetically pleasing. To achieve a canopy with concave draping and more visual interest, the lower bound of the upper primary hub 2504 can be set at a lower position on the pole 2520, as shown in FIG. 32. In either case, the lower bound of the upper primary hub 2504 may be positioned along the length of the pole 2520 by inserting a stop pin through holes in the pole 2520 positioned just below a desired position of the upper primary hub 2504. In some embodiments, multiple sets of holes may be provided in the pole 2520, so that a canopy operator may choose the location at which the lattice framework 2526 will be opened. When coupled with a pin or other mechanism to set the lowest extent of the lower primary hub 2506, setting the lower extent of the upper primary hub 2504 short of the top of the pole 2520 allows the upper primary hub 2504 to move upward along the pole as the canopy support structure 3100 retracts and the lowest primary hub 2506 reaches its lower bound. This allows a canopy designer to set the lower clearance of the retracted framework 2526 independently of the lower clearance of the extended framework 2526.

Note that the lower primary hub 2506 in FIGS. 31 & 32 is flipped 180 degrees with respect to its orientation in FIG. 25. This modification places the hub's ribs "up" and enables the non-ribbed portion of the hub 2506 to be gripped when a user wants to extend or retract the canopy support structure 2500, as opposed to providing the canopy support structure with a crank or pulley mechanism. Flipping one or both primary hubs 2506, 2508 of any canopy support structure 180 degrees also allows the secondary hubs 122, 124 of the canopy support structure 100 (or brackets 2522, 2524 of the canopy support structure 2500) to draw closer together for a shallower framework 186, 2526 when fully extended.

Figure 33:
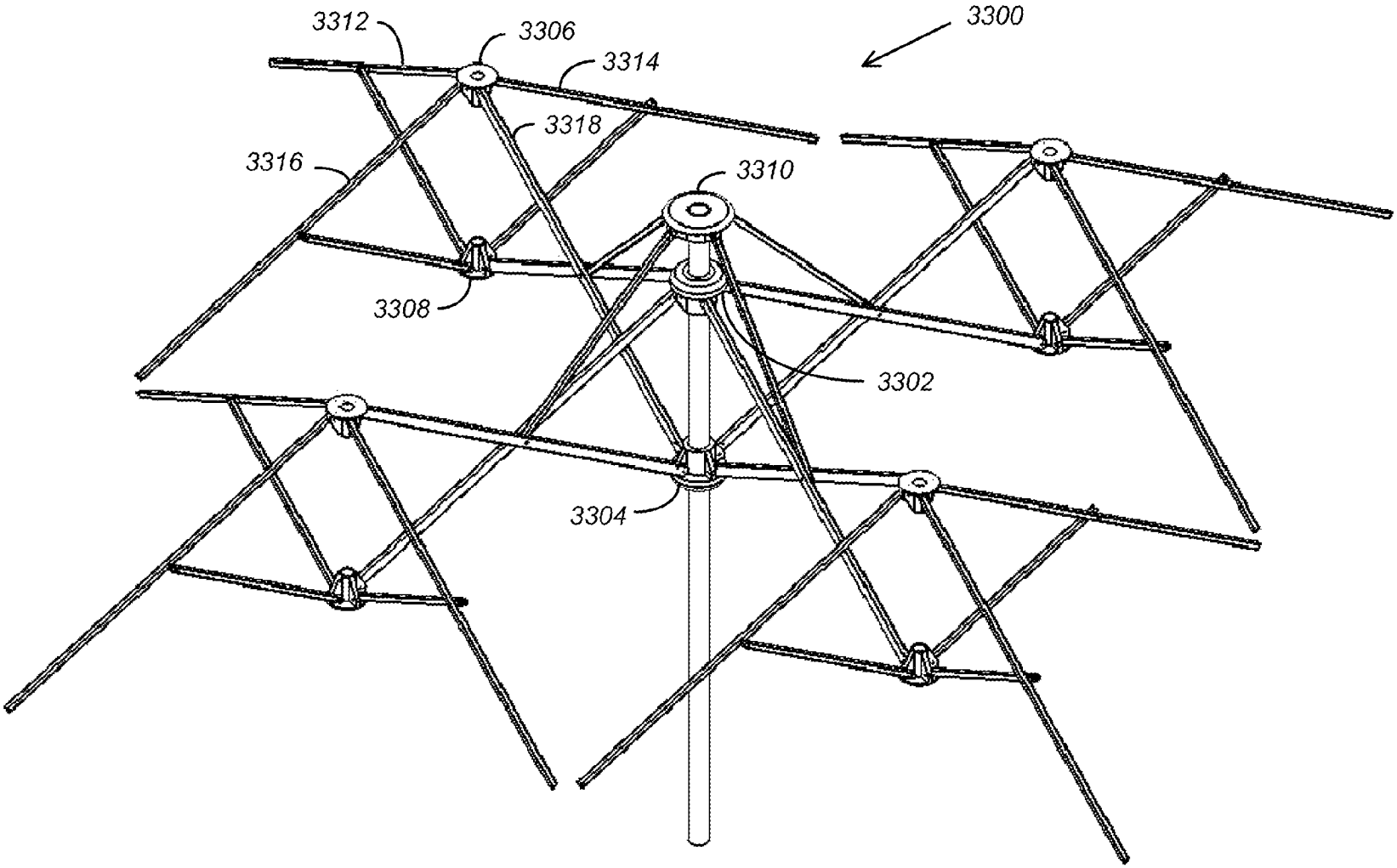
FIG. 33 illustrates a square "quadrilattice" canopy support structure.

The various hubs used in the canopy support structures 100, 2500, 3100 described above are each configured to attach to six articulating arms or members. In other canopy support structures, hubs may be configured to attach to different numbers or arrangements of articulating arms and members. For example, FIG. 33 illustrates a square "quadrilattice" canopy support structure 3300 in which the primary hubs 3302, 3304, secondary hubs (e.g., 3306, 3308, and suspension hub 3310 are each configured to attach to four articulating arms (e.g., 3312, 3314, 3316, 3318).

Figure 34:
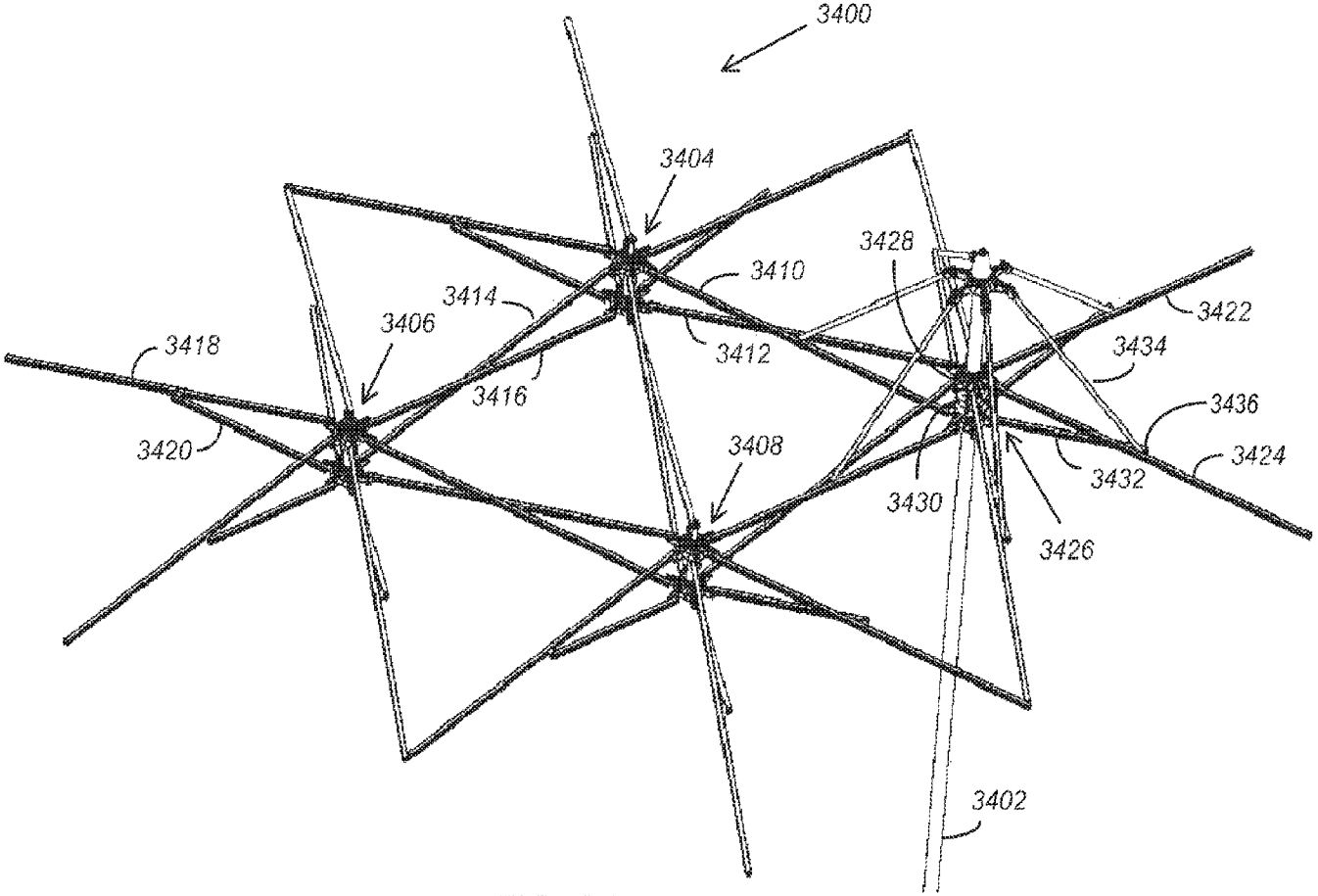
FIGS. 34 & 35 illustrate a fourth example of a canopy support structure, referred to as an "offset equilattice" canopy support structure.
Figure 35:
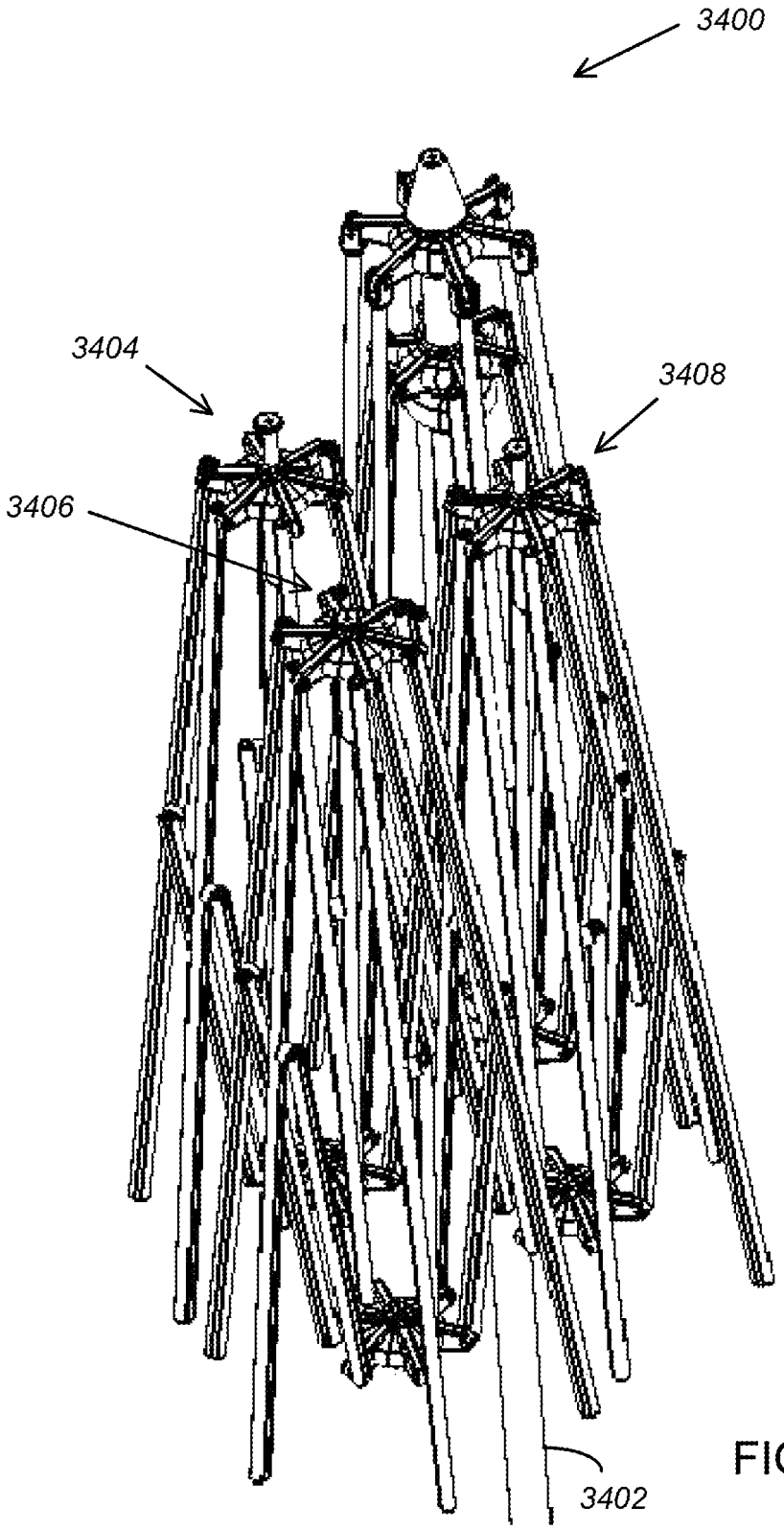

FIGS. 34 & 35 illustrate a fourth example 3400 of a canopy support structure. This embodiment is referred to as an "offset equilattice" canopy support structure 3400. FIG. 34 illustrates the structure 3400 in an extended position. FIG. 35 illustrates the structure 3400 in a retracted position. In principle, the structure 3400 is configured and operates similarly to the structure 100 shown in FIGS. 1-6. However, the structure 3400 extends eccentrically rather than concentrically from a pole 3402. The canopy support structure 3400 also includes two tiers of secondary hub pairs, with the secondary hub pairs 3404 and 3408 being one tier removed from the primary hub pair 3426, and with the secondary hub pair 3406 being two tiers removed from the primary hub pair 3426.

The number and arrangement of secondary hub pairs 3404, 3406, 3408 and articulating arms (e.g., 3410, 3412, 3414, 3416, 3418, 3420) is exemplary only, and other offset canopy support structures can have different numbers and arrangements of secondary hubs and articulating arms. Of note, many of the same hub and articulating arm components that are used to construct the concentric canopy support structure 100 shown in FIG. 1 may be used to construct the eccentric canopy support structure 3400 shown in FIG. 34. Note, however, that when the canopy support structure 3400 has a relatively short overhang on one side of the pole 3402, the use of secondary hubs or brackets may not be necessary in that part of the canopy support structure 3400. For example, a secondary articulating arm 3424 may be coupled at one end to the upper primary hub 3428; a tertiary articulating arm 3432 may be coupled at one end to the lower primary hub 3430; and the tertiary articulating arm 3432 may be coupled to the body of the secondary articulating arm 3424. Alternately, the secondary articulating arm 3424 could be replaced with another tertiary articulating arm. In either case, one end of a suspension arm 3434 may be coupled to the pin 3436 that joins the articulating arms 3424 and 3432.

In some cases, counterweights may be hung from the articulating arms 3422, 3424 of the shorter overhang; and in some cases, the counterweights may be hanging flower planters. Alternately, and by way of example, an optional brace may be secured between one of the articulating arms 3422, 3424 and the pole 3402 (or pole base, or ground) when the canopy support structure 3400 is extended. The brace may criss-cross the pole when viewed from certain angles, or may extend substantially vertically to the ground or pole base. When the canopy support structure 3400 is retracted, the brace may be detached from the canopy support structure 3400 at one or both ends. Alternately, the body of the brace can be configured to articulate, telescope or bend (e.g., in the case of a cable, wire or other flexible brace) as the canopy support structure is moved to its retracted position.

Figure 36:
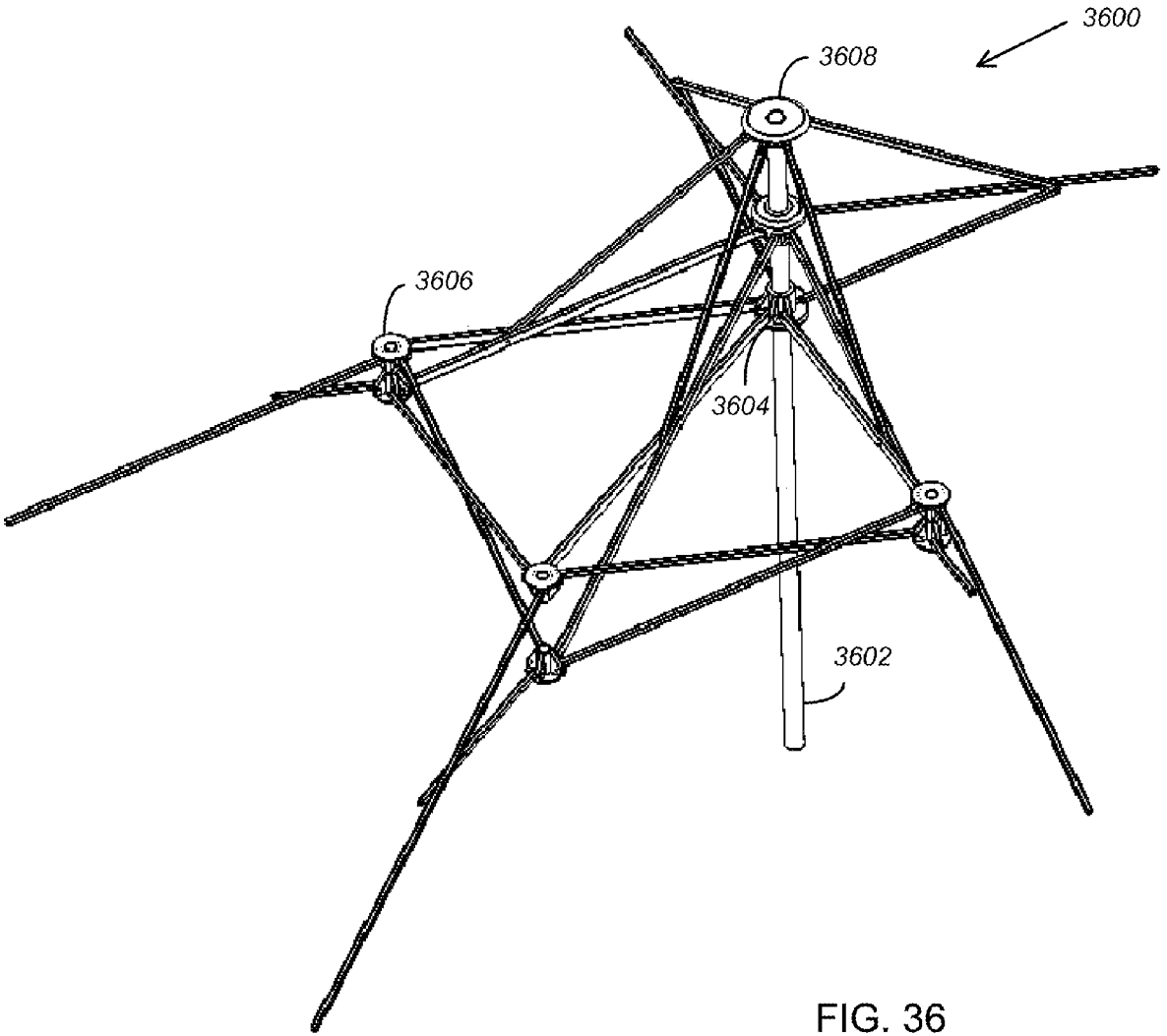
FIG. 36 illustrates a fifth example of a canopy support structure.
Figure 37:
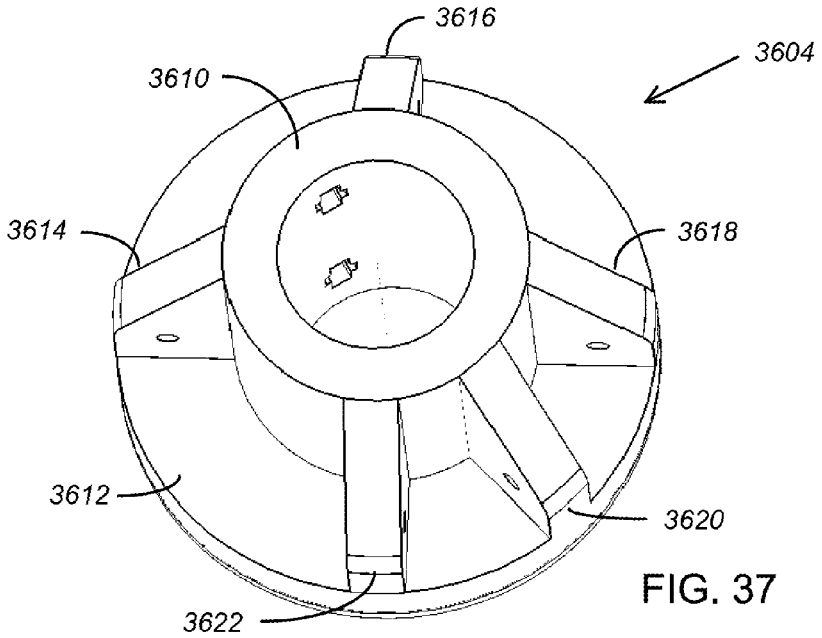
FIG. 37 provides a close-up view of a primary hub usable in the FIG. 36 canopy support structure.

FIG. 36 illustrates a fifth example 3600 of a canopy support structure. The structure 3600 not only extends eccentrically from a pole 3602, but it comprises hubs (e.g., 3604, 3606, 3608) with asymmetric arrangements of ribs. For example, FIG. 37 provides a close-up view of the primary hub 3604, which has a sleeve 3610 connected to a collar 3612, with five ribs 3614, 3616, 3618, 3620, 3622 connecting the sleeve 3610 and the collar 3612. The ribs 3614, 3616, 3618, 3620, 3622 are distributed asymmetrically about the sleeve 3610.

Figure 38:
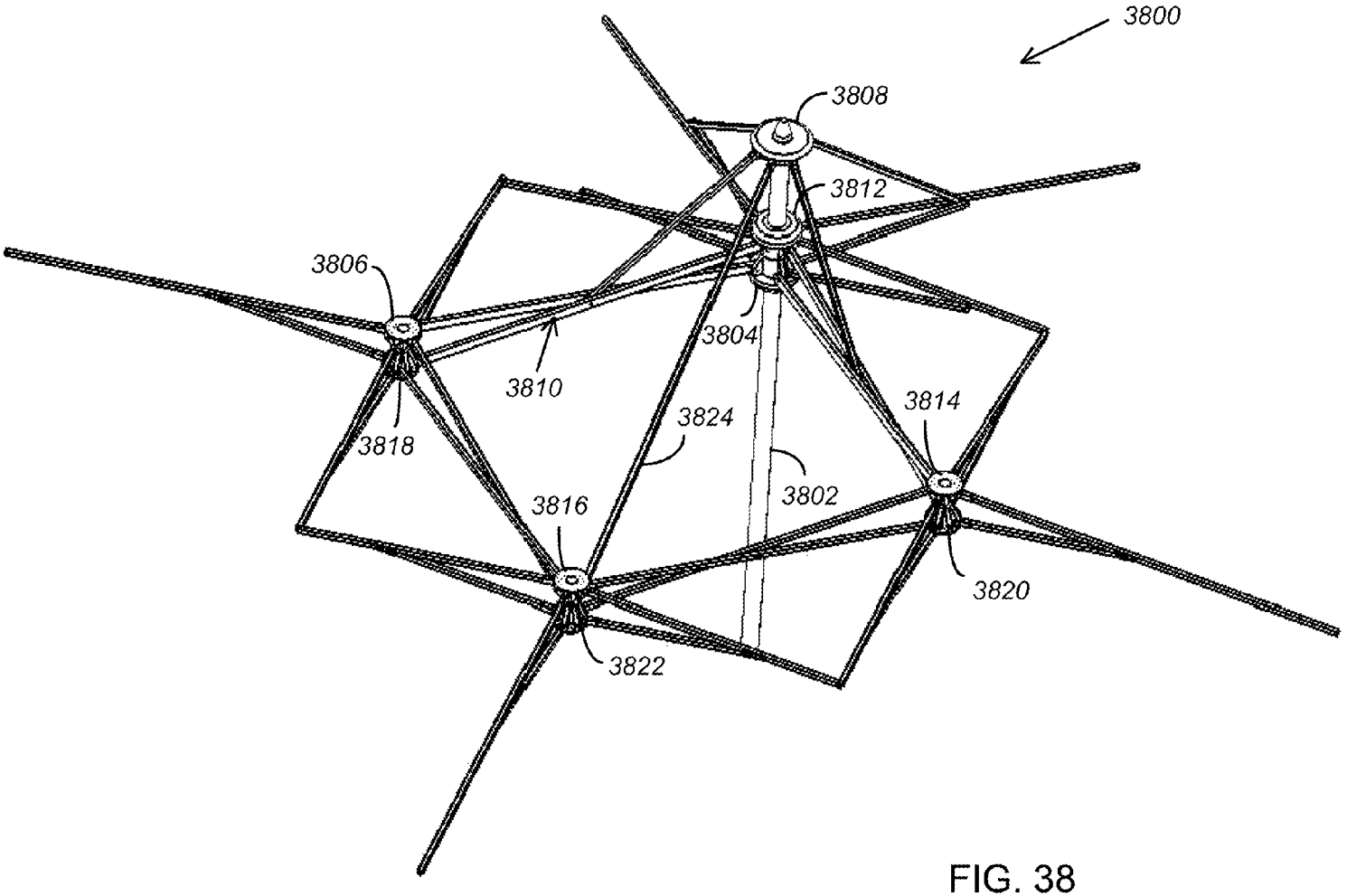
FIG. 38 illustrates a sixth example of a canopy support structure.

FIG. 38 illustrates a sixth example 3800 of a canopy support structure. The structure 3800 extends eccentrically from a pole 3802 and comprises hubs (e.g., 3804, 3806, 3808, 3814, 3816, 3818, 3820, 3822) with asymmetric arrangements of ribs. In contrast to the other canopy support structures disclosed herein, the structure 3800 has a three-dimensional articulating lattice structure with a quadrilateral support structure 3810 (in the example shown, a square support structure). The quadrilateral support structure 3810 comprises a first set of hubs 3806, 3812, 3814, 3816 defining vertices of a first quadrilateral; a second set of hubs 3804, 3818, 3820, 3822 defining vertices of a second quadrilateral; and a plurality of articulating arms that interconnect the hubs 3804, 3806, 3812, 3814, 3816, 3818, 3820, 3822. Also unlike the other canopy support structures disclosed herein, the structure 3800 comprises an articulating, telescoping or flexible suspension member 3824 that connects to a hub 3822 (or to a rib thereof).

Figure 39:
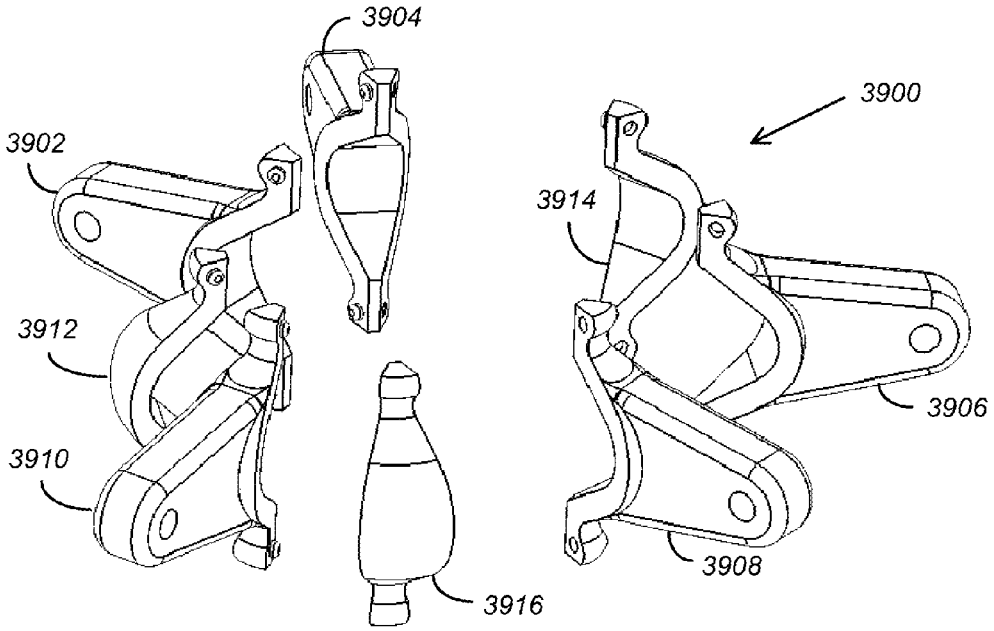
FIG. 39 illustrates a modular secondary hub that could be used in place of any of the secondary hubs shown in FIG. 38.

FIG. 39 illustrates a modular secondary hub 3900 that could be used in place of any of the secondary hubs 3806, 3814, 3816, 3818, 3820, 3822 shown in FIG. 38. Unlike the modular hubs described earlier in this description, the modular secondary hub 3900 comprises a number of 45 degree wedges instead of a number of 60 degree wedges. The modular secondary hub 3900 also comprises a mix of different types of wedges, including a first number of identical type wedges 3902, 3904, 3906, 3908, 3910 with ribs, and a second number of identical type wedges 3912, 3914, 3916 without ribs (i.e., blanks). The modular secondary hub 3900 therefore illustrates how different types of modular components may be mixed to form different configurations of hubs. For some embodiments of canopy support structure, wedges of different angular extents can be mixed to form a single hub. For example, 15, 30, 45 and even 60 degree wedges could be mixed to form a single hub. In general, modular components of smaller angular extent can be mixed and matched to form a wider variety of hub configurations.

Figure 40:
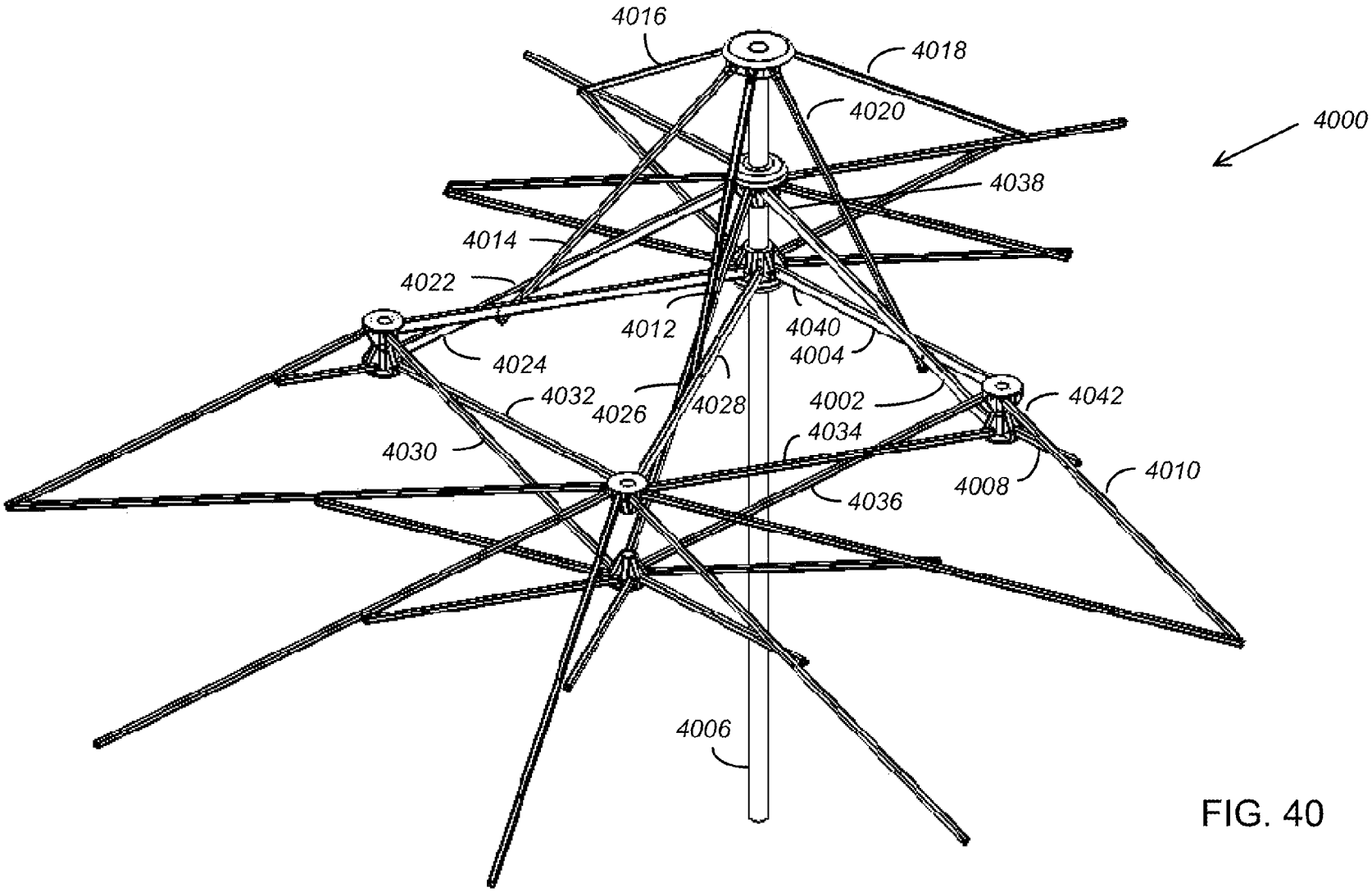
FIG. 40 illustrates a seventh example of a canopy support structure.

FIG. 40 illustrates a seventh example 4000 of a canopy support structure. The structure 4000 employs an array of different types of hubs, as well as scissor-connected primary articulating arms (e.g., 4002, 4004) of different lengths. More particularly, the canopy support structure 4000 is an offset square quadrilattice similar to the canopy support structure 3800. However, unlike the canopy support structure 3800, which has a suspension arm 3824 directly connected to secondary hub 3816 or 3822, the canopy support structure 4000 has a suspension arm 4012 connected to primary articulating arms 4026 and 4028, at the hypotenuse of the square formed by the articulating arms 4002, 4004, 4022, 4024, 4030, 4032, 4034 and 4036. This arrangement requires the primary articulating arms 4026 and 4028 to be longer than the primary articulating arms 4002, 4004, 4022 and 4024, but allows the suspension arms 4012, 4014, 4016, 4018, 4020 to be the same length. In addition, it may require that the distance from one end of a primary, secondary, or tertiary arm to the closest scissor connection along the length of the arm be the same for all arms connected to any single hub. Alternately, the sum of the distance from one end of a primary, secondary, or tertiary arm to the closest scissor connection along the length of the arm and the distance from the corresponding end of the primary, secondary, or tertiary arm with which it is connected to the scissor connection by which the pair of arms are connected can be the same for all connected pairs of arms at all hub pairs. Alternately, varying the distance from the end of an arm to a scissor connection within a pair of arms, while keeping the sum of those distances the same for all pairs of hubs, allows the umbrella or awning designer to vary the pitch of the extended framework without compromising its smooth operation and compact contraction. For example, by increasing the length of the end 4038 of a downward sloping arm 4002 of a scissor-connected primary articulating arm pair 4002/4004, while decreasing the length of the end 4040 of an upward sloping arm 4004 by an equal amount, the canopy support structure 4000 can be caused to slope downward as it extends away from the pole 4006. In a similar manner, a shorter tertiary articulating arm 4008 paired with a shorter end 4042 of a secondary articulating arm 4010 causes the secondary articulating arm 4010 to slope downward at a steeper angle. Such modifications can give rise to an even greater array of canopy support structure shapes, slopes and configurations.

Providing a canopy support structure with telescoping arms, to allow the above-described variations in arm length, allows the operator to independently adjust the slope of articulating arms upward or downward to account for varying angles of the sun, thereby providing increased shade advantage. Also, controlling the telescoping potential in the articulating arms with alignment holes of equal spacing, and connecting the telescoping arms with their corresponding main bodies with spring-loaded pins, allows a canopy support structure to be retracted at any time without restoring the symmetric configuration of the arms. Alternatively, inserting a spring inside the outer arm of the telescoping pair of arms and before inserting the inner arm of the telescoping pair of arms allows the spring to absorb impact resulting from the shade structure inadvertently falling or being blown over during a wind event.

Figure 41:
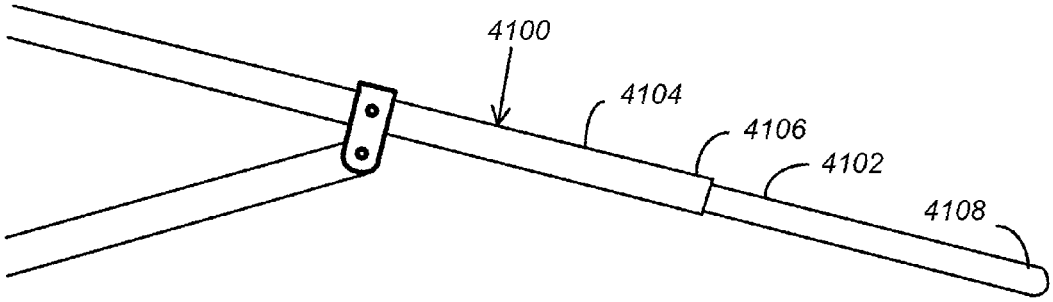
FIGS. 41 & 42 illustrate a secondary articulating arm having an optional telescoping arm.
Figure 42:
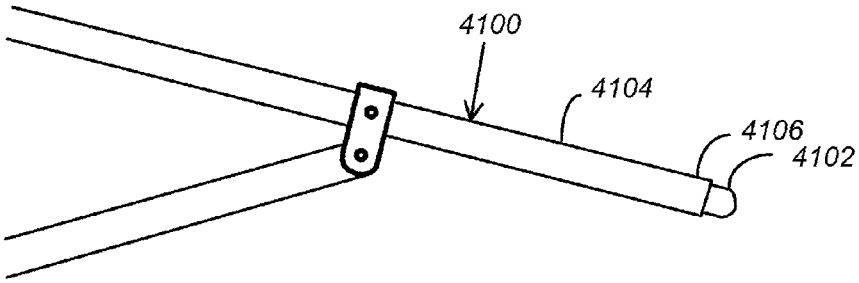

FIGS. 41 & 42 illustrate a secondary articulating arm 4100 having an optional telescoping arm 4102. The telescoping arm 4102 slides within a main body 4104 of the secondary articulating arm 4100. The main body 4104 or telescoping arm 4102 can be tapered or otherwise configured so that the telescoping arm 4102 can be locked within the main body 4104 when retracted or extended. FIG. 41 illustrates the telescoping arm 4102 in a fully extended position, and FIG. 42 illustrates the telescoping arm 4102 in a partially or fully retracted position. The use of one or more telescoping arms 4102 around the periphery of a canopy support structure allows the circumference of the canopy support structure to be modified. Connecting the canopy to both the outer end 4108 of telescoping arm 4102 and outer end 4106 of main body 4104 creates a fold in the canopy, similar to a valance, when the telescoping arm 4102 is contracted, while maintaining a fully-stretched canopy.

Figure 43:
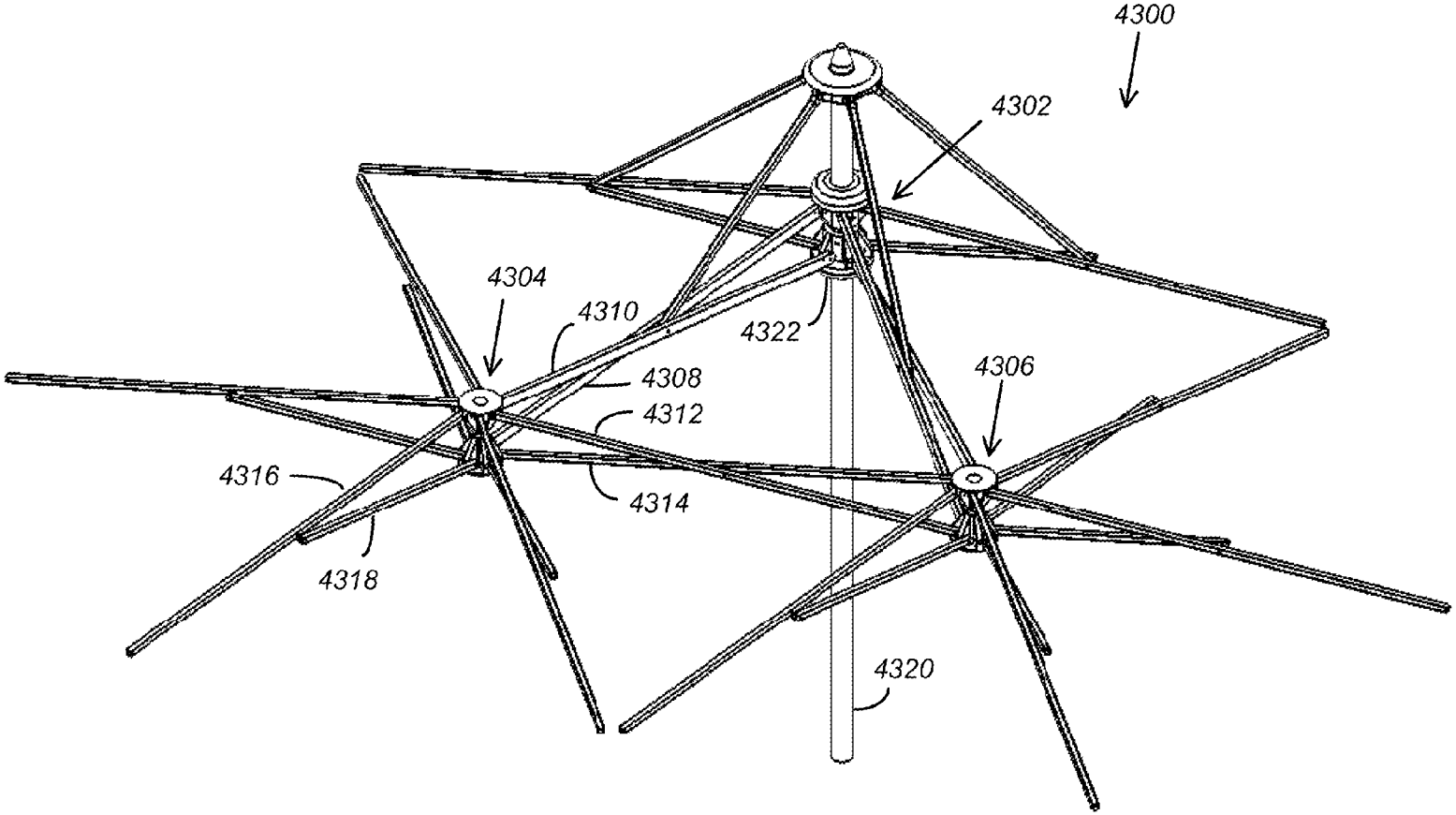
FIG. 43 illustrates a canopy support structure configured to mount on or adjacent one or more walls of a building.

In some cases, canopy support structures constructed in accordance with some or all of the principles disclosed herein may be configured to mount on or adjacent one or more walls of a building. A first such structure 4300 is shown in FIG. 43 and comprises hub pairs 4302, 4304, 4306 and articulating arms or members 4308, 4310, 4312, 4314, 4316, 4318 similar to those shown in FIGS. 1-6. The pole 4320 may be mounted to a wall of a building using one or more suitable mounting brackets. Providing flexibility in the mounting bracket creates a tilting mechanism for the canopy, for increased shade advantage and aesthetic interest. Alternately, the pole 4320 may be mounted on the ground adjacent a wall.

Figure 44:
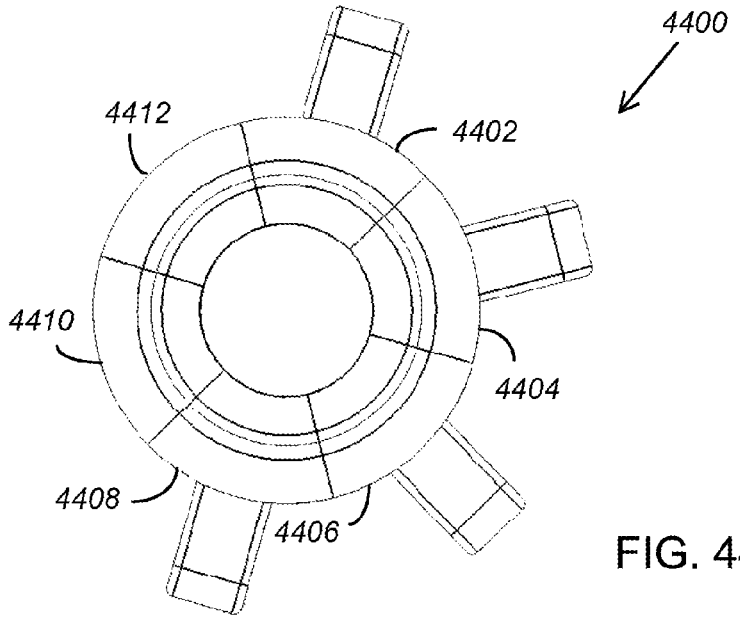
FIG. 44 provides a plan view of a modular primary hub that may be used to implement each of the primary hubs of the canopy support structure shown in FIG. 43.

FIG. 44 provides a plan view of a modular primary hub 4400 that may be used to implement each of the primary hubs 4322 of the canopy support structure 4300. The modular primary hub 4400 comprises four ribbed modular components 4402, 4404, 4406, 4408, each of which is constructed identically to the modular components 1102-1108 used in the primary hub 1100 (FIG. 11). The modular primary hub 4400 also comprises two modular components 4410, 4412 that are ribless. The ribless modular components 4410, 4412 are better adapted to facing or abutting a wall.

Figure 45:
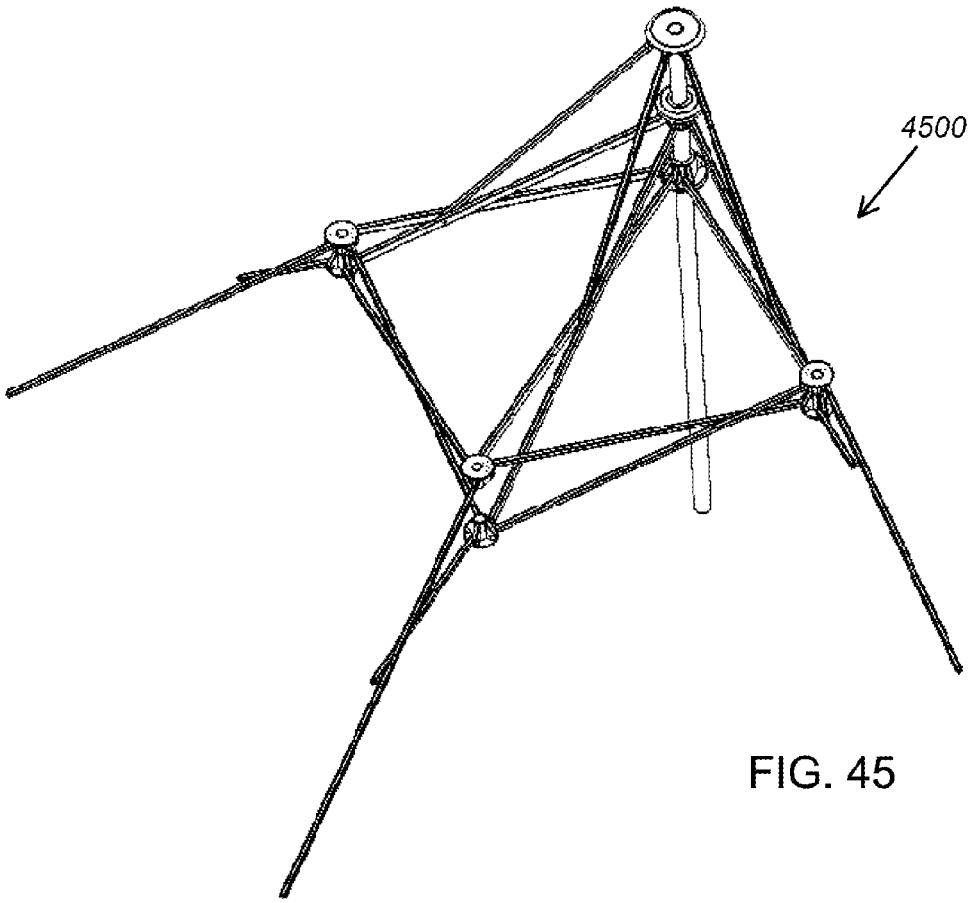
FIG. 45 illustrates a canopy support structure that is mountable at an inside corner of a building.
Figure 46:
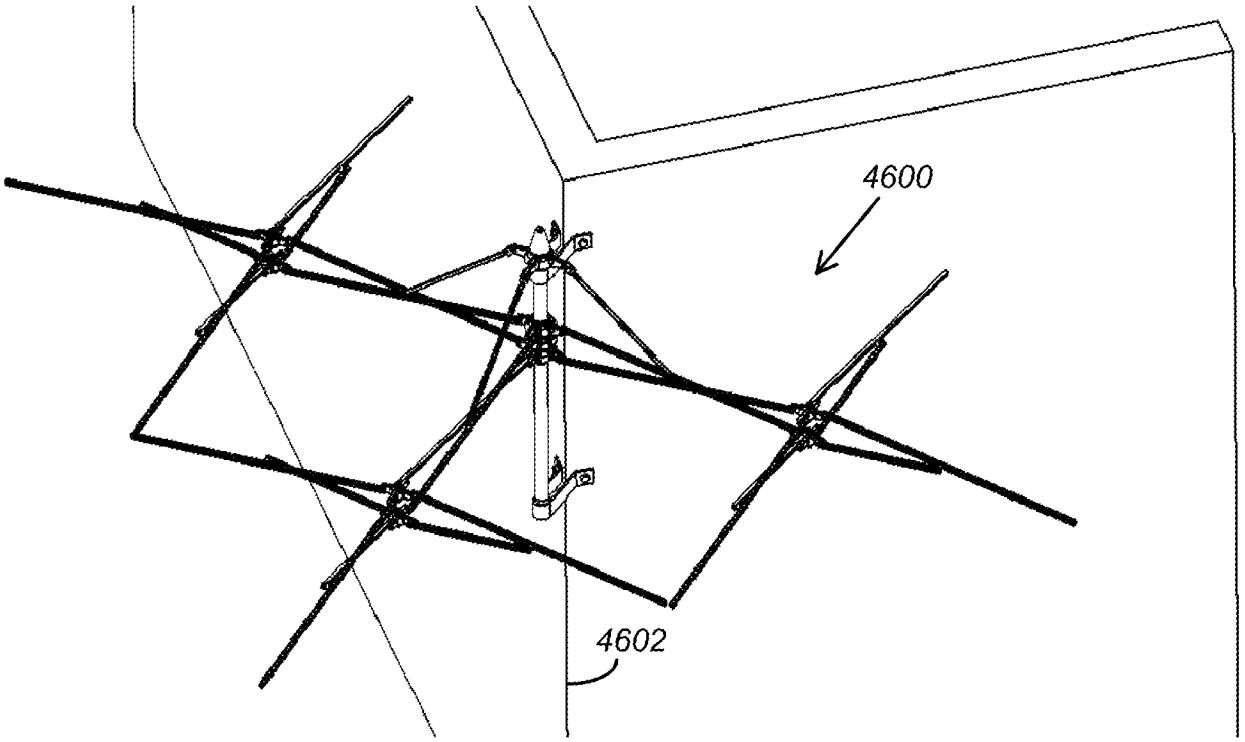
FIG. 46 illustrates a canopy support structure that is mountable at an outside corner of a building.

FIG. 45 illustrates a canopy support structure 4500 that is mountable at an inside corner of a building (e.g., to or adjacent an inside corner of a building). FIG. 46 illustrates a canopy support structure 4600 that is mountable at an outside corner 4602 of a building (e.g., to or adjacent an outside corner of a building). Each of the canopy support structures 4500, 4600 are constructed and operate similarly to other canopy support structures that have already been described.

In addition to mounting a pole of a canopy support structures on or near a wall or building, a canopy support structure may be movably mounted on one or more tracks mounted on a wall or building. FIGS. 47-50 illustrate various exemplary ways to mount a canopy support structure on a track or tracks.

Figure 47:
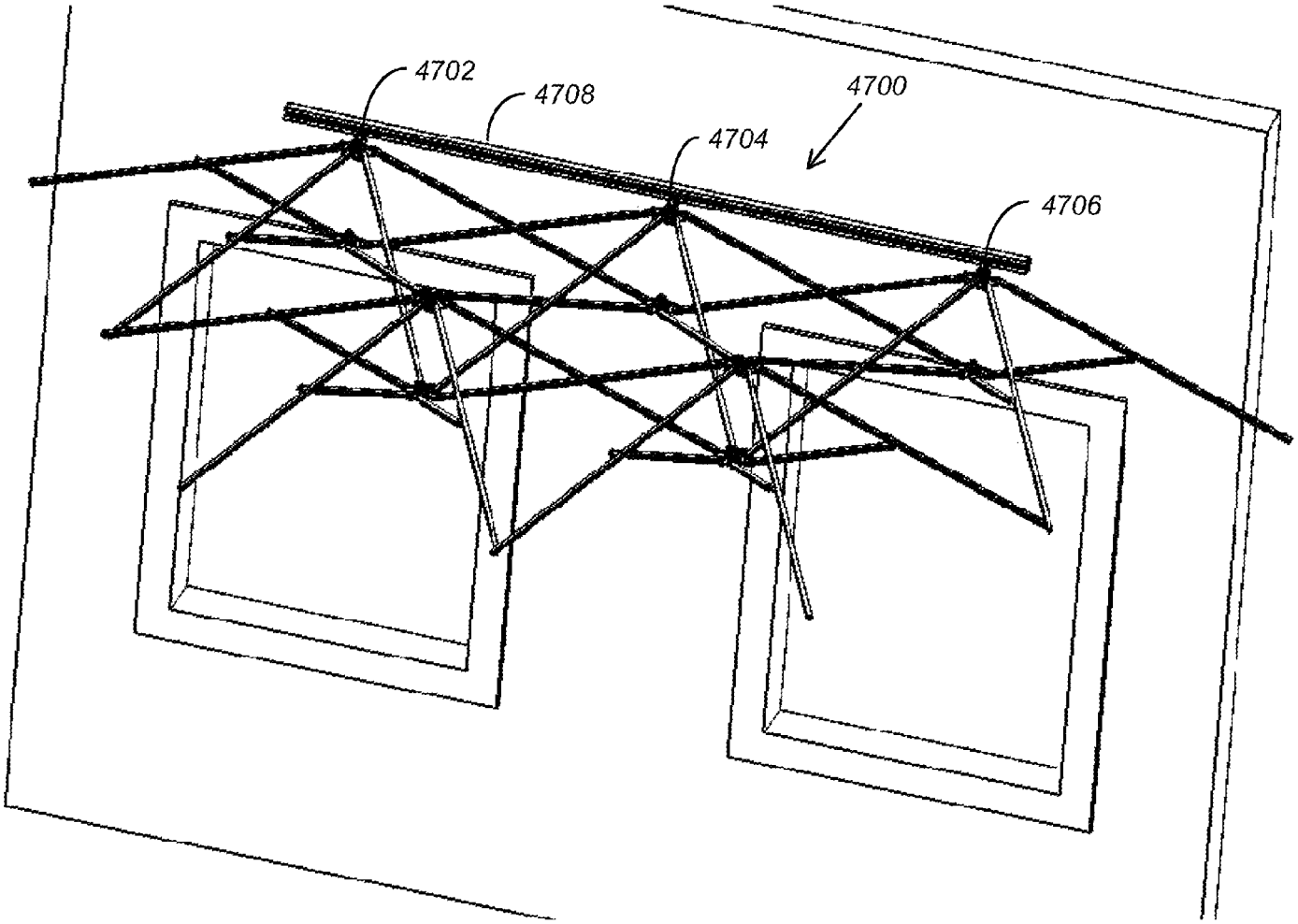
FIG. 47 illustrates the framework of a canopy support structure that is mounted via a row of upper hubs to a horizontal top track.
Figure 52:
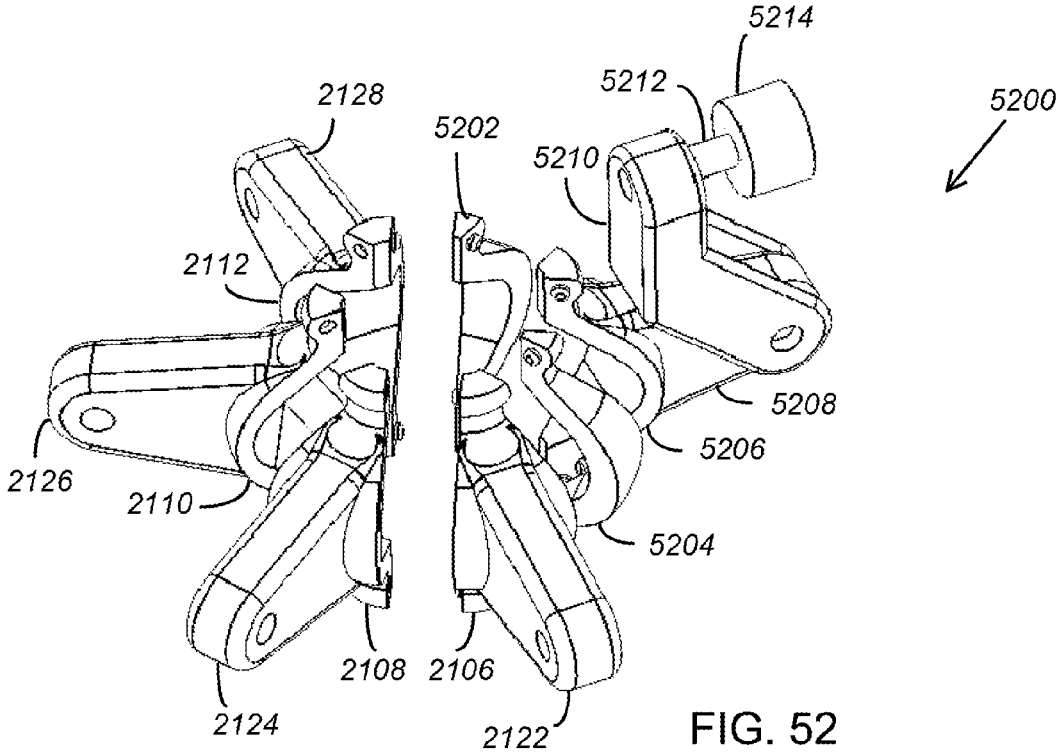
FIG. 52 illustrates a hub configured to mount a canopy support structure to a horizontal track.

In FIG. 47, the framework of a canopy support structure 4700 is mounted via a row of upper hubs 4702, 4704, 4706 to a horizontal top track 4708. In some embodiments, the canopy support structure 4700 could be additionally supported with a vertical track (e.g., similar to the vertical track 4814 shown in FIG. 48). The upper hubs 4702, 4704, 4706 may be constructed similarly to the hub shown in FIG. 21, but with two of the ribbed wedges shown in FIG. 21 replaced with a pair of 15 degree wedge spacers 5202, 5204 and a 45 degree wedge 5206 having a rib 5208. See, for example, the exploded view of upper hub 5200 shown in FIG. 52. An arm 5210 is pivot-mounted at one of its ends to a hole in the rib 5208. An axle 5212 is rotationally mounted to the other end of the arm 5210. A horizontal track roller 5214 is rotationally mounted to the axle 5212.

Figure 48:
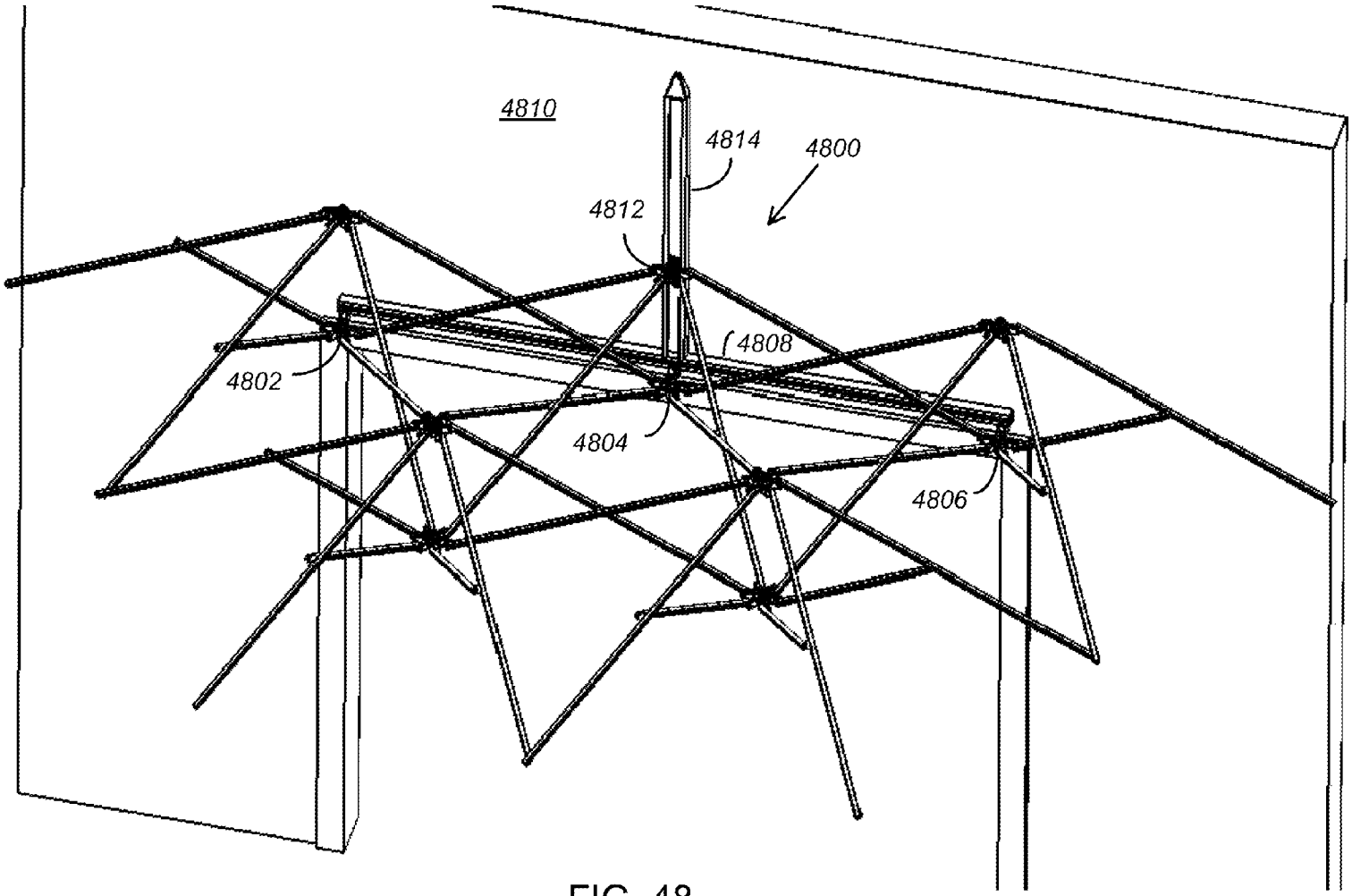
FIG. 48 illustrates the framework of a canopy support structure that is mounted via a row of lower hubs to a horizontal bottom track.
Figure 53:
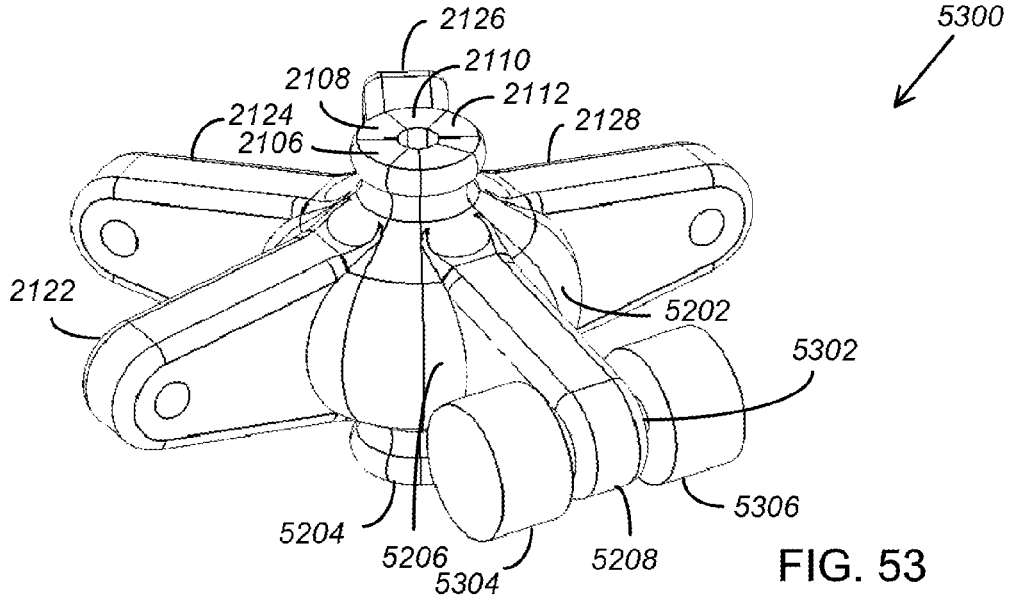
FIG. 53 illustrates a hub configured to mount a canopy support structure to a vertical track.

In FIG. 48, the framework of a canopy support structure 4800 is mounted via a row or lower hubs 4802, 4804, 4806 to a horizontal bottom track 4808. In this embodiment, the lower hubs 4802, 4804, 4806 may be implemented using the hub design 5200 shown in FIG. 52. To provide the canopy support structure 4800 with more stability (e.g., to prevent the structure from tipping or pulling away from the wall 4810), one of the upper hubs 4812 may be slidably or rollably mounted to a vertical track 4814. An exemplary configuration of this upper hub 4812 is shown in FIG. 53. The hub 5300 may be constructed similarly to the hub 5200 (FIG. 53), but with an axle 5302 having vertically rolling rollers 5304, 5306 held by the hole in the wedge's rib 5208 (with the axle 5302 and rollers 5304, 5306 replacing the arm 5210, axle 5212 and horizontal track roller 5214).

Figure 49:
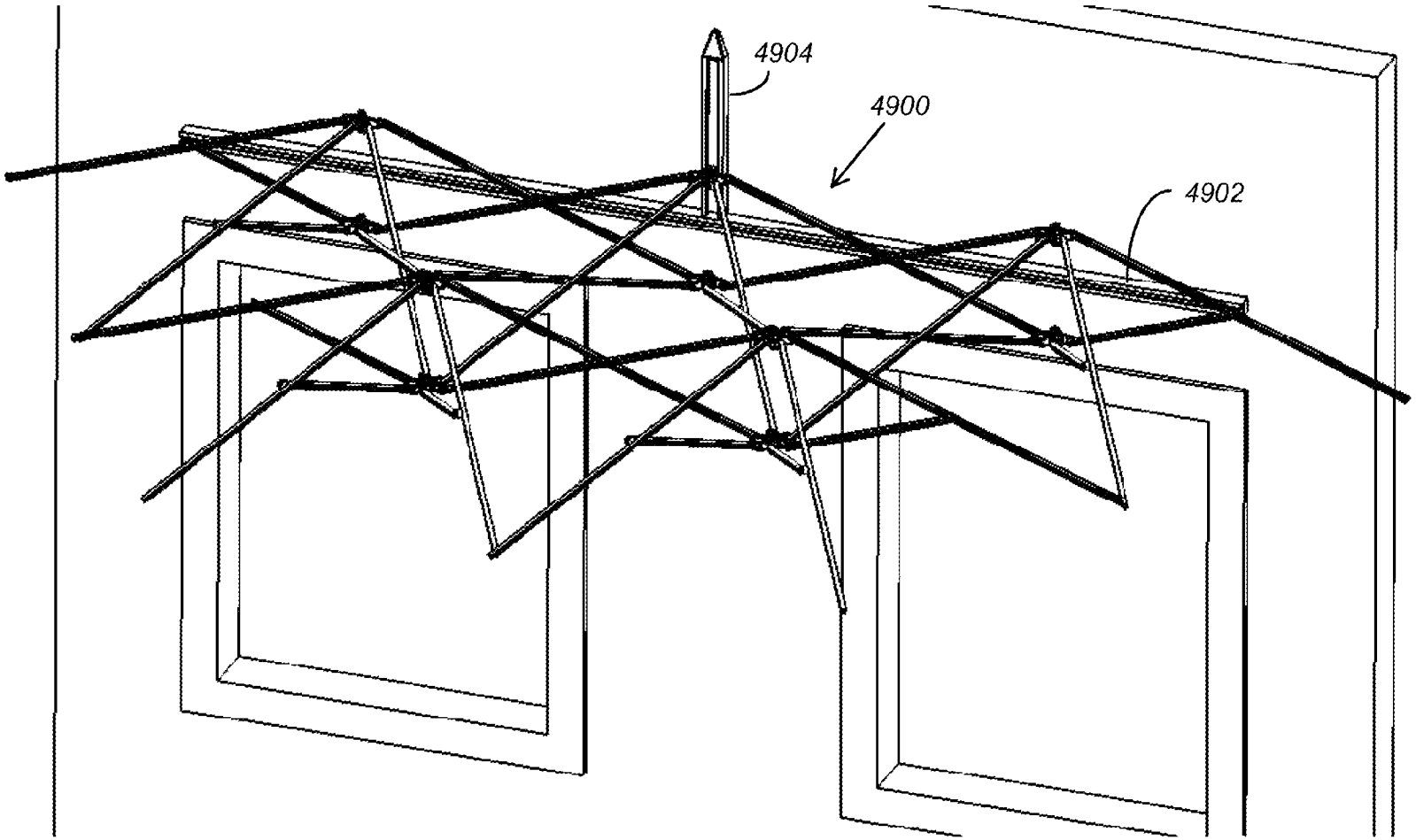
FIG. 49 illustrates the framework of a canopy support structure that is mounted to a horizontal track using rollers coupled to bypass pins.
Figure 50:
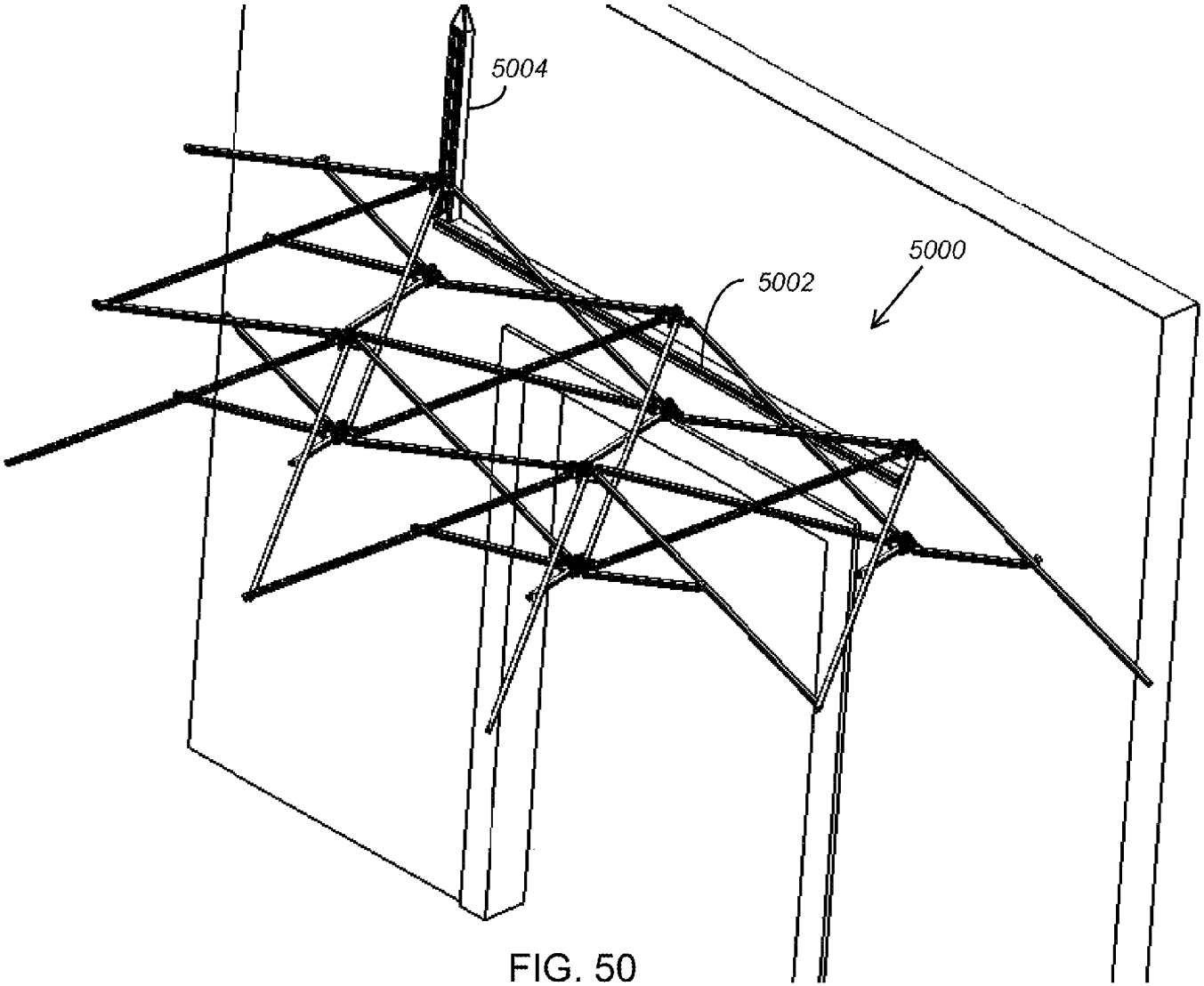
FIGS. 50 & 51 illustrate an alternative embodiment of the canopy support structure shown in FIG. 49, wherein the vertical track is mounted to one side of the horizontal track.
Figure 51:
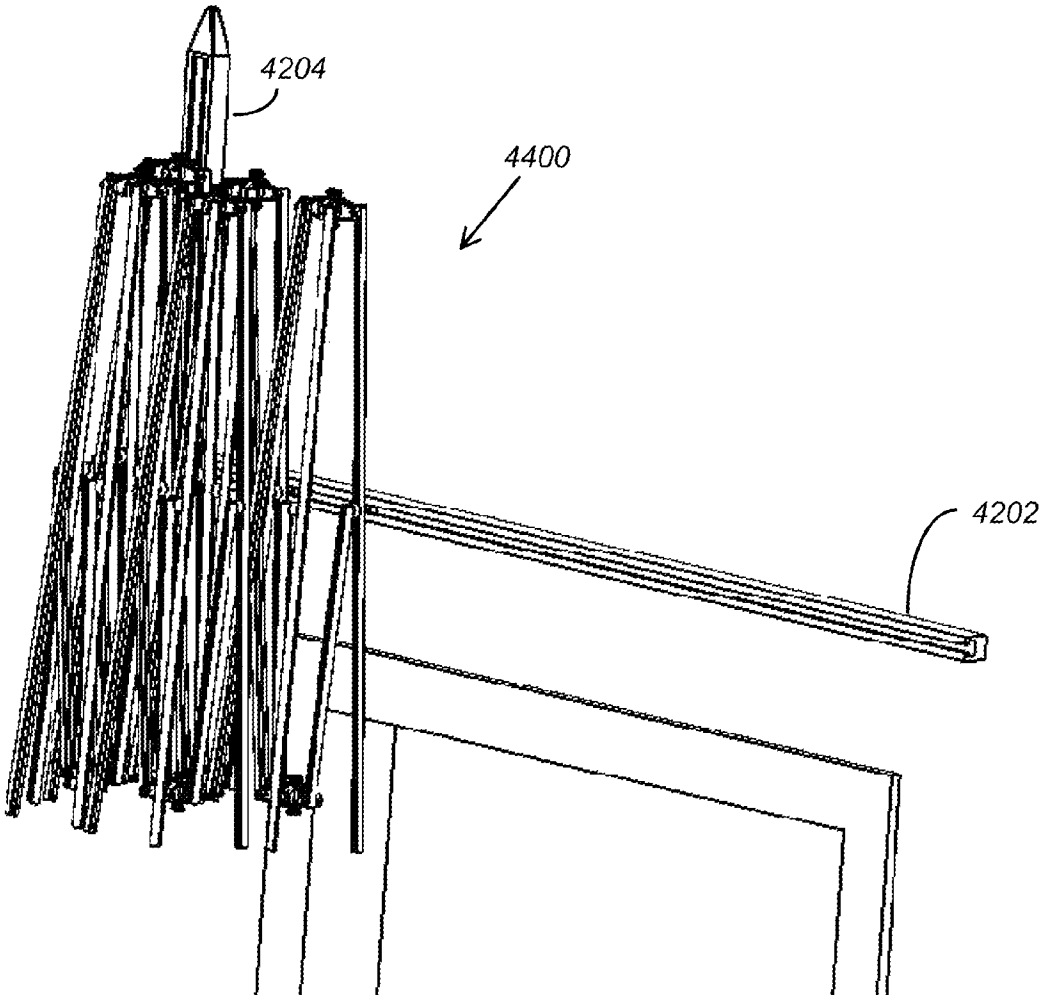

In FIG. 49, the framework of a canopy support structure 4900 is mounted to a horizontal track 4902 using rollers coupled to bypass pins. The embodiment shown in FIG. 49 therefore represents a mid-mounted canopy support structure 4900. Similarly to the FIG. 48 embodiment, a vertical track 4904 may be employed to ensure the stability of the structure 4900. The vertical track 4904 may be centrally mounted with respect to the horizontal track 4202, thereby causing the canopy support structure 4900 to collapse in the center of the horizontal track 4902, or the vertical track 4904 may be mounted to one side of the horizontal track 4904, thereby causing the canopy support structure 4900 to retract to one side of the horizontal track 4902 (as shown in FIGS. 50 & 51). In some awning configurations, the canopy could be attached to the top of the vertical track. Alternatively, the apex of a canopy could be attached directly to a wall at a location independent of either the horizontal or vertical track.

Depending on their configurations, the disclosed canopy support structures can be used to provide various advantages over more conventional canopy support structures. For example, the scissor-like retraction of a canopy support structure enables it to provide more clearance over ground, thereby enabling the canopy support structure to clear the head of a person sitting or standing at a table positioned under the canopy support structure. In contrast, a conventional canopy support structure having a similar height and span barely clears the table. One can appreciate that the circumference of a conventional canopy support structure is limited by the height of its pole and the need for its arms to clear objects like people, tables and the ground when in a closed position. The novel canopy support structures disclosed herein are not so limited, and are capable of larger circumference and/or offset constructions that are not possible using conventional canopy support structures.

Another potential advantage of the disclosed canopy support structures is the ability to construct multiple configurations of canopy support structures using a relatively small number of parts. For example, the same configurations of pole, primary hub components, secondary hub components, suspension hubs and articulating arms can be used to construct the canopy support structures shown in many of the disclosed embodiments. The use of parts that are interchangeable among different configurations of canopy support structure adds simplicity and versatility to a product line of different canopy support structures, and reduces the number of parts that need to be manufactured and inventoried for the product line. Simplicity and versatility in product parts also makes it easier to provide a canopy support structure that a purchaser can assemble on their own (e.g., as a do-it-yourself kit, or from a number of individually purchased parts).

Some of the notable advantages of canopy support structures that are asymmetric or offset with respect to a pole include 1) their ability to be rotated based on the position of the sun, and 2) the ability to position their poles "out of the way" of the area covered by their canopies. Unfortunately, the dimensions of asymmetric or offset canopy support structures have conventionally been limited by the direct relationship between offset arm height and umbrella height. The techniques used for building the canopy support structures disclosed herein overcome the direct relationship between arm height and umbrella height, and enable the construction of larger asymmetric and offset canopy support structures, thereby enabling a canopy user to better capitalize on the inherent advantages of an asymmetric or offset canopy.

Figure 54:
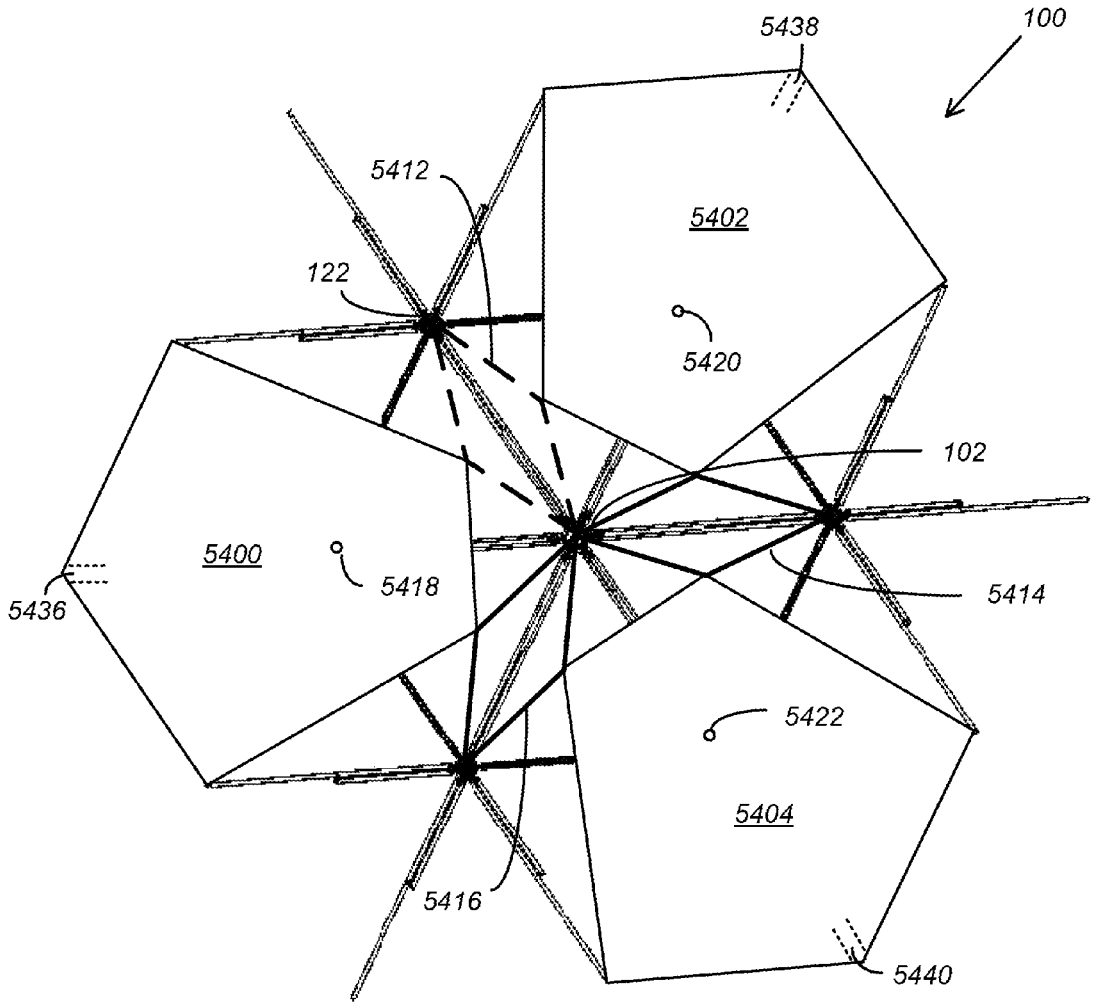
FIGS. 54-57 illustrate a first method for attaching a novel, segmented, self-draining canopy to the canopy support structure shown in FIGS. 1-6.
Figure 55:
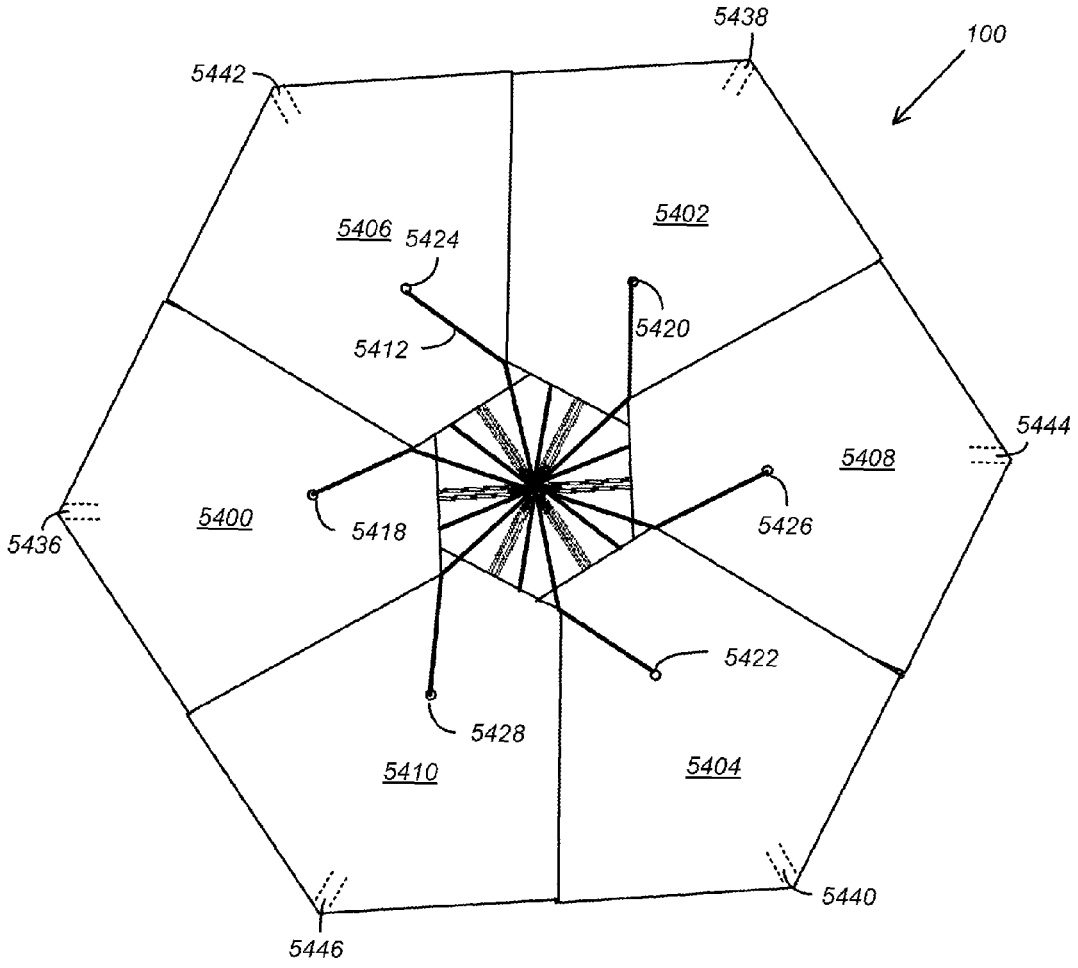

Various types of canopies may be draped over and secured to the canopy support structures disclosed herein. FIGS. 54-57 illustrate how a novel, segmented, self-draining canopy may be attached to the equilattice canopy support structure 100 shown in FIGS. 1-6. To begin, and as illustrated in FIGS. 54 & 55, a plurality of canopy segments 5400, 5402, 5404, 5406, 5408, 5410 may be attached to the canopy support structure 100. Three canopy segments 5400, 5402, 5404 are shown attached to the canopy support structure 100 in FIG. 54. The canopy segments 5400, 5402, 5404 are attached to the canopy support structure 100 by means of pockets 5436, 5438, 5440 that receive the free ends of secondary articulating arms, and by one or more laces 5412, 5414, 5416. Lace 5412 is shown in a broken line for ease of viewing. As shown, the lace 5412 extends from the pole 102, through a grommet or clip on one corner of a first canopy segment 5400, through an eyelet or clip atop the secondary hub 122 (or alternately, through a bracket 2522, 3000 such as the one illustrated in FIG. 25 or 30), through a grommet or clip on one corner of a second canopy segment 5402, and back to pole 102. Each diamond-shaped lacing pattern may be formed separately, or a single cord may provide all of the diamond shaped laces 5412, 5414, 5416. To enable similar attachments of the remaining canopy segments, the canopy segments 5400-5410 may comprise button-holes through which eyelets or clips 5418, 5420, 5422, 5424, 5426, 5428 project. The eyelets or clips 5418-5428 may be attached to the tops of the secondary hubs.

FIG. 55 illustrates attachment of the remaining canopy segments 5406, 5408, 5410. In practice, all of the canopy segments 5400-5410 would be attached more or less in parallel. Preferably, the canopy segments overlay each other like windmill blades, and each diamond-shaped lace extends not only through grommets or clips of two canopy segments (e.g., 5400 & 5402), but through the buttonhole formed in an intermediate canopy segment (e.g., 5406). The canopy segments 5406-5410 have pockets 5442, 5444, 5446 for receiving the ends of respective articulating arms.

Figure 56:
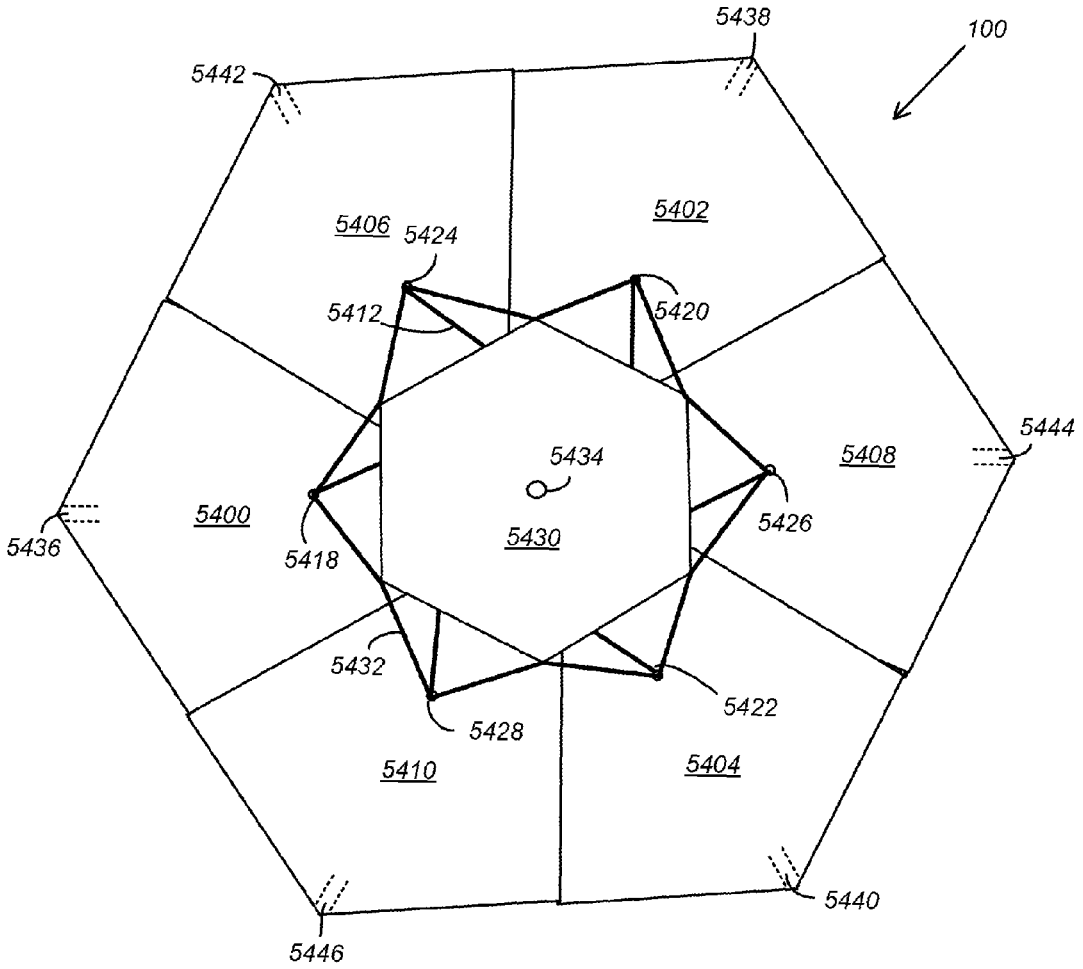

FIG. 56 illustrates attachment of a center segment 5430 of the canopy. The center segment 5430 may comprise a hole for receiving a post or stud that attaches a finial or cap 5434 to the cap 188. Cap 188 is shown in FIG. 1, but is covered by the center segment 5430 in FIG. 56. The center segment 5430 may also have a number of grommets or clips attached to the corners of its hexagonal circumference. In this manner, a lace 5432 may be alternately threaded through ones of the grommets or clips attached to the center segment 5430 and ones of the eyelets or clips attached to the tops of the secondary hubs. Alternately, some or all of the canopy segments 5400-5410, 5430 could be stitched, attached with hook and loop fasteners, or otherwise connected at abutting corners, thereby eliminating some or all of the lacing. Additionally, any or all of the canopy segments 5400-5410, 5430 could be provided with a disconnect mechanism designed to 1) quickly release the canopy segment during a high wind event and provide increased venting, which venting tends to lessen forces that might damage the canopy's support structure, and 2) provide easy re-connection of a canopy segment to the canopy support structure 100.

Figure 57:
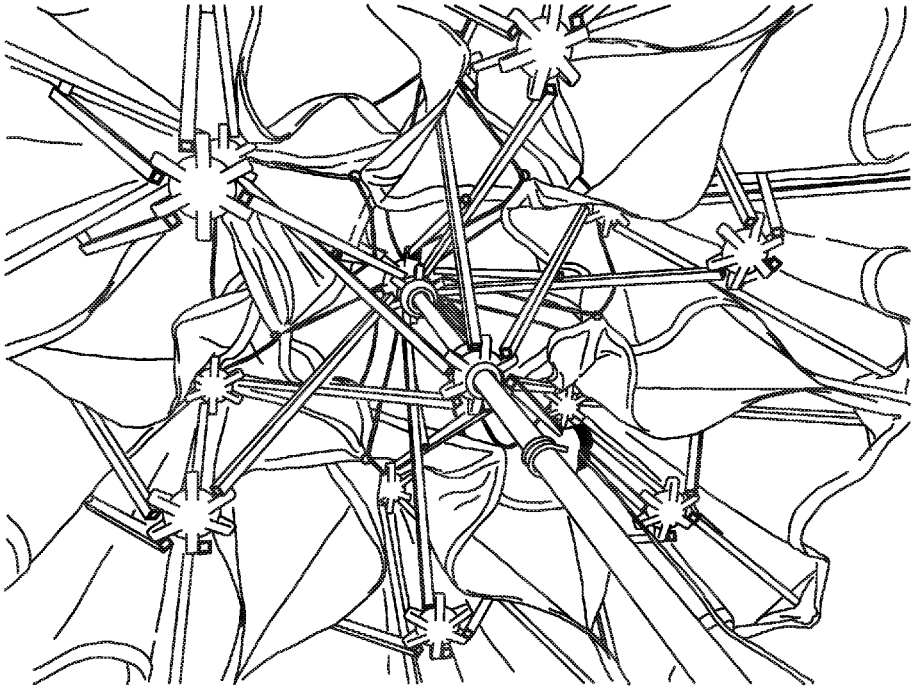

FIG. 57 illustrates how the segments 5400-5410, 5430 of the canopy drape over the various hubs and allow water to self-drain from the canopy when the canopy support structure 100 is in a retracted or partially retracted position. FIG. 57 further illustrates how the operator of a canopy could increase the natural venting potential of the canopy, during moderate winds, by retracting the canopy to varying degrees. Alternatively, a non-segmented canopy may be used in place of the segmented canopy (e.g., in protected areas, where water and debris will not pool in the accordion folds created be the articulating arms, or for uses where the shade structure is brought inside when not in use).

Figure 58:
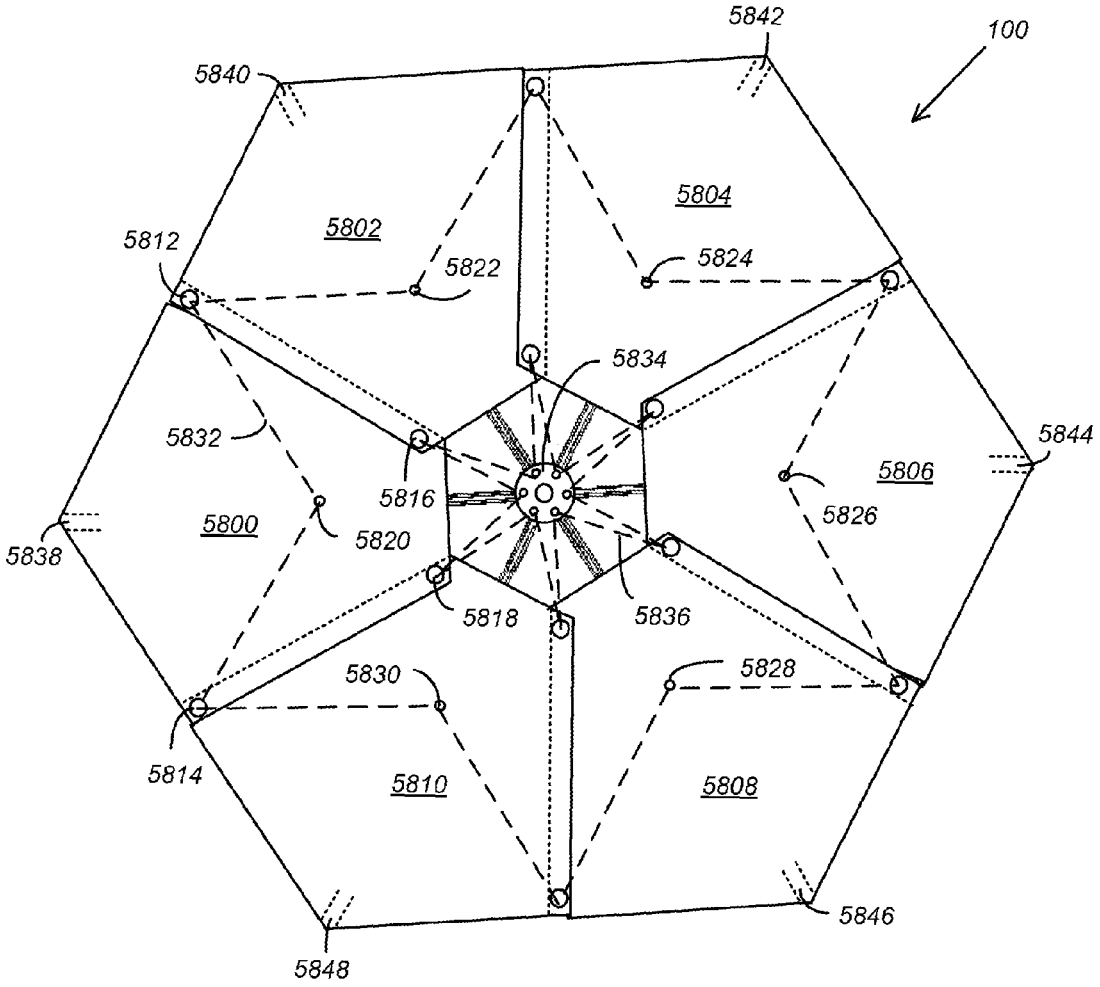
FIG. 58 illustrates a second method for attaching a novel, segmented, self-draining canopy to the canopy support structure shown in FIGS. 1-6.

FIG. 58 illustrates an alternate way to provide and lace outer canopy segments 5800, 5802, 5804, 5806, 5808, 5810 to the canopy support structure 100. The canopy segments 5800-5810 overlay each other like windmill blades. Each of the canopy segments 5800-5810 is attached to the canopy support structure 100 by means of a pocket 5838, 5840, 5842, 5844, 5846, 5848 that receives the free end of a respective secondary articulating arm, and by one or more laces 5832, 5836.

The lace 5832 extends between snaps, clips or grommets (e.g., snaps 5812, 5814) at outer corners of the canopy segments 5800-5810 and eyelets or clips atop the secondary hubs of the canopy support structure 100. Alternately, the lace 5832 may extend through brackets 2522, 3000 such as the ones illustrated in FIG. 25 or 30 instead of through eyelets or clips atop secondary hubs.

The lace 5836 extends between snaps, clips or grommets (e.g., grommets 5816, 5818) at inner corners of the canopy segments 5800-5810 and holes in a suspension hub 5834. By way of example, the suspension hub 5834 may take the form of suspension ring 2000 (FIG. 20).

The segmented, self-draining canopies shown in FIGS. 54-58 may be variously modified, depending on the configuration of the canopy support structure for which the canopy is designed.

While illustrative and presently preferred embodiments of the invention have been described in detail herein, it is to be understood that the inventive concepts may be otherwise variously embodied and employed and are intended to represent a spectrum of design variations and versatility provided by the invention. The appended claims are intended to be construed to include such variations, except as limited by the prior art.

What is claimed is:

1. A pole-mounted canopy support structure, comprising:

a single support pole;

a three-dimensional array of hub pairs, the hubs of each hub pair being movable toward each other during extension of the canopy support structure and away from each other during retraction of the canopy support structure, wherein a first of the hub pairs includes a first hub and a second hub, and wherein each of the first hub and the second hub is coupled to and movable along the single support pole; and a plurality of articulating arms connecting the hub pairs, wherein the articulating arms include sets of scissor-connected primary articulating arms, wherein each of the hub pairs is pivotally connected to at least one other of the hub pairs by a respective set of the scissor-connected primary articulating arms, wherein the plurality of articulating arms includes secondary articulating arms, and wherein each of the secondary articulating arms has a first end that is pivotally connected to one of the hubs in the hub pairs and a second end that hangs free.

2. The pole-mounted canopy support structure of claim 1, wherein at least one of the first hub and the second hub has a number of wheels projecting into a pole-receiving cavity.

3. The pole-mounted canopy support structure of claim 1, further comprising: a suspension hub on the single support pole; and at least one tether coupled between the suspension hub and the articulating arms.

4. The pole-mounted canopy support structure of claim 3, wherein the suspension hub is coupled to and movable along the single support pole.

5. The pole-mounted canopy support structure of claim 4, wherein the suspension hub has a number of wheels projecting into a pole-receiving cavity.

6. The pole-mounted canopy support structure of claim 3, wherein the at least one tether includes a rigid tether.

7. The pole-mounted canopy support structure of claim 3, wherein the at least one tether includes a flexible tether.

8. The pole-mounted canopy support structure of claim 3, wherein the suspension hub is anchored to the single support pole.

9. The pole-mounted canopy support structure of claim 1, wherein the three-dimensional array of hub pairs and the plurality of articulating arms define a three-dimensional articulating lattice structure.

10. The pole-mounted canopy support structure of claim 9, wherein the three-dimensional articulating lattice structure includes an equilateral triangle support structure comprising: a first set of the hubs defining vertices of a first equilateral triangle; a second set of the hubs defining vertices of a second equilateral triangle; and a plurality of the articulating arms connecting the hubs defining the vertices of the first and second equilateral triangles.

11. The pole-mounted canopy support structure of claim 1, wherein the three-dimensional array of hub pairs and the plurality of articulating arms define radial support members extending from the single support pole of the canopy support structure when extended, the canopy support structure further comprising a plurality of lateral support members connected between the radial support members.

12. The pole-mounted canopy support structure of claim 11, wherein the articulating arms and at least one of the lateral support members are rigid.

13. The pole-mounted canopy support structure of claim 11, wherein the articulating arms are rigid and the lateral support members are flexible.

14. The pole-mounted canopy support structure of claim 1, wherein the plurality of articulating arms includes tertiary articulating arms, each of which has a first end that is pivotally connected to one of the hubs in the hub pairs, and a second end that is pivotally connected to an intermediate portion of one of the secondary articulating arms.

15. The pole-mounted canopy support structure of claim 1, wherein at least one of the secondary articulating arms comprises a main body and a telescoping arm that retracts into or extends from the main body.

16. The pole-mounted canopy support structure of claim 1, wherein each of the primary articulating arms in at least one of the sets of scissor-connected primary articulating arms has a main body and a telescoping arm that retracts into or extends from the main body, whereby the telescoping arms can be retracted into or extended from the main bodies to adjust a tilt of part of the canopy support structure.

17. The pole-mounted canopy support structure of claim 1, wherein the hubs of the three-dimensional array of hubs are symmetrically distributed about the pole.

18. The pole-mounted canopy support structure of claim 1, wherein the hubs of the three-dimensional array of hubs are asymmetrically distributed about the pole.

19. The pole-mounted canopy support structure of claim 1, wherein each of at least one of the hub pairs, other than the hub pair including the first and second hubs, comprises: a telescoping mast that slides between retracted and extended positions within a sleeve of a first of the hubs in the hub pair; and a bearing surface on a second of the hubs in the hub pair, wherein the bearing surface presses against the telescoping mast and moves it to its extended position as the canopy support structure is moved to its extended position, and wherein the bearing surface moves away from the telescoping mast and allows the telescoping mast to move to its retracted position as the canopy support structure is retracted.

20. A pole-mounted canopy support structure, comprising:

a single support pole;

first and second hubs coupled to and movable along the pole, the first and second hubs being movable toward each other during extension of the canopy support structure and away from each other during retraction of the canopy support structure; and a plurality of articulating arms, wherein each of the articulating arms is connected directly or indirectly to the first and second hubs, wherein the articulating arms include sets of scissor-connected primary articulating arms, wherein at least some of the sets of scissor-connected primary articulating arms are connected directly to the first and second hubs and extend outward from the first and second hubs during extension of the canopy support structure, and wherein the plurality of articulating arms includes secondary articulating arms and tertiary articulating arms;

wherein each of the secondary articulating arms has a first upper end that is pivotally connected to the canopy support structure via one of the primary articulating arms and a first lower end that hangs free from the canopy support structure for attachment to a canopy, and wherein each of the tertiary articulating arms has a second lower end and a second upper end, the second lower end being pivotally connected to the canopy support structure via another one of the primary articulating arms, and the second upper end being pivotally connected to an intermediate portion of one of the secondary articulating arms.

21. The pole-mounted canopy support structure of claim 20, wherein at least one of the first hub and the second hub has a number of wheels projecting into a pole-receiving cavity.

22. The pole-mounted canopy support structure of claim 20, further comprising a plurality of lateral support members connected between the sets of scissor-connected primary articulating arms, wherein:

a first set of scissor-connected primary articulating arms comprises a first arm connected to the first hub and sloping downward from the first hub, and a second arm connected to the second hub and sloping upward from the second hub;

a second set of scissor-connected primary articulating arms is adjacent the first set of scissor-connected primary articulating arms and comprises a third arm connected to the first hub and sloping downward from the first hub, and a fourth arm connected to the second hub and sloping upward form the second hub;

a first lateral support member is connected between a third lower end of the first arm and a third upper end of the fourth arm; and a second lateral support member is connected between a fourth upper end of the second arm and a fourth lower end of the third arm.

23. The pole-mounted canopy support structure of claim 22, wherein the articulating arms and at least one of the lateral support members are rigid.

24. The pole-mounted canopy support structure of claim 22, wherein the articulating arms are rigid and the lateral support members are flexible.

25. The pole-mounted canopy support structure of claim 20, further comprising: a suspension hub on the single support pole; and at least one tether coupled between the suspension hub and the articulating arms.

26. The pole-mounted canopy support structure of claim 25, wherein the suspension hub is coupled to and movable along the single support pole.

27. The pole-mounted canopy support structure of claim 26, wherein the suspension hub has a number of wheels projecting into a pole-receiving cavity.

28. The pole-mounted canopy support structure of claim 25, wherein the at least one tether includes a rigid tether.

29. The pole-mounted canopy support structure of claim 25, wherein the at least one tether includes a flexible tether.

30. The pole-mounted canopy support structure of claim 25, wherein the suspension hub is anchored to the single support pole.

31. The pole-mounted canopy support structure of claim 20, wherein at least one of the secondary articulating arms comprises a main body and a telescoping arm that retracts into or extends from the main body.

32. The pole-mounted canopy support structure of claim 20, wherein each of the primary articulating arms in at least one of the sets of scissor-connected primary articulating arms has a main body and a telescoping arm that retracts into or extends from the main body, whereby the telescoping arms can be retracted into or extended from the main bodies to adjust a tilt of part of the canopy support structure.

33. The pole-mounted canopy support structure of claim 20, wherein each primary articulating arm is connected to one of the secondary articulating arms or one of the tertiary articulating arms by a bracket.

* * * * *